US011619119B1

(12) United States Patent
Roper et al.

(10) Patent No.: US 11,619,119 B1
(45) Date of Patent: Apr. 4, 2023

(54) DOWNHOLE GUN TUBE EXTENSION

(71) Applicant: Integrated Solutions, Inc., Phoenix, AZ (US)

(72) Inventors: Brian Keith Roper, Phoenix, AZ (US); Todd K. Roper, Phoenix, AZ (US)

(73) Assignee: Integrated Solutions, Inc., Phoenix, AZ (US)

( * ) Notice: Subject to any disclaimer, the term of this patent is extended or adjusted under 35 U.S.C. 154(b) by 0 days.

(21) Appl. No.: 17/228,692

(22) Filed: Apr. 12, 2021

Related U.S. Application Data

(60) Provisional application No. 63/008,481, filed on Apr. 10, 2020.

(51) Int. Cl.
*E21B 43/119* (2006.01)
*E21B 47/024* (2006.01)
*E21B 43/1185* (2006.01)

(52) U.S. Cl.
CPC ..... *E21B 43/119* (2013.01); *E21B 43/11855* (2013.01); *E21B 47/024* (2013.01)

(58) Field of Classification Search
CPC ..... E21B 43/116; E21B 43/119; E21B 43/11855; E21B 47/024
See application file for complete search history.

(56) References Cited

U.S. PATENT DOCUMENTS 2,062,974 A * 12/1936 Lane ..... E21B 43/116 89/27.11
4,234,768 A 11/1980 Boop
4,527,636 A 7/1985 Bordon
RE32,755 E 9/1988 Vann
4,815,540 A 3/1989 Wallbillich, III
4,829,901 A 5/1989 Yates, Jr.
4,830,120 A 5/1989 Stout
4,886,126 A 12/1989 Yates, Jr.
4,917,187 A 4/1990 Burns et al.
4,949,793 A 8/1990 Rubbo et al.
(Continued)

FOREIGN PATENT DOCUMENTS

GB 2442975 4/2008
GB 2513934 11/2014
(Continued)

OTHER PUBLICATIONS

Schlumberger Brochure, "ASFS Addressable-Switch Firing System," (2014).

*Primary Examiner* — Dany E Akakpo
(74) *Attorney, Agent, or Firm* — Snell & Wilmer L.L.P.

(57) ABSTRACT

A gun-tube extension has (1) a body portion, (2) a first end configured to connect to an end cap of a gun tube, and (3) a second end configured to be connected to a sub-assembly. The gun-tube extension may rotate either by the operation of gravity on weights or by a motor. The gun-tube extension may include an orientation-detection device, such as an accelerometer, which may be part of an addressable switch. A ground for a gun tube or gun-tube extension may include a bow spring attached to and in electrical communication with the gun tube housing or the gun-tube extension housing. An end cap may include indexing indicia to orient a gun tube to a desired rotational position and/or may be structured to fit different diameter gun tubes.

20 Claims, 69 Drawing Sheets

(56) References Cited

U.S. PATENT DOCUMENTS 4,979,567 A 12/1990 Rubbo
5,016,716 A 5/1991 Donovan et al.
5,025,861 A 6/1991 Huber et al.
5,044,441 A 9/1991 Rubbo et al.
5,067,568 A 11/1991 Yates, Jr. et al.
5,076,355 A 12/1991 Donovan et al.
5,131,472 A 7/1992 Dees et al.
5,156,213 A 10/1992 George et al.
5,226,494 A 7/1993 Rubbo et al.
RE34,451 E 11/1993 Donovan et al.
5,303,772 A 4/1994 George et al.
5,320,176 A 6/1994 Naquin et al.
5,327,974 A 7/1994 Donovan et al.
5,346,014 A 9/1994 Ross
5,370,186 A 12/1994 Ireland
5,398,760 A 3/1995 George et al.
5,462,117 A 10/1995 Green et al.
5,526,880 A 6/1996 Jordan et al.
5,603,379 A * 2/1997 Henke ..... E21B 43/1185 175/4.51
5,611,401 A 3/1997 Myers et al.
5,662,170 A 9/1997 Donovan et al.
5,680,905 A 10/1997 Green et al.
6,055,213 A 4/2000 Rubbo et al.
6,105,688 A 8/2000 Vaynshteyn et al.
6,142,231 A 11/2000 Myers et al.
6,148,916 A 11/2000 Sampson et al.
6,246,962 B1 6/2001 Schultz et al.
6,283,156 B1 9/2001 Motley
6,283,227 B1 9/2001 Lerche et al.
6,286,598 B1 9/2001 van Petegem et al.
6,295,912 B1 10/2001 Burleson et al.
6,296,066 B1 10/2001 Terry et al.
6,298,915 B1 10/2001 George
6,310,829 B1 10/2001 Green et al.
6,321,838 B1 11/2001 Skinner
6,325,146 B1 12/2001 Ringgenberg et al.
6,329,407 B1 12/2001 Jahne et al.
6,333,784 B1 12/2001 Blasi et al.
6,371,219 B1 4/2002 Collins et al.
6,378,438 B1 4/2002 Lussier et al.
6,414,905 B1 7/2002 Owens et al.
6,435,278 B1 8/2002 Barlow et al.
6,439,121 B1 8/2002 Gillingham
6,446,720 B1 9/2002 Ringgenberg et al.
6,450,258 B2 9/2002 Green et al.
6,459,383 B1 10/2002 Delatorre
6,487,973 B1 12/2002 Gilbert, Jr. et al.
6,494,260 B2 12/2002 van Petegem et al.
6,497,284 B2 12/2002 van Petegem et al.
6,536,350 B2 3/2003 Cartland et al.
6,564,866 B2 5/2003 Clark et al.
6,566,635 B1 5/2003 Matsen et al.
6,591,912 B2 7/2003 Ross et al.
6,595,290 B2 7/2003 George et al.
6,604,584 B2 8/2003 Lerche et al.
6,626,241 B2 9/2003 Nguyen
6,630,668 B1 10/2003 Cramer et al.
6,637,339 B1 10/2003 Petzold et al.
6,653,608 B1 11/2003 Matsen et al.
6,658,981 B2 12/2003 Rochen et al.
6,679,323 B2 1/2004 Vargervik et al.
6,679,327 B2 1/2004 Sloan et al.
6,684,954 B2 2/2004 George
6,708,761 B2 3/2004 George et al.
6,723,709 B1 4/2004 Pressato et al.
6,729,398 B2 5/2004 Ringgenberg et al.
6,736,984 B2 5/2004 Golecki
6,748,843 B1 6/2004 Barker et al.
6,758,124 B2 7/2004 Barker et al.
6,793,017 B2 9/2004 Nguyen et al.
6,820,693 B2 11/2004 Hales et al.
6,823,902 B2 11/2004 Rudesill et al.
6,843,318 B2 1/2005 Yarbro
6,843,320 B2 1/2005 Yarbro
6,851,471 B2 2/2005 Barlow et al.
6,877,561 B2 4/2005 Richard et al.
6,880,637 B2 4/2005 Myers et al.
6,920,933 B2 7/2005 Watson et al.
6,941,627 B2 9/2005 Fritsche et al.
6,944,095 B2 9/2005 Thomas
6,955,217 B2 10/2005 Clark et al.
7,000,699 B2 2/2006 Yang et al.
7,007,756 B2 3/2006 Lerche et al.
7,013,977 B2 3/2006 Nordaas
7,016,261 B2 3/2006 Quinn et al.
7,021,375 B2 4/2006 Ringgenberg et al.
7,044,236 B2 5/2006 Iversen et al.
7,066,261 B2 6/2006 Vicente et al.
7,073,579 B2 7/2006 Ringgenberg et al.
7,086,463 B2 8/2006 Ringgenberg et al.
7,116,542 B2 10/2006 Lerche et al.
7,172,023 B2 2/2007 Barker et al.
7,178,213 B2 2/2007 Haas et al.
7,210,524 B2 5/2007 Sloan et al.
7,229,701 B2 6/2007 Madhava et al.
7,231,982 B2 6/2007 Sloan et al.
7,237,486 B2 7/2007 Myers, Jr. et al.
7,237,487 B2 7/2007 Myers, Jr. et al.
7,243,725 B2 7/2007 George et al.
7,246,659 B2 7/2007 Fripp et al.
7,266,917 B2 9/2007 Ryan et al.
7,295,491 B2 11/2007 Carstensen
7,299,961 B2 11/2007 Stavig, Jr. et al.
7,303,017 B2 12/2007 Barker et al.
7,308,461 B2 12/2007 Iwatsu
7,322,416 B2 1/2008 Burris et al.
7,339,852 B2 3/2008 Gordy et al.
7,342,230 B2 3/2008 Adamski
7,360,487 B2 4/2008 Myers, Jr. et al.
7,387,156 B2 6/2008 Drummond et al.
7,395,987 B2 7/2008 Lindquist et al.
7,428,922 B2 9/2008 Fripp et al.
7,431,080 B2 10/2008 Wright et al.
7,526,850 B2 5/2009 Haas et al.
7,530,311 B2 5/2009 Koekemoer et al.
7,540,326 B2 6/2009 Rytlewski
7,556,695 B2 7/2009 Strangman et al.
7,565,927 B2 7/2009 Gerez et al.
7,575,702 B2 8/2009 Obrachta
7,581,498 B2 9/2009 Hetz et al.
7,591,212 B2 9/2009 Myers, Jr. et al.
7,595,633 B2 9/2009 Martin et al.
7,600,568 B2 10/2009 Ross et al.
7,602,827 B2 10/2009 Okuda
7,607,379 B2 10/2009 Rospek et al.
7,610,969 B2 11/2009 LaGrange et al.
7,624,807 B2 12/2009 Vick, Jr.
7,648,740 B2 1/2010 Slaughter
7,650,947 B2 1/2010 Henke et al.
7,665,529 B2 2/2010 Farquhar et al.
7,686,082 B2 3/2010 Marsh
7,710,545 B2 5/2010 Cramblitt et al.
7,721,649 B2 5/2010 Hetz et al.
7,721,820 B2 5/2010 Hill et al.
7,730,951 B2 6/2010 Suijaatmadja et al.
7,735,578 B2 6/2010 Loehr et al.
7,752,971 B2 7/2010 Loehr
7,757,767 B2 7/2010 Hill et al.
7,762,172 B2 7/2010 Li et al.
7,762,247 B2 7/2010 Evans
7,770,662 B2 8/2010 Harvey et al.
7,806,035 B2 10/2010 Kaiser et al.
7,810,552 B2 10/2010 Slaughter
7,828,051 B2 11/2010 Walker
7,829,011 B2 11/2010 Slaughter
7,857,066 B2 12/2010 DiFoggio et al.
7,861,609 B2 1/2011 Haggerty et al.
7,861,784 B2 1/2011 Burleson et al.
7,866,372 B2 1/2011 Slaughter
7,866,377 B2 1/2011 Slaughter
7,934,558 B2 5/2011 Hales et al.
7,942,098 B2 5/2011 Han et al.
7,946,344 B2 5/2011 Braithwaite et al.

(56) References Cited

U.S. PATENT DOCUMENTS

| | | | |
|---|---|---|---|
| 7,955,568 | B2 | 6/2011 | Ullman et al. |
| 7,980,308 | B2 | 7/2011 | Myers, Jr. et al. |
| 7,980,309 | B2 | 7/2011 | Crawford |
| 8,002,035 | B2 | 8/2011 | Hales et al. |
| 8,006,427 | B2 | 8/2011 | Blevins et al. |
| 8,006,762 | B2 | 8/2011 | Burleson et al. |
| 8,035,370 | B2 | 10/2011 | Jackson et al. |
| 8,061,425 | B2 | 11/2011 | Hales et al. |
| 8,061,426 | B2 | 11/2011 | Suijaatmadja |
| 8,061,431 | B2 | 11/2011 | Moore et al. |
| 8,066,083 | B2 | 11/2011 | Hales et al. |
| 8,074,737 | B2 | 12/2011 | Hill et al. |
| 8,091,447 | B2 | 1/2012 | Garabello et al. |
| 8,091,638 | B2 | 1/2012 | Dusterhoft et al. |
| 8,127,846 | B2 | 3/2012 | Hill et al. |
| 8,136,608 | B2 | 3/2012 | Goodman |
| 8,143,119 | B2 | 3/2012 | Sakoh et al. |
| 8,152,107 | B1 | 4/2012 | Toombs |
| 8,157,022 | B2 | 4/2012 | Bertoja et al. |
| 8,181,718 | B2 | 5/2012 | Burleson et al. |
| 8,186,259 | B2 | 5/2012 | Burleson et al. |
| 8,213,151 | B2 | 7/2012 | Nelson et al. |
| 8,223,591 | B2 | 7/2012 | Chelminski |
| 8,230,946 | B2 | 7/2012 | Crawford et al. |
| 8,256,337 | B2 | 9/2012 | Hill et al. |
| 8,264,814 | B2 | 9/2012 | Love et al. |
| 8,267,172 | B2 | 9/2012 | Suijaatmadja et al. |
| 8,276,656 | B2 | 10/2012 | Goodman |
| 8,286,697 | B2 | 10/2012 | Evans et al. |
| 8,286,706 | B2 | 10/2012 | McCann et al. |
| 8,307,743 | B2 | 11/2012 | Hsu |
| 8,307,904 | B2 | 11/2012 | Suijaatmadja |
| 8,336,437 | B2 | 12/2012 | Barlow et al. |
| 8,347,962 | B2 | 1/2013 | Sampson et al. |
| 8,365,376 | B2 | 2/2013 | Reid et al. |
| 8,365,814 | B2 | 2/2013 | Hill et al. |
| 8,369,063 | B2 | 2/2013 | Vicente |
| 8,381,822 | B2 | 2/2013 | Hales et al. |
| 8,387,226 | B2 | 3/2013 | Weigel, Jr. et al. |
| 8,387,814 | B2 | 3/2013 | Zheng |
| 8,393,392 | B2 | 3/2013 | Mytopher et al. |
| 8,393,393 | B2 | 3/2013 | Rodgers et al. |
| 8,408,285 | B2 | 4/2013 | Lian et al. |
| 8,418,764 | B2 | 4/2013 | Dusterhoft et al. |
| 8,424,606 | B2 | 4/2013 | Zhan et al. |
| 8,439,114 | B2 | 5/2013 | Parrott et al. |
| 8,490,686 | B2 | 7/2013 | Rodgers et al. |
| 8,540,021 | B2 | 9/2013 | McCarter et al. |
| 8,544,563 | B2 | 10/2013 | Bourne et al. |
| 8,549,905 | B2 | 10/2013 | Brooks et al. |
| 8,555,764 | B2 | 10/2013 | Le et al. |
| 8,576,090 | B2 | 11/2013 | Lerche et al. |
| 8,584,763 | B2 | 11/2013 | Hales et al. |
| 8,596,378 | B2 | 12/2013 | Mason et al. |
| 8,597,076 | B2 | 12/2013 | Krienke et al. |
| 8,607,863 | B2 | 12/2013 | Fripp et al. |
| 8,672,031 | B2 | 3/2014 | Vaynshteyn |
| 8,678,261 | B2 | 3/2014 | Lee |
| 8,689,868 | B2 | 4/2014 | Lerche et al. |
| 8,695,506 | B2 | 4/2014 | Lanclos |
| 8,714,251 | B2 | 5/2014 | Glenn et al. |
| 8,714,252 | B2 | 5/2014 | Glenn et al. |
| 8,716,627 | B2 | 5/2014 | Saunders et al. |
| 8,728,245 | B2 | 5/2014 | Dufresne et al. |
| 8,739,673 | B2 | 6/2014 | Le et al. |
| 8,740,071 | B1 | 6/2014 | Higgs et al. |
| 8,746,331 | B2 | 6/2014 | Kash et al. |
| 8,790,587 | B2 | 7/2014 | Singh et al. |
| 8,794,326 | B2 | 8/2014 | Le et al. |
| 8,794,335 | B2 | 8/2014 | Fadul et al. |
| 8,807,003 | B2 | 8/2014 | Le et al. |
| 8,807,206 | B2 | 8/2014 | Walker |
| 8,807,210 | B2 | 8/2014 | Smith et al. |
| 8,807,213 | B2 | 8/2014 | Walket et al. |
| 8,831,739 | B2 | 9/2014 | McCreery et al. |
| 8,839,863 | B2 | 9/2014 | Hetz et al. |
| 8,839,873 | B2 | 9/2014 | Johnson et al. |
| 8,844,625 | B2 | 9/2014 | Mhaskar et al. |
| 8,851,160 | B2 | 10/2014 | Stolboushkin |
| 8,875,796 | B2 | 11/2014 | Hales et al. |
| 8,881,816 | B2 | 11/2014 | Glenn et al. |
| 8,884,778 | B2 | 11/2014 | Lerche et al. |
| 8,893,605 | B1 | 11/2014 | Hester, Jr. et al. |
| 8,893,785 | B2 | 11/2014 | Skinner et al. |
| 8,899,322 | B2 | 12/2014 | Cresswell et al. |
| 8,899,346 | B2 | 12/2014 | Dagenais et al. |
| 8,910,556 | B2 | 12/2014 | Umphries et al. |
| 8,910,713 | B2 | 12/2014 | Zuklic et al. |
| 8,910,716 | B2 | 12/2014 | Newton et al. |
| 8,919,236 | B2 | 12/2014 | Bell et al. |
| 8,919,253 | B2 | 12/2014 | Sampson et al. |
| 8,919,443 | B2 | 12/2014 | Parker et al. |
| 8,931,389 | B2 | 1/2015 | Brooks et al. |
| 8,943,943 | B2 | 2/2015 | Tassaroli |
| 8,960,288 | B2 | 2/2015 | Sampson |
| 8,960,289 | B2 | 2/2015 | Zhang et al. |
| 8,963,827 | B2 | 2/2015 | Kim et al. |
| 8,965,044 | B1 | 2/2015 | Owechko |
| 8,967,257 | B2 | 3/2015 | Fadul et al. |
| 8,971,152 | B2 | 3/2015 | Chelminski |
| 8,978,749 | B2 | 3/2015 | Rodgers et al. |
| 8,985,023 | B2 | 3/2015 | Mason |
| 8,985,200 | B2 | 3/2015 | Rodgers et al. |
| 8,991,496 | B2 | 3/2015 | Bishop |
| 9,004,185 | B2 | 4/2015 | Madero et al. |
| 9,027,456 | B2 | 5/2015 | Mhaskar |
| 9,062,534 | B2 | 6/2015 | Evans et al. |
| 9,068,411 | B2 | 6/2015 | O'Connor et al. |
| 9,068,449 | B2 | 6/2015 | Suijaatmadja |
| 9,080,431 | B2 | 7/2015 | Bell et al. |
| 9,080,433 | B2 | 7/2015 | Lanclos et al. |
| 9,086,085 | B2 | 7/2015 | Lubchansky et al. |
| 9,091,152 | B2 | 7/2015 | Rodgers et al. |
| 9,115,572 | B1 | 8/2015 | Hardesty et al. |
| 9,121,265 | B2 | 9/2015 | Myers et al. |
| 9,133,695 | B2 | 9/2015 | Xu |
| 9,134,170 | B2 | 9/2015 | Mefford et al. |
| 9,145,763 | B1 | 9/2015 | Sites, Jr. |
| 9,146,295 | B2 | 9/2015 | Jiang et al. |
| 9,157,718 | B2 | 10/2015 | Ross |
| 9,174,381 | B1 | 11/2015 | Morales |
| 9,175,553 | B2 | 11/2015 | McCann et al. |
| 9,187,990 | B2 | 11/2015 | Xu |
| 9,194,219 | B1 | 11/2015 | Hardesty et al. |
| 9,200,487 | B2 | 12/2015 | Draper et al. |
| 9,206,675 | B2 | 12/2015 | Hales et al. |
| 9,217,305 | B2 | 12/2015 | Coles et al. |
| 9,222,339 | B2 | 12/2015 | Mason et al. |
| 9,238,956 | B2 | 1/2016 | Martinez |
| 9,272,337 | B2 | 3/2016 | Steppan et al. |
| 9,284,819 | B2 | 3/2016 | Tolman et al. |
| 9,284,824 | B2 | 3/2016 | Fadul et al. |
| 9,291,040 | B1 | 3/2016 | Hardesty et al. |
| 9,297,228 | B2 | 3/2016 | Martinez et al. |
| 9,310,284 | B2 | 4/2016 | Grahma et al. |
| 9,366,372 | B2 | 6/2016 | Nakazono et al. |
| 9,382,783 | B2 | 7/2016 | Langford et al. |
| 9,394,767 | B2 | 7/2016 | Brooks et al. |
| 9,428,988 | B2 | 8/2016 | Frazier |
| 9,441,438 | B2 | 9/2016 | Allison et al. |
| 9,446,444 | B2 | 9/2016 | Christensen et al. |
| 9,447,678 | B2 | 9/2016 | Walter et al. |
| 9,476,289 | B2 | 10/2016 | Wells |
| 9,476,290 | B2 | 10/2016 | Umphries et al. |
| 9,488,024 | B2 | 11/2016 | Hoffman et al. |
| 9,506,317 | B2 | 11/2016 | Craig et al. |
| 9,506,333 | B2 | 11/2016 | Castillo et al. |
| 9,518,454 | B2 | 12/2016 | Current et al. |
| 9,520,219 | B2 | 12/2016 | LaGrange et al. |
| 9,520,249 | B2 | 12/2016 | Bonavides |
| 9,523,271 | B2 | 12/2016 | Bonavides et al. |
| 9,528,360 | B2 | 12/2016 | Castillo et al. |
| 9,530,581 | B2 | 12/2016 | Bonavides et al. |
| 9,534,484 | B2 | 1/2017 | Wright et al. |

(56) References Cited

U.S. PATENT DOCUMENTS

| | | | |
|---|---|---|---|
| 9,535,015 | B2 | 1/2017 | Isomura |
| 9,540,913 | B2 | 1/2017 | Moore |
| 9,540,919 | B2 | 1/2017 | Castillo et al. |
| 9,545,697 | B2 | 1/2017 | Whinnem et al. |
| 9,557,212 | B2 | 1/2017 | Xia et al. |
| 9,562,364 | B1 | 2/2017 | Lehr |
| 9,562,421 | B2 | 2/2017 | Hardesty et al. |
| 9,562,736 | B2 | 2/2017 | Grossnickle et al. |
| 9,581,422 | B2 | 2/2017 | Preiss et al. |
| 9,593,548 | B2 | 3/2017 | Hill et al. |
| 9,593,560 | B2 | 3/2017 | Mailand et al. |
| 9,598,940 | B2 | 3/2017 | Rodgers et al. |
| 9,598,941 | B1 | 3/2017 | Upchurch et al. |
| 9,605,937 | B2 | 3/2017 | Eitschberger et al. |
| 9,606,214 | B2 | 3/2017 | Kelchner et al. |
| 9,611,709 | B2 | 4/2017 | O'Malley |
| 9,617,814 | B2 | 4/2017 | Seals et al. |
| 9,625,226 | B2 | 4/2017 | Lee et al. |
| 9,631,462 | B2 | 4/2017 | Tirado et al. |
| 9,649,682 | B2 | 5/2017 | Keener |
| 9,650,857 | B2 | 5/2017 | Mailand et al. |
| 9,677,363 | B2 | 6/2017 | Schacherer et al. |
| 9,689,223 | B2 | 6/2017 | Schacherer et al. |
| 9,689,237 | B2 | 6/2017 | Johnson et al. |
| 9,689,238 | B2 | 6/2017 | Hardesty et al. |
| 9,689,239 | B2 | 6/2017 | Hardesty |
| 9,695,646 | B2 | 7/2017 | Grice |
| 9,702,029 | B2 | 7/2017 | Fripp et al. |
| 9,708,894 | B2 | 7/2017 | Ditzler et al. |
| 9,719,339 | B2 | 8/2017 | Richard et al. |
| 9,725,993 | B1 | 8/2017 | Yang et al. |
| 9,745,836 | B2 | 8/2017 | Zevenbergen et al. |
| 9,745,847 | B2 | 8/2017 | Ditzler |
| 9,750,162 | B2 | 8/2017 | Szarek |
| 9,752,423 | B2 | 9/2017 | Lynk |
| 9,759,049 | B2 | 9/2017 | Hardesty et al. |
| 9,759,356 | B2 | 9/2017 | Ott et al. |
| 9,765,601 | B1 | 9/2017 | Yang et al. |
| 9,776,767 | B2 | 10/2017 | DeJesus et al. |
| 9,789,506 | B2 | 10/2017 | Kosta |
| 9,803,455 | B1 | 10/2017 | Yang et al. |
| 9,810,036 | B2 | 11/2017 | Mailand et al. |
| 9,810,047 | B2 | 11/2017 | Filyukov et al. |
| 9,816,791 | B2 | 11/2017 | Erickson et al. |
| 9,822,618 | B2 | 11/2017 | Eitschberger |
| 9,823,053 | B1 | 11/2017 | Fink |
| 9,833,838 | B2 | 12/2017 | Mazyar et al. |
| 9,835,015 | B2 | 12/2017 | Hardesty et al. |
| 9,839,889 | B2 | 12/2017 | Quinto |
| 9,841,253 | B2 | 12/2017 | Anthony |
| 9,845,666 | B2 | 12/2017 | Hardesty et al. |
| 9,851,191 | B2 | 12/2017 | Lerche et al. |
| 9,855,229 | B2 | 1/2018 | Khairatkar-Joshi et al. |
| 9,856,411 | B2 | 1/2018 | Sadana et al. |
| 9,869,160 | B2 | 1/2018 | Onuoha |
| 9,870,048 | B2 | 1/2018 | Yamazaki |
| 9,874,062 | B2 | 1/2018 | Lajesic et al. |
| 9,879,492 | B2 | 1/2018 | Kitzman |
| 9,896,915 | B2 | 2/2018 | Balun et al. |
| 9,914,165 | B2 | 3/2018 | Erickson |
| 9,925,628 | B2 | 3/2018 | Drexler |
| 9,926,777 | B2 | 3/2018 | Rodgers et al. |
| 9,938,789 | B2 | 4/2018 | Silva et al. |
| 9,951,589 | B2 | 4/2018 | Wilson |
| 9,963,231 | B2 | 5/2018 | Chattopadhyay |
| 9,988,898 | B2 | 6/2018 | McColphin |
| 9,989,512 | B2 | 6/2018 | Haggerty |
| 10,035,287 | B2 | 7/2018 | Song |
| 10,465,462 | B2 | 11/2019 | Frazier et al. |
| 10,689,955 | B1 | 6/2020 | Mauldin et al. |
| 10,767,453 | B2 | 9/2020 | Phelps et al. |
| 10,830,566 | B2 | 11/2020 | Maxted et al. |
| 11,078,762 | B2 | 8/2021 | Mauldin et al. |
| 11,268,376 | B1 | 3/2022 | Jackson et al. |
| 2002/0163441 | A1 | 11/2002 | Hill |
| 2003/0047358 | A1 | 12/2003 | Bonkowski |
| 2005/0001734 | A1 | 1/2005 | Miller |
| 2015/0000509 | A1 | 1/2015 | Current et al. |
| 2015/0167451 | A1 | 6/2015 | Weerasinghe et al. |
| 2016/0115753 | A1 | 4/2016 | Frazier |
| 2016/0230546 | A1 | 8/2016 | Braisher et al. |
| 2016/0369622 | A1 | 12/2016 | Wheeler et al. |
| 2017/0009559 | A1 | 1/2017 | Spring et al. |
| 2017/0159420 | A1 | 6/2017 | Tolman et al. |
| 2017/0211363 | A1 | 7/2017 | Bradley |
| 2018/0019529 | A1 | 5/2018 | Goyeneche |
| 2019/0112917 | A1 | 4/2019 | Disko et al. |
| 2019/0309608 | A1 | 10/2019 | Phelps et al. |
| 2020/0018584 | A1 | 1/2020 | Phelps et al. |
| 2020/0088026 | A1 | 3/2020 | Butemowsky et al. |
| 2020/0109624 | A1 | 4/2020 | Parasram et al. |
| 2020/0225014 | A1 | 7/2020 | Maxted et al. |
| 2020/0256168 | A1* | 8/2020 | Knight ..... E21B 23/00 |
| 2021/0048284 | A1 | 2/2021 | Maxted et al. |

FOREIGN PATENT DOCUMENTS

| | | |
|---|---|---|
| WO | 200020820 | 4/2000 |
| WO | 2015052509 | 4/2015 |
| WO | 2016186611 | 11/2016 |

* cited by examiner

DOWNHOLE GUN TUBE EXTENSION

CROSS REFERENCE TO RELATED APPLICATIONS

This application claims priority to U.S. Provisional Patent Application Ser. No. 63/008,481 filed on Apr. 10, 2020 entitled "DOWNHOLE GUN TUBE EXTENSION," the contents of which are incorporated herein by reference for all purposes.

BACKGROUND

When drilling oil or gas wells, a wellbore is formed. After drilling, the drill string and bit are removed and the remaining wellbore is lined with a metal casing. A generally annular area is formed between the outside surface of the metal casing and the surrounding formations.

A cementing operation is typically conducted to fill the area between the metal casing and the surrounding formation with concrete. The combination of concrete and metal casing strengthens the wellbore.

Later, perforations are usually made in the metal casing and concrete using a perforating gun assembly that is generally comprised of a steel outer casing, and a charge tube (or "gun tube") inside of the casing with explosive charges (sometimes called shaped charges) positioned in the gun tube. The gun tube is lowered into the wellbore and is typically connected to an electric wireline or other conveyance device until it is at a predetermined position. Then a signal actuates a detonator of the gun tube, which detonates the explosive charges in the gun tube. The explosion of the charges perforates the metal casing and concrete to allow fluids to flow from the formation into the wellbore.

Downhole perforating operations use gun tubes with shape charges positioned at varying angles in order to open a wellbore at a location desired by an operator. Until the advent of a self-orienting gun tube, the direction at which a shape charge fired could not be controlled; only the angles of the shape charges relative to each other within the same gun tube could be set by manufacturing the openings in the gun tube at different relative positions.

The disclosures of the following U.S. Patent Applications are incorporated by reference into this Application. (1) U.S. application Ser. No. 16/293,492 entitled Downhole Plunger and Sub-assembly and filed on Mar. 5, 2019, (2) U.S. application Ser. No. 16/293,508 entitled Downhole Perforating Gun Tube and Components and filed on Mar. 5, 2019, (3) U.S. application Ser. No. 16/293,522 entitled End Fitting For Downhole Perforating Gun Tube and filed on Mar. 5, 2019, (4) U.S. application Ser. No. 16/293,528 entitled Double Wire Feed Through For Downhole Sub-assembly and filed on Mar. 5, 2019, (5) U.S. application Ser. No. 16/293,532 entitled Intelligent Downhole Perforating Gun Tube and Components and filed on Mar. 5, 2019, and (6) U.S. application Ser. No. 16/367,101 entitled Downhole Safety Switch and Communication Protocol and filed on Mar. 27, 2019.

A gun-tube extension is attached to an end cap of a gun tube and extends from the end cap. The gun-tube extension has (1) a first end configured to connect to the end cap of a gun tube, (2) a second end configured to be connected to a sub-assembly, and (3) a body portion configured to retain a switch, such as an addressable switch, used to detonate explosives positioned in the gun tube. The second end of the gun-tube extension may permit the gun-tube extension and the gun tube to which it is indirectly connected to rotate. The gun-tube extension may rotate either by the operation of gravity on weights attached to the gun-tube extension or by a motor.

A switch, which is preferably an addressable switch, used to detonate explosives in a gun tube, may include an orientation-detection device, such as an accelerometer. The orientation of the switch, and hence of the gun tube or gun-tube extension that includes the switch, may be communicated to a human or machine operator who/which has the ability to change the orientation by operating one or more devices, such as a motor, to rotationally move the gun tube and/or gun-tube extension inside of a wellbore.

A ground for a gun tube or gun-tube extension may include a bow spring attached to and in electrical communication with the gun tube and/or end caps of the gun tube. The bow spring may be adjustable and creates a solid ground. The bow spring grounds to the inner surface of a casing or sub-assembly in which the gun tube and bow spring are positioned.

An end cap for use in a gun tube may have a stepped cylindrical body with multiple diameters to enable it to fit gun tubes of varying diameters, such as 1⅝" and 1¾", or 1⅞" and 2". The end caps can be rotationally indexed with respect to each other to alter the rotational position of a gun tube in order to change the direction in which explosives in the gun tube fire. In one embodiment, legs in a gun-tube extension are received in openings in an end cap to fix the end cap and the gun tube into a desired rotational position. This determines the direction at which the explosive charges in the gun tube fire when detonated.

DETAILED DESCRIPTION

End Cans for Gun Tubes

Indexed End Caps

Figure 1:
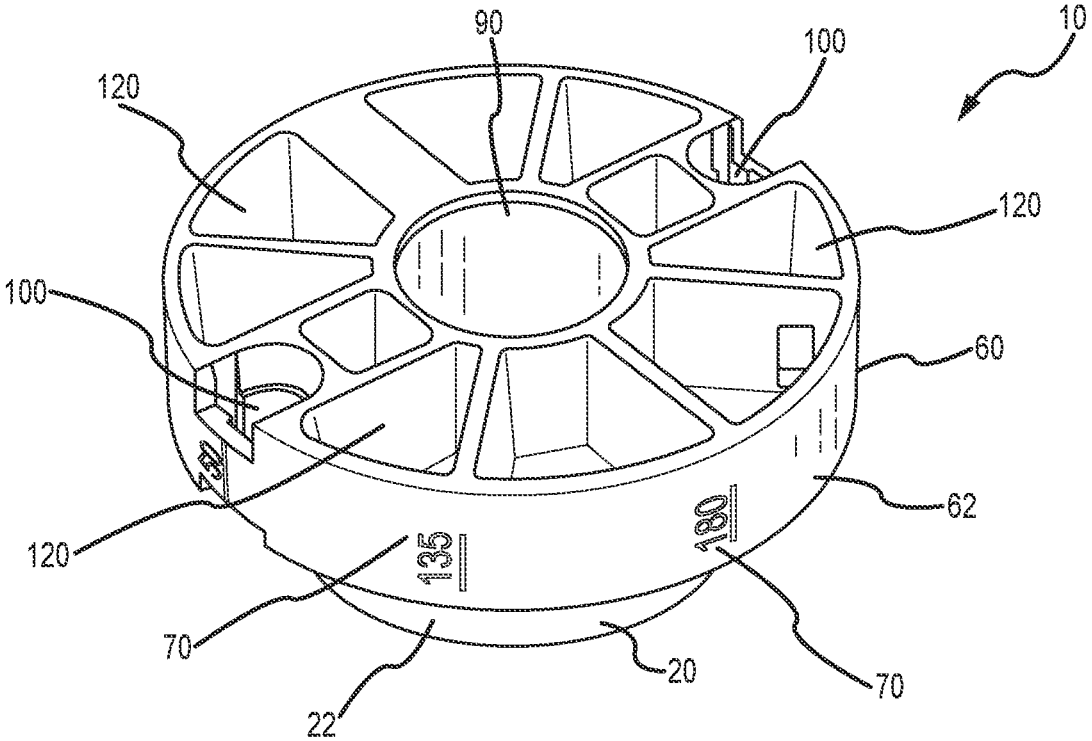
FIG. 1 is a top, perspective view of an end cap according to this disclosure.
Figure 2:
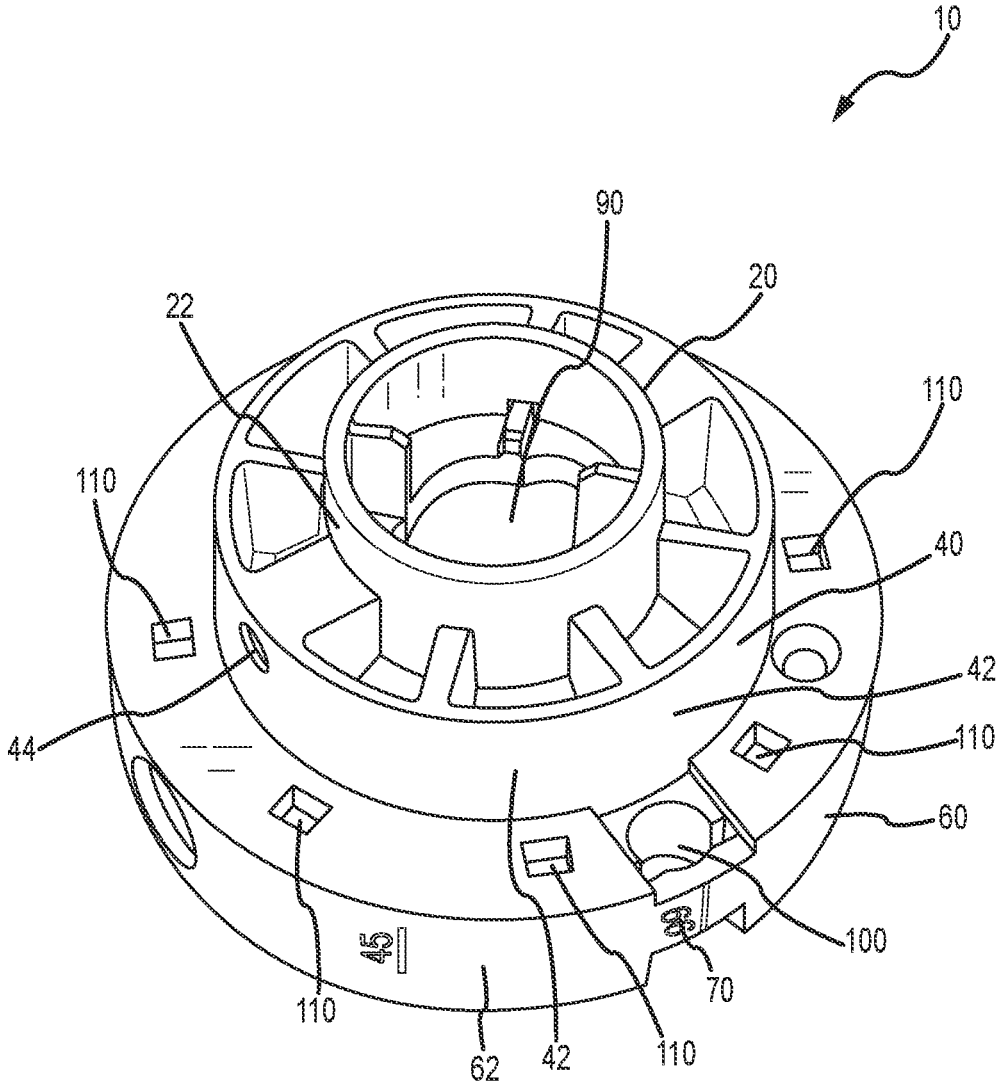
FIG. 2 is a bottom, perspective view of the end cap of FIG. 1.
Figure 3:
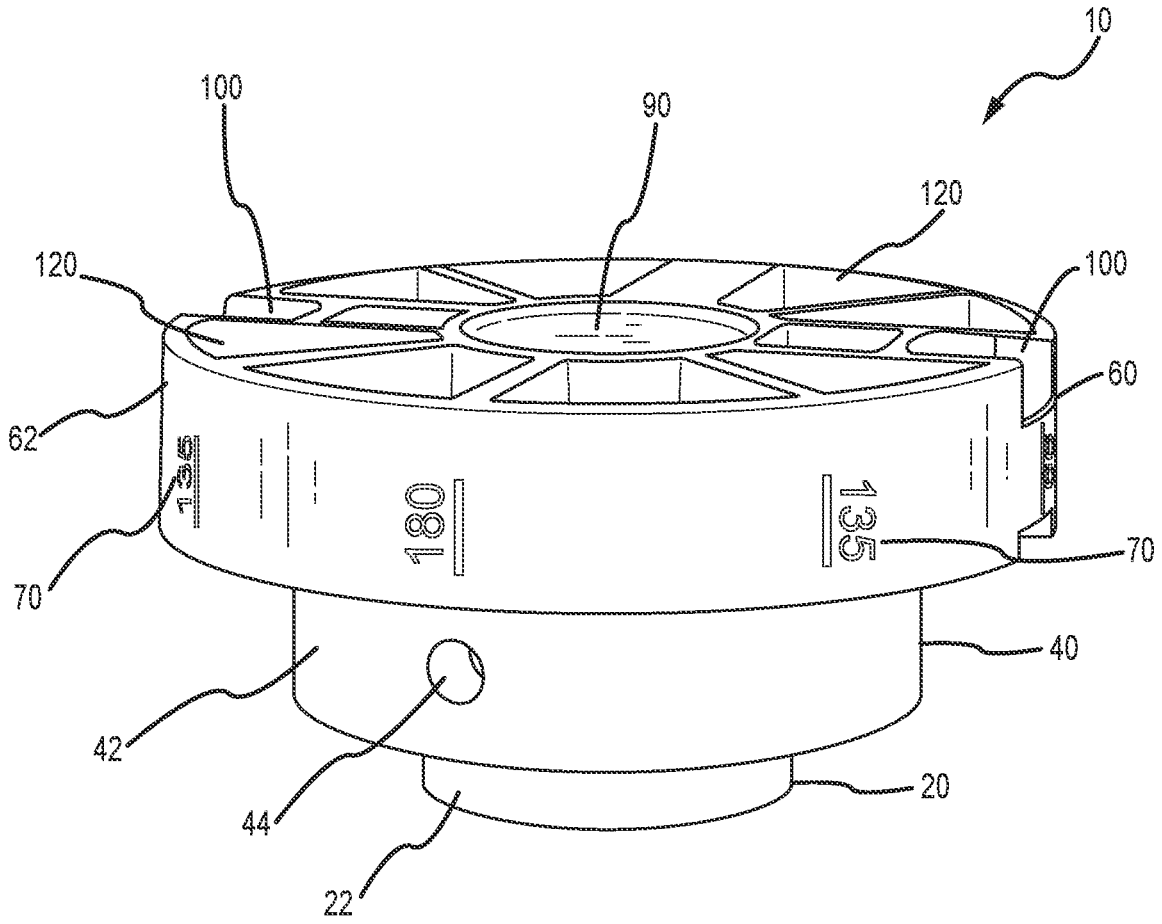
FIG. 3 is a side view of the end cap of FIG. 1.
Figure 4:
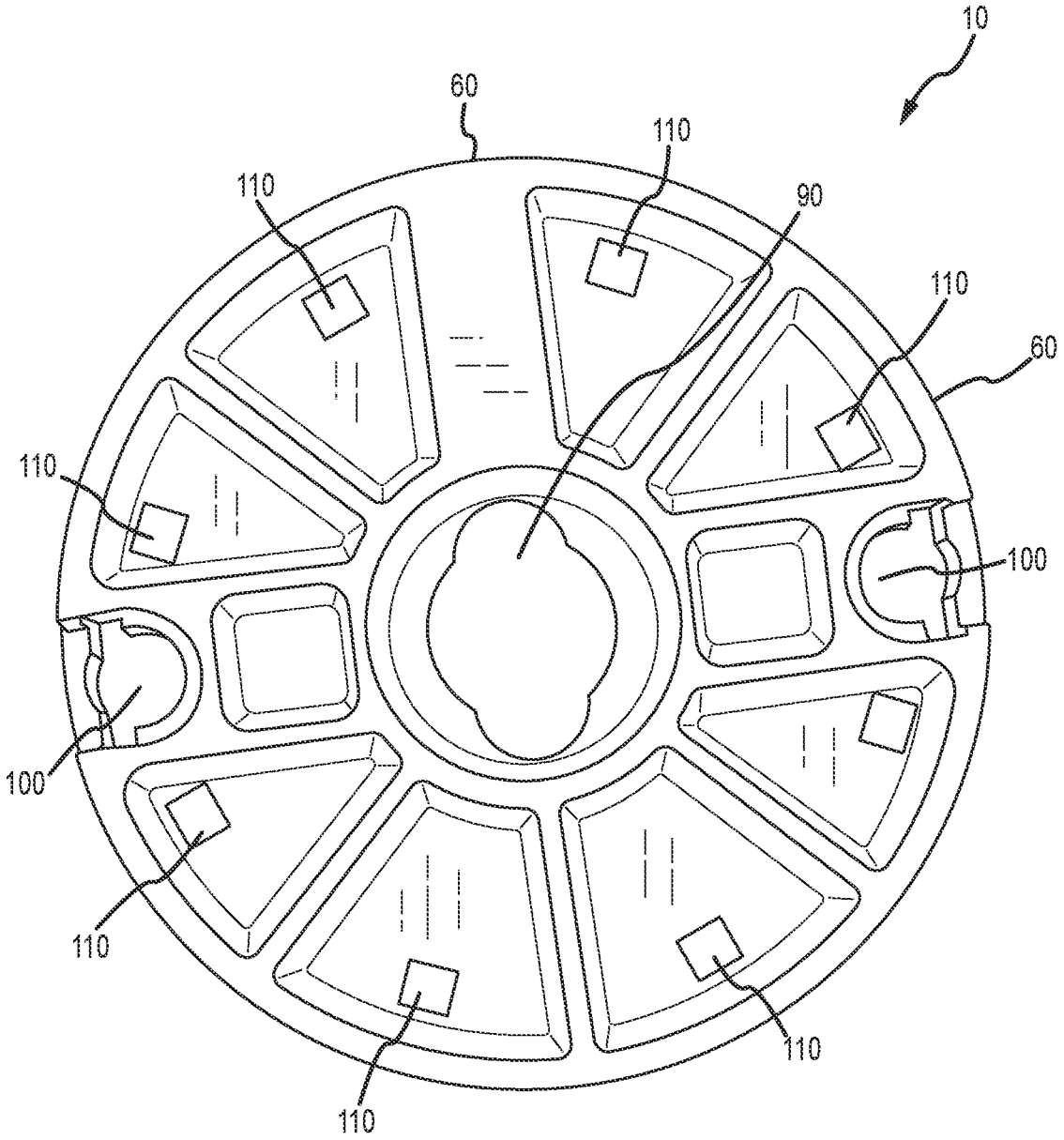
FIG. 4 is a top view of the end cap of FIG. 1.
Figure 5:
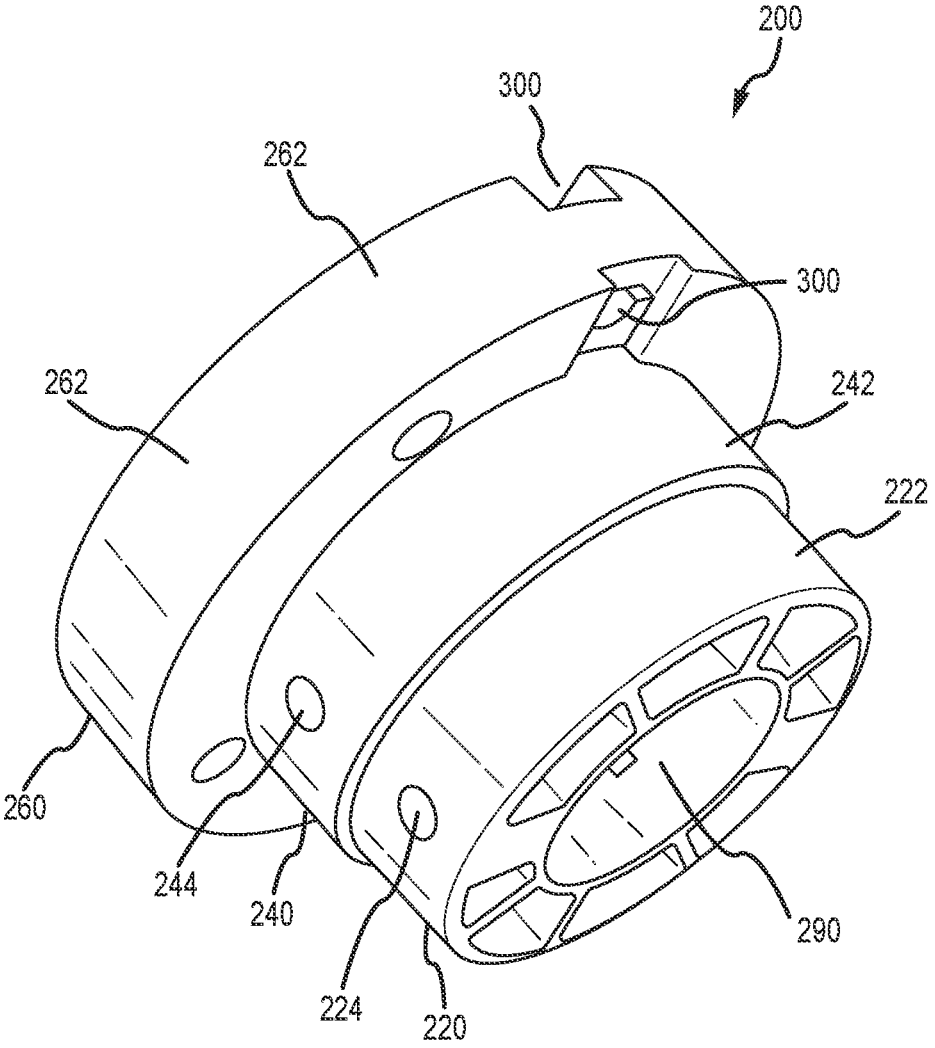
FIG. 5 is a side, perspective view of an alternate end cap according to this disclosure.
Figure 6:
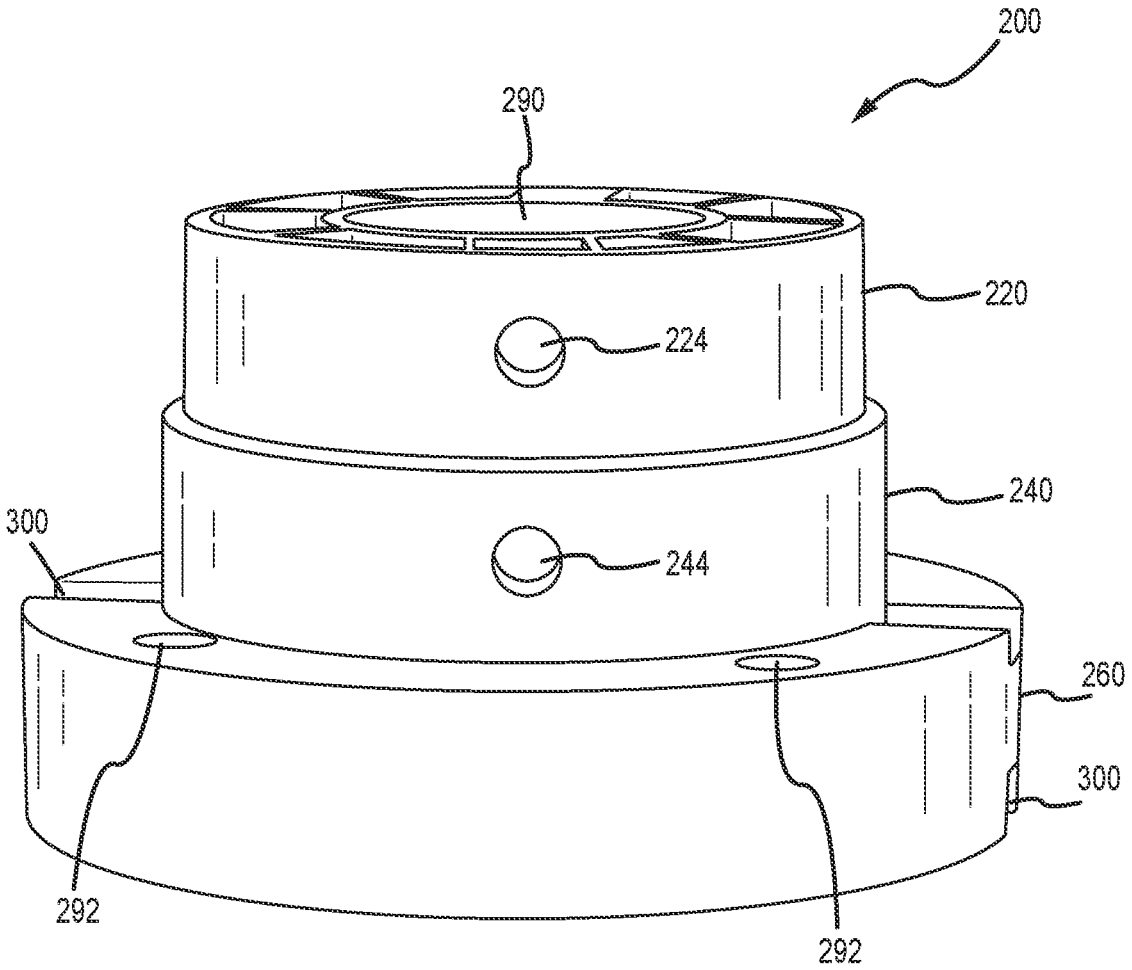
FIG. 6 is a side view of the end cap of FIG. 5.
Figure 7:
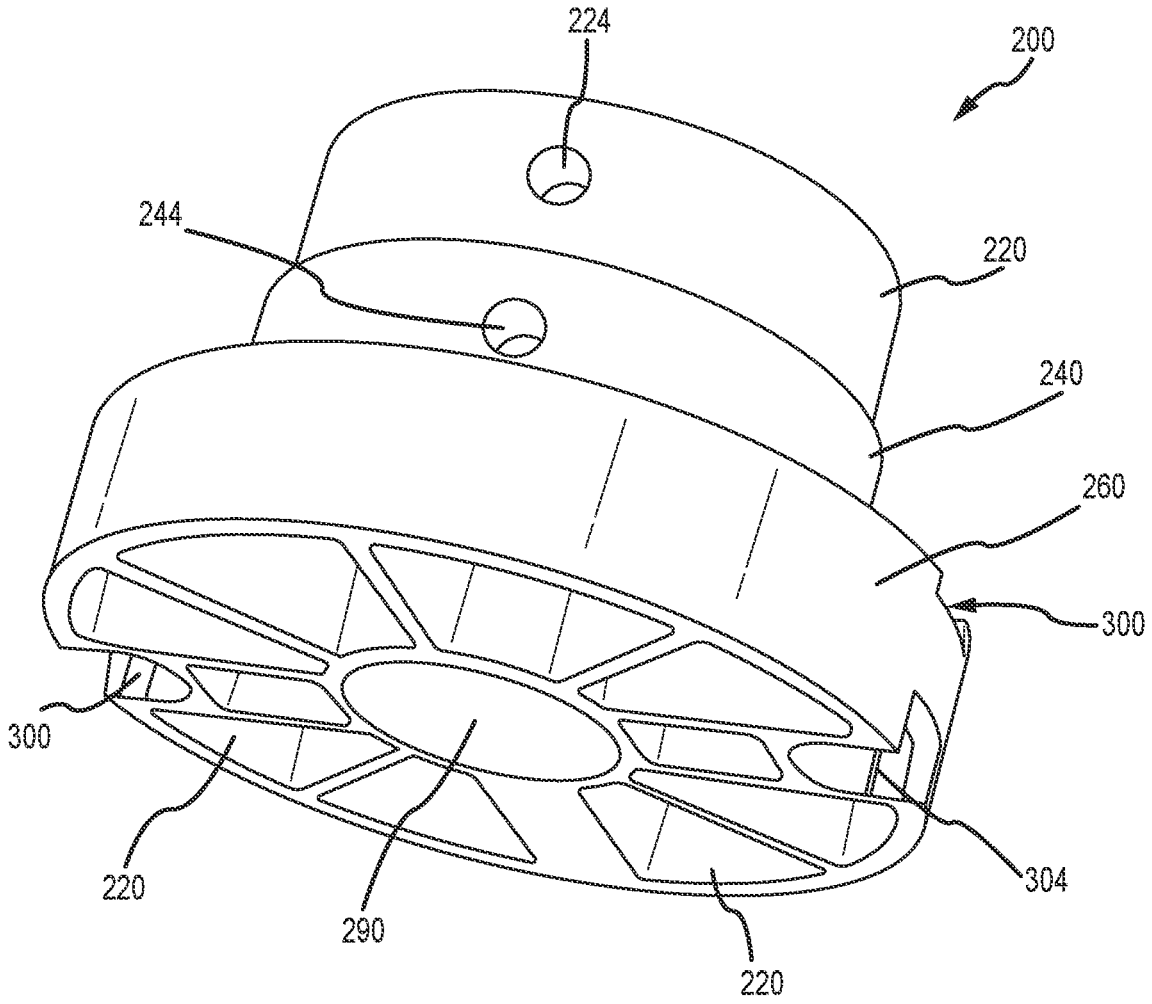
FIG. 7 is a side, perspective view of the end cap of FIG. 5.
Figure 8:
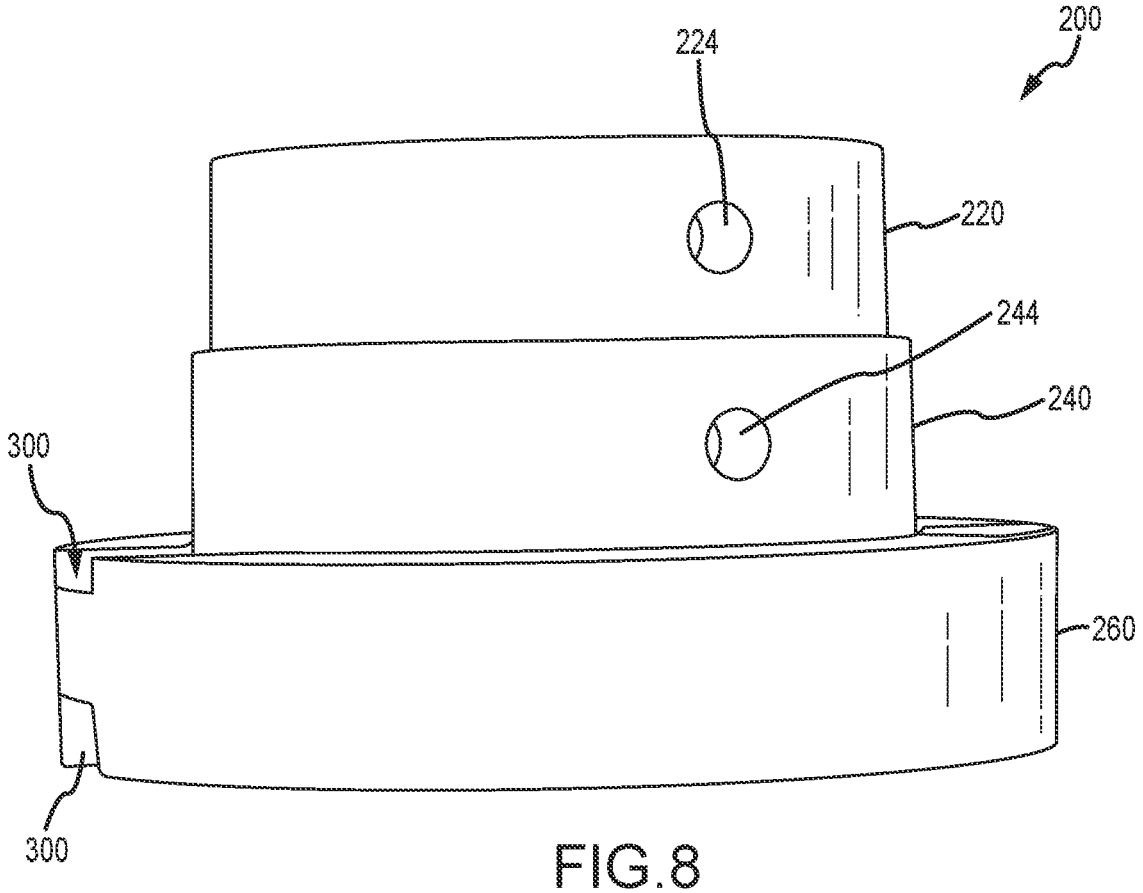
FIG. 8 is a side view of the end cap of FIG. 5.
Figure 9:
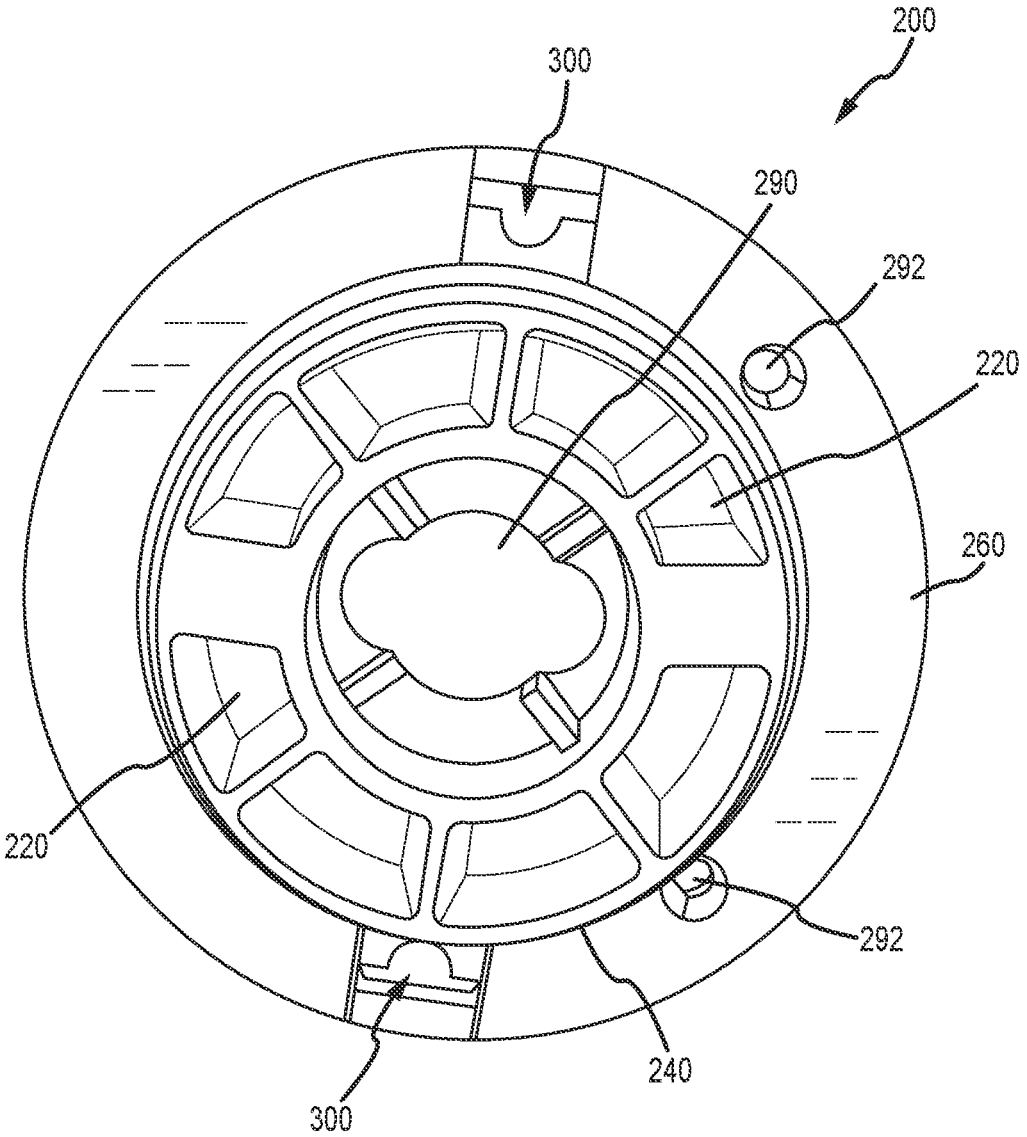
FIG. 9 is a top view of the end cap of FIG. 5.
Figure 10:
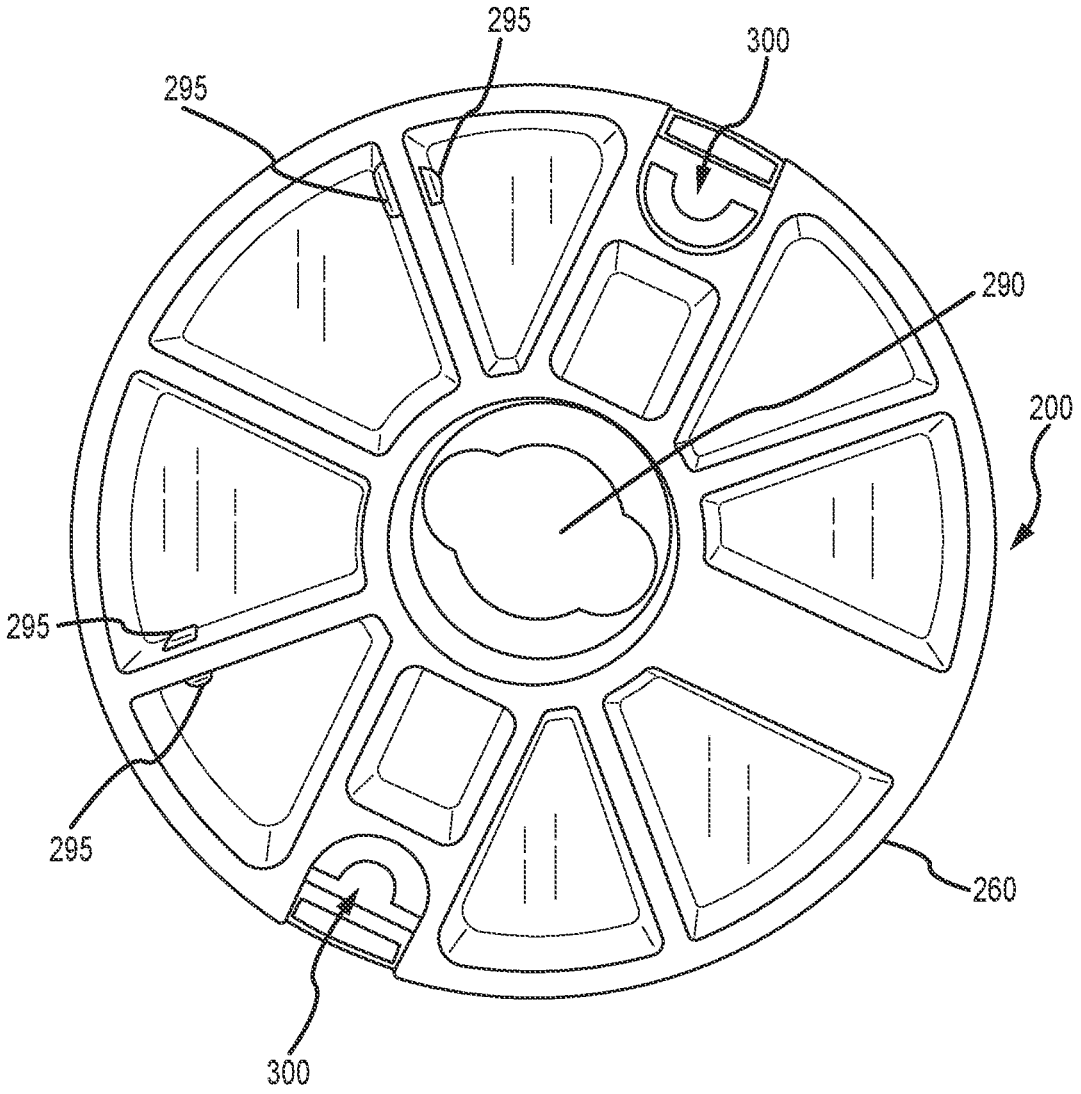
FIG. 10 is a bottom view of the end cap of FIG. 5.
Figure 11:
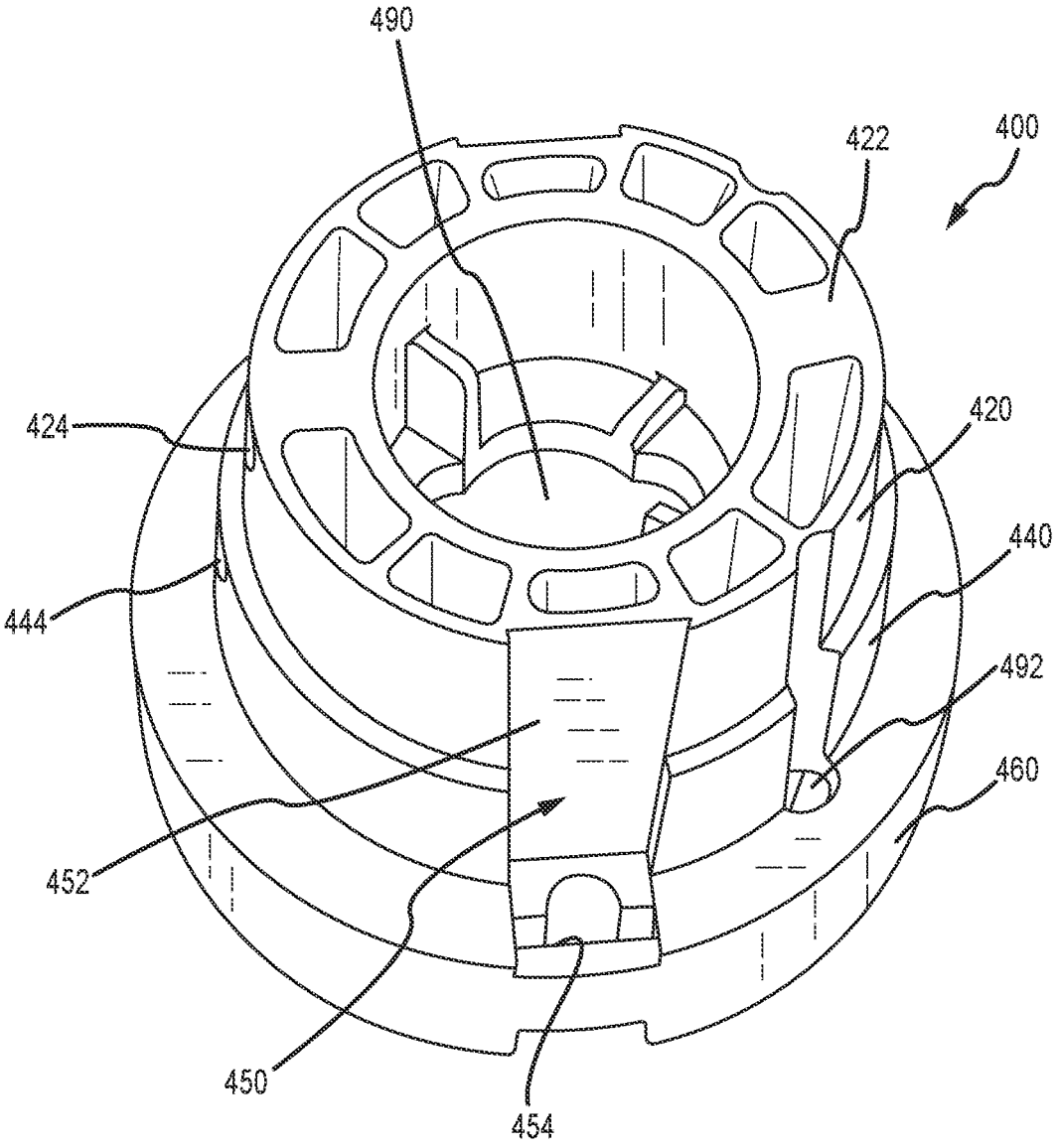
FIG. 11 is a bottom, perspective view of an end cap according to this disclosure that is configured to receive a bow-spring assembly.
Figure 12:
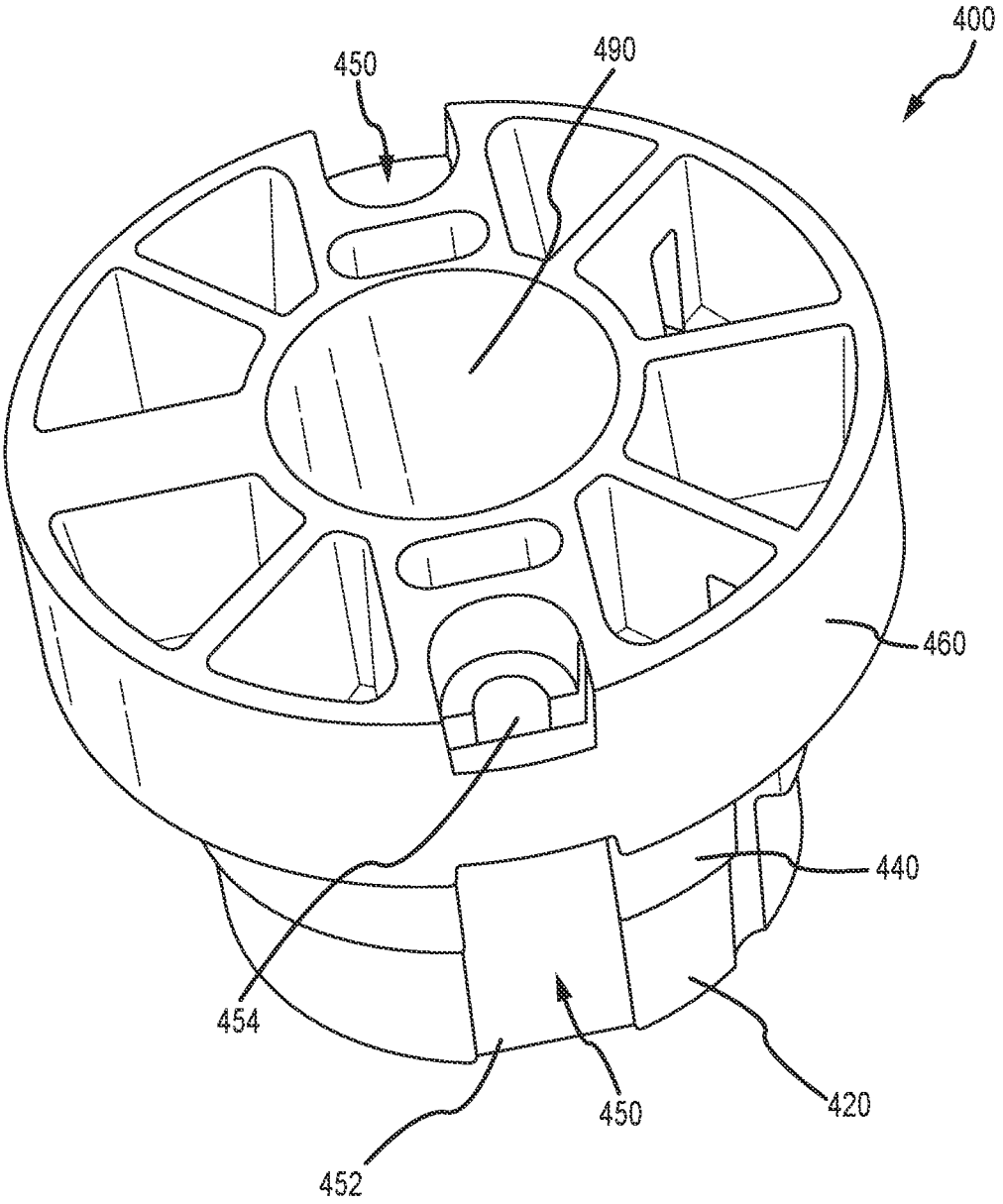
FIG. 12 is a side, perspective view of the end cap of FIG. 11.
Figure 13:
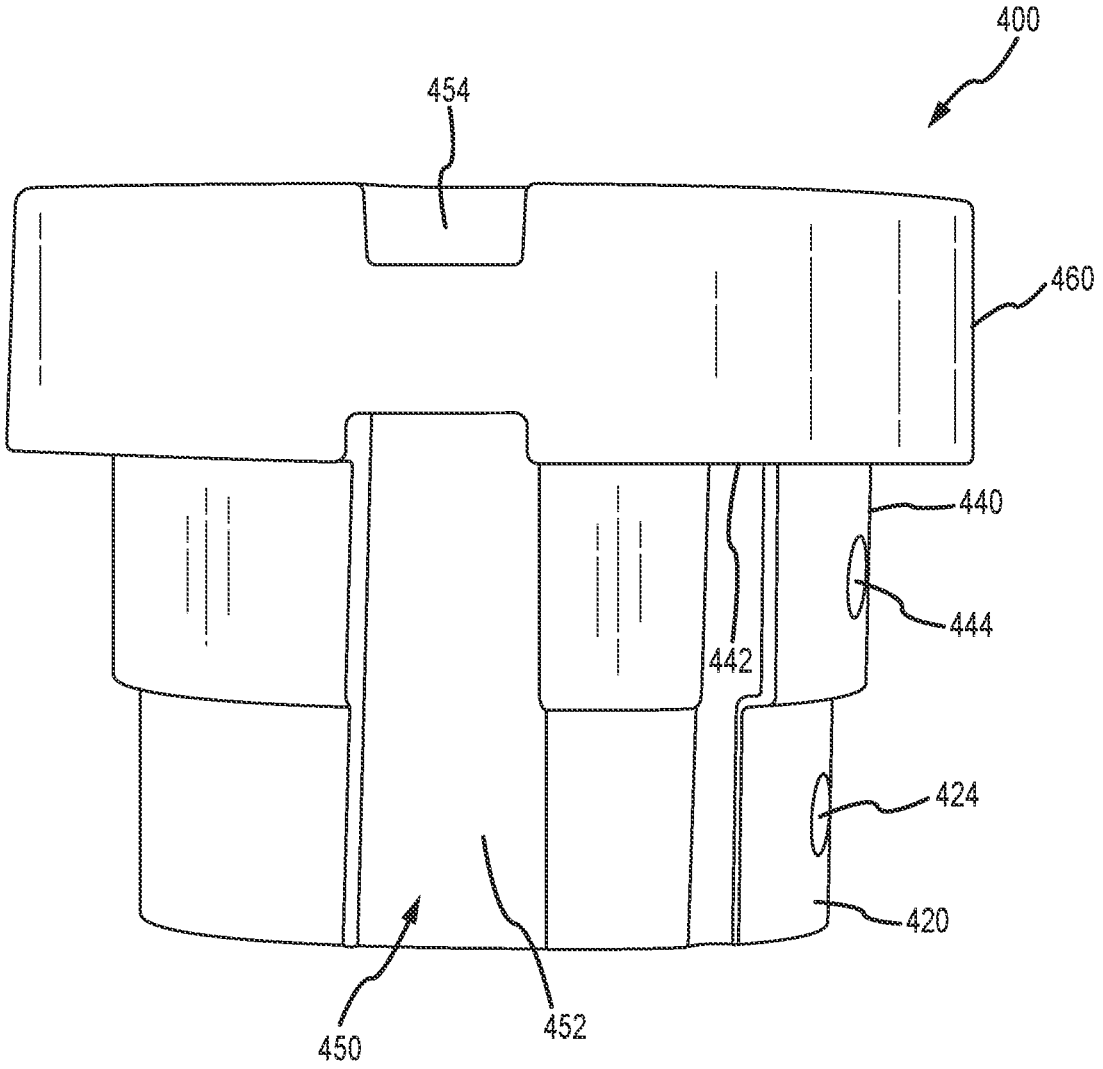
FIG. 13 is a side view of the end cap of FIG. 11.
Figure 14:
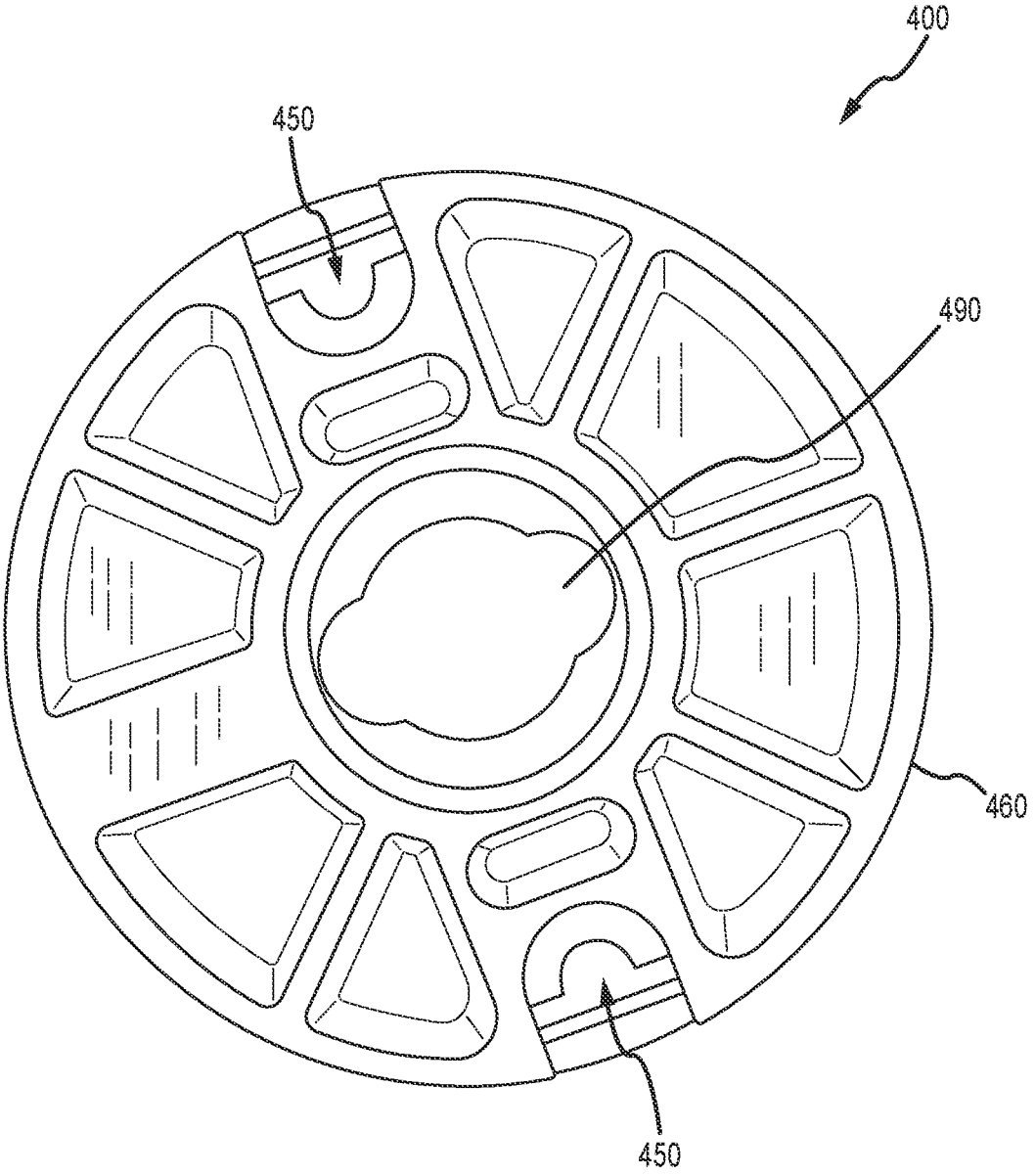
FIG. 14 is a top view of the end cap of FIG. 11.
Figure 15:
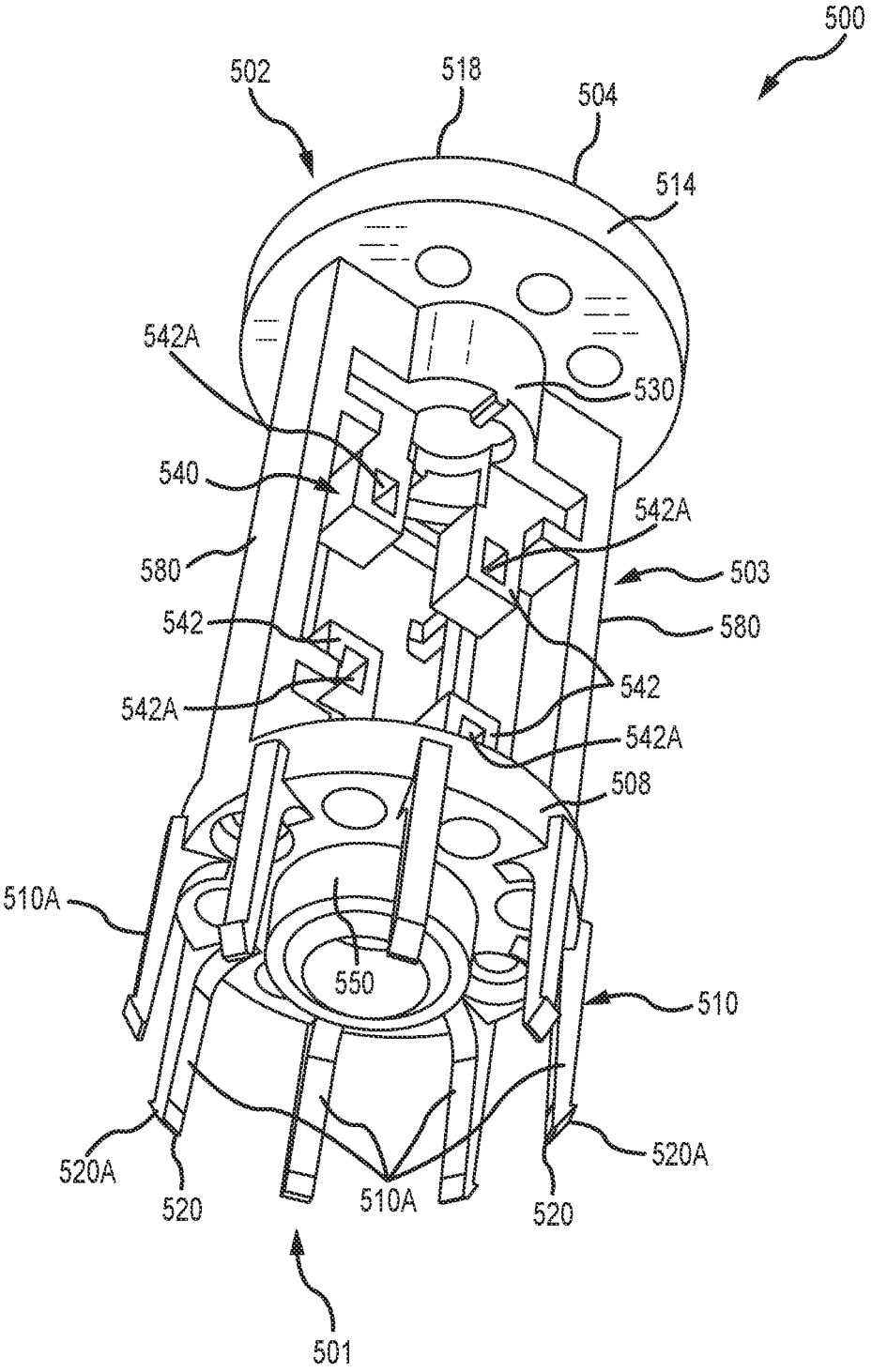
FIG. 15 is a side, perspective view of a gun-tube extension according to this disclosure.
Figure 16:
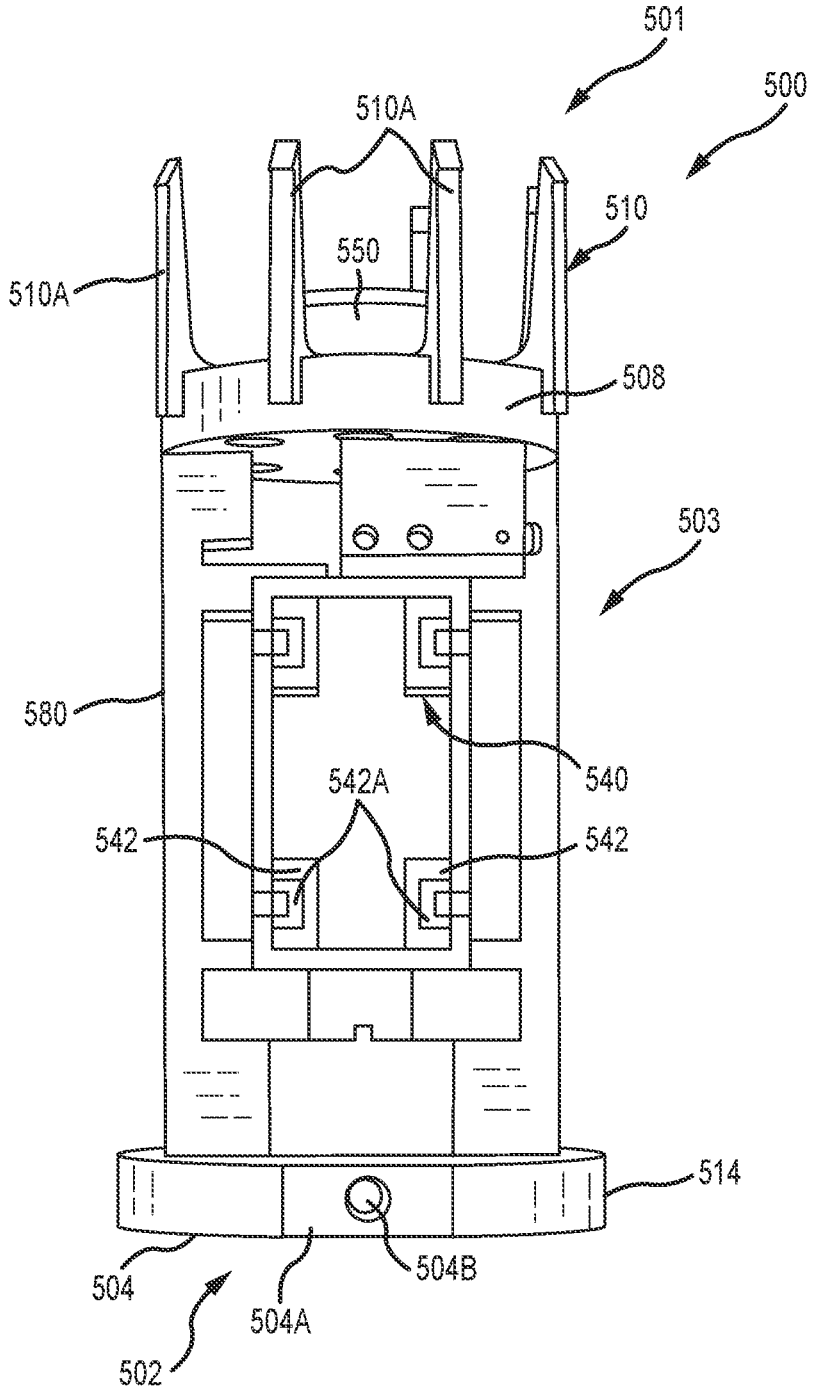
FIG. 16 is a rotated side view of the gun-tube extension of FIG. 15.
Figure 17:
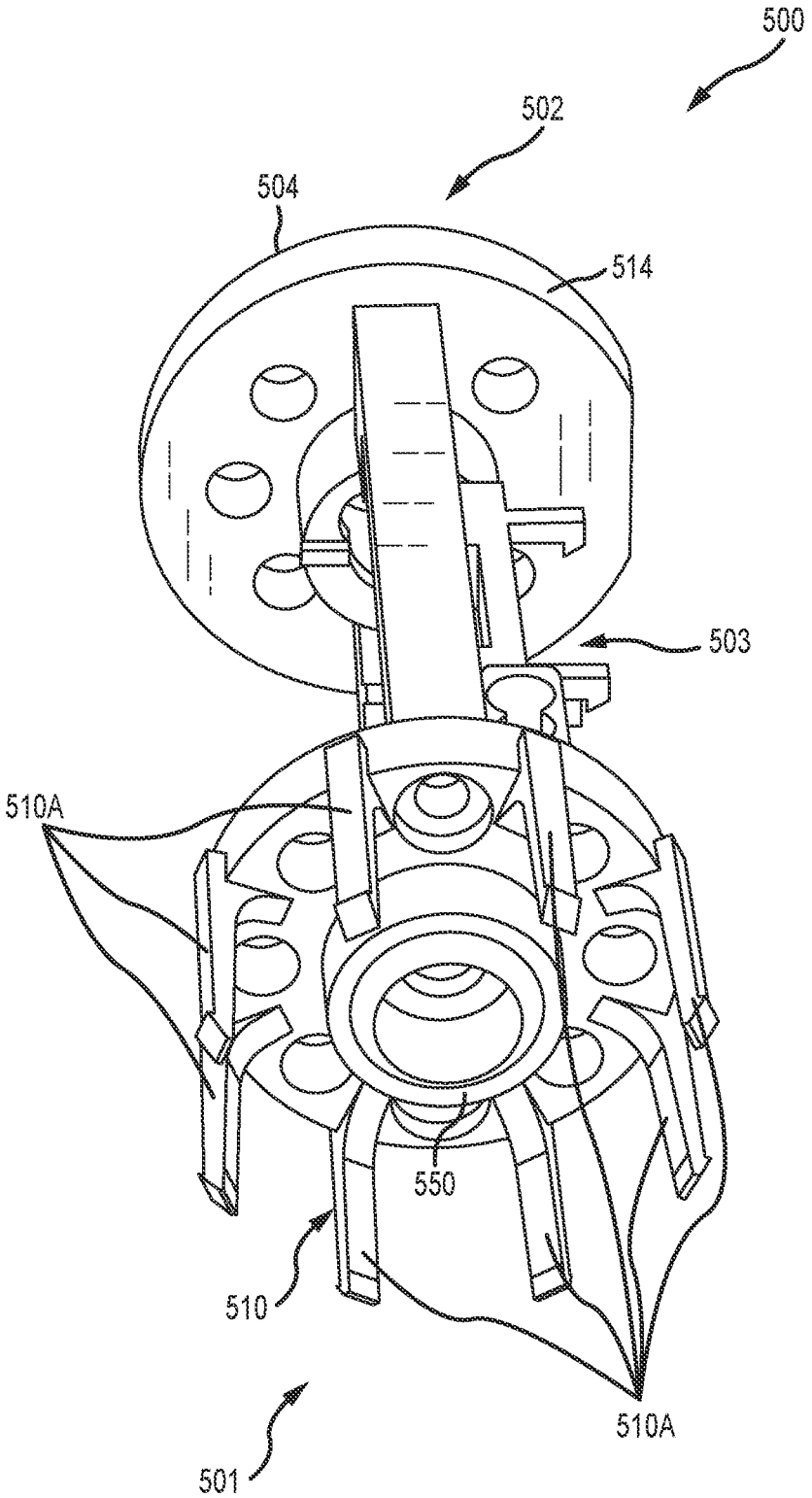
FIG. 17 is a bottom, perspective view of the gun-tube extension of FIG. 15.
Figure 18:
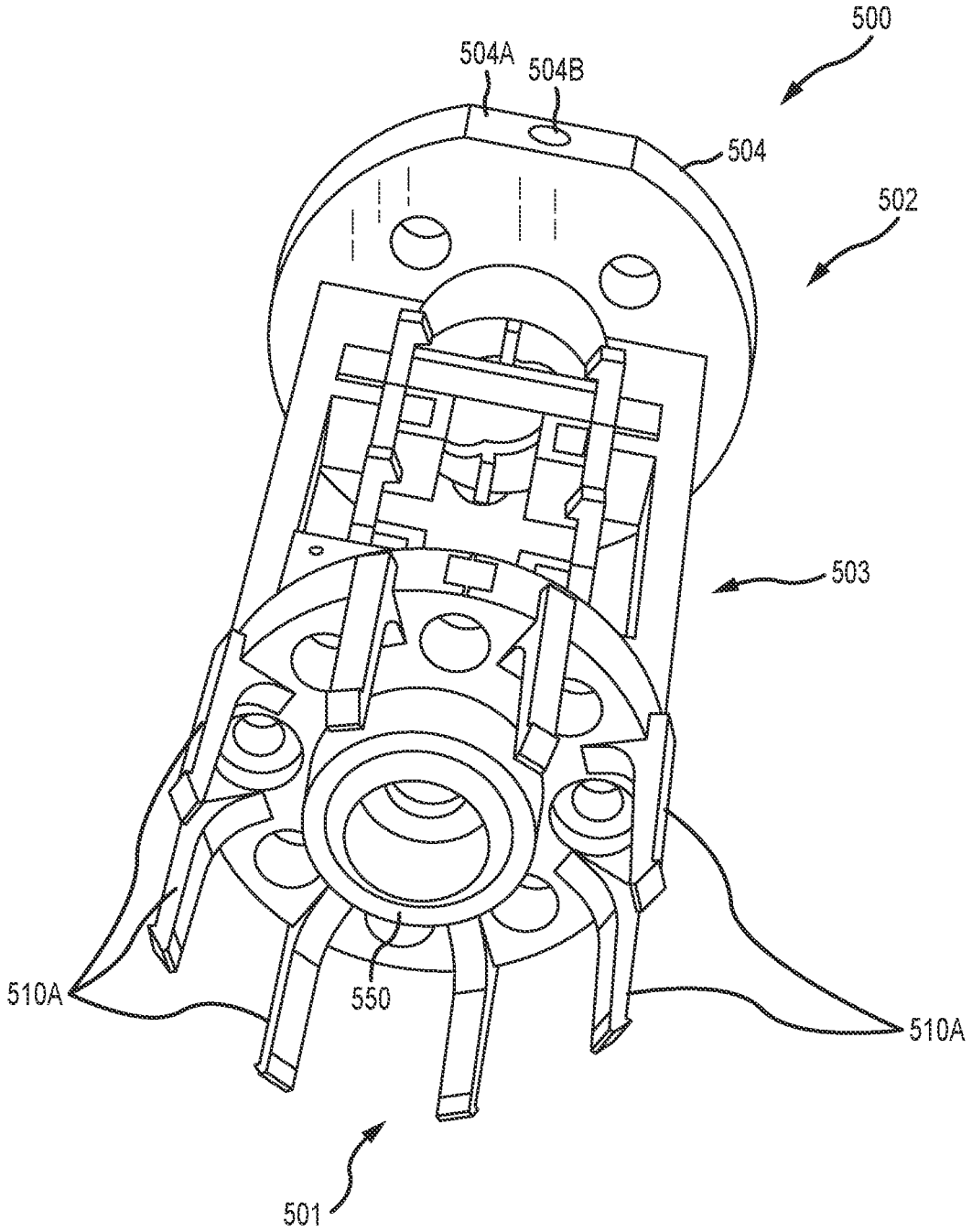
FIG. 18 is an alternate bottom, perspective view of the gun-tube extension of FIG. 15.
Figure 19:
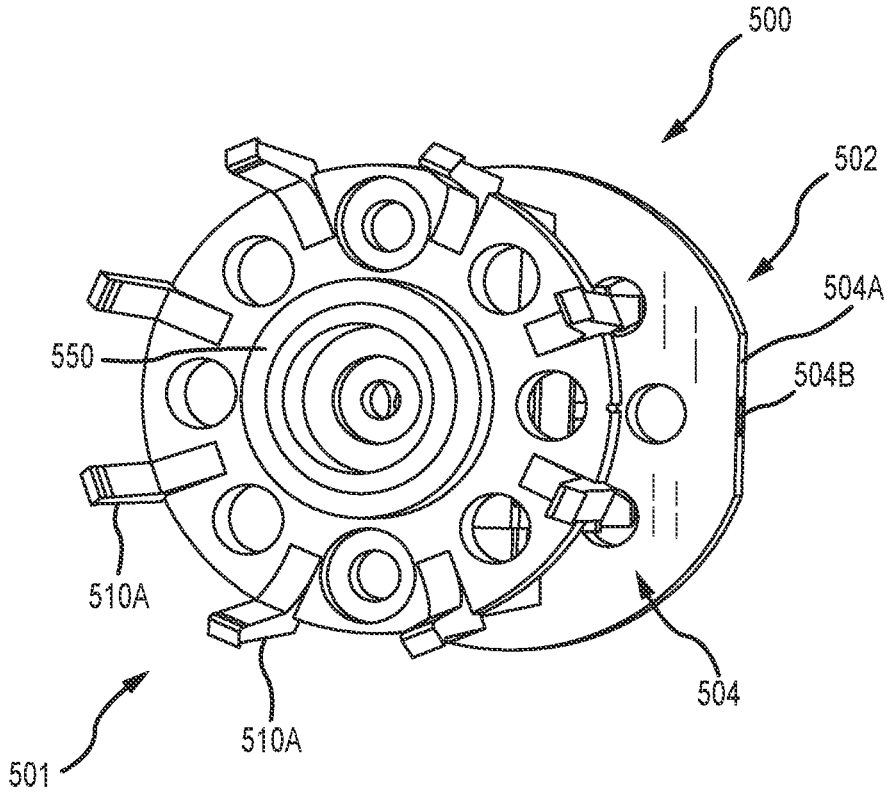
FIG. 19 is an alternate bottom, perspective view of the gun-tube extension of FIG. 15.
Figure 20:
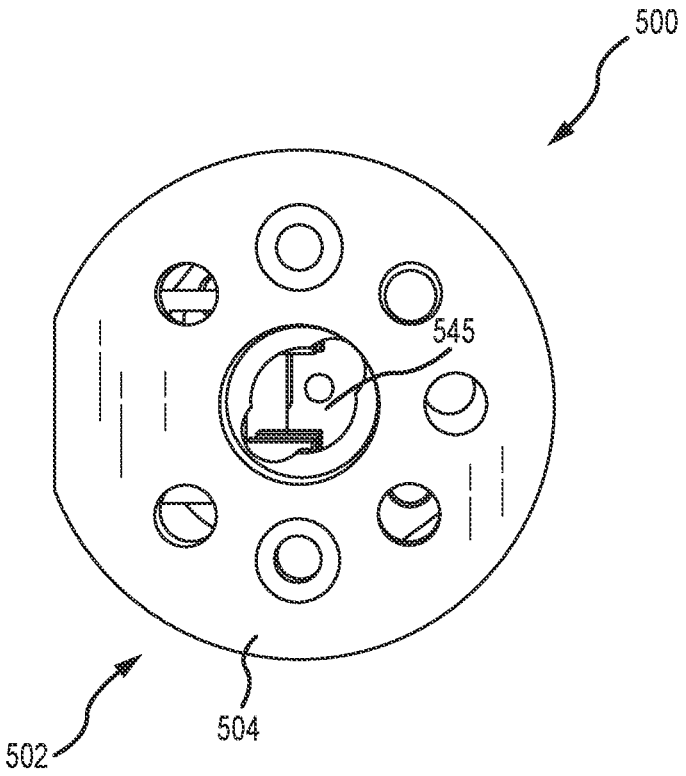
FIG. 20 is top view of the gun-tube extension of FIG. 15.
Figure 21:
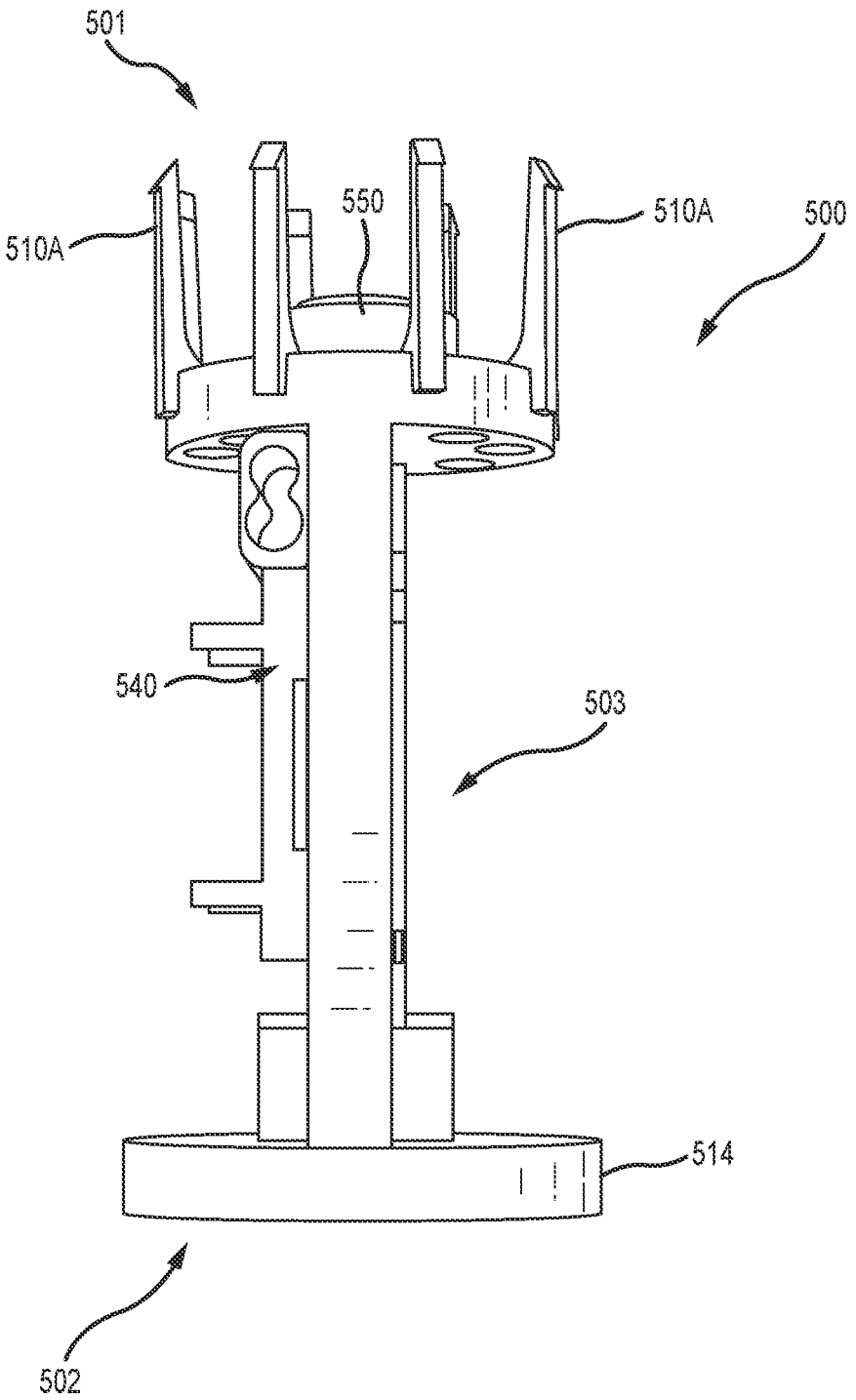
FIG. 21 is a side view of the gun-tube extension of FIG. 15.
Figure 22:
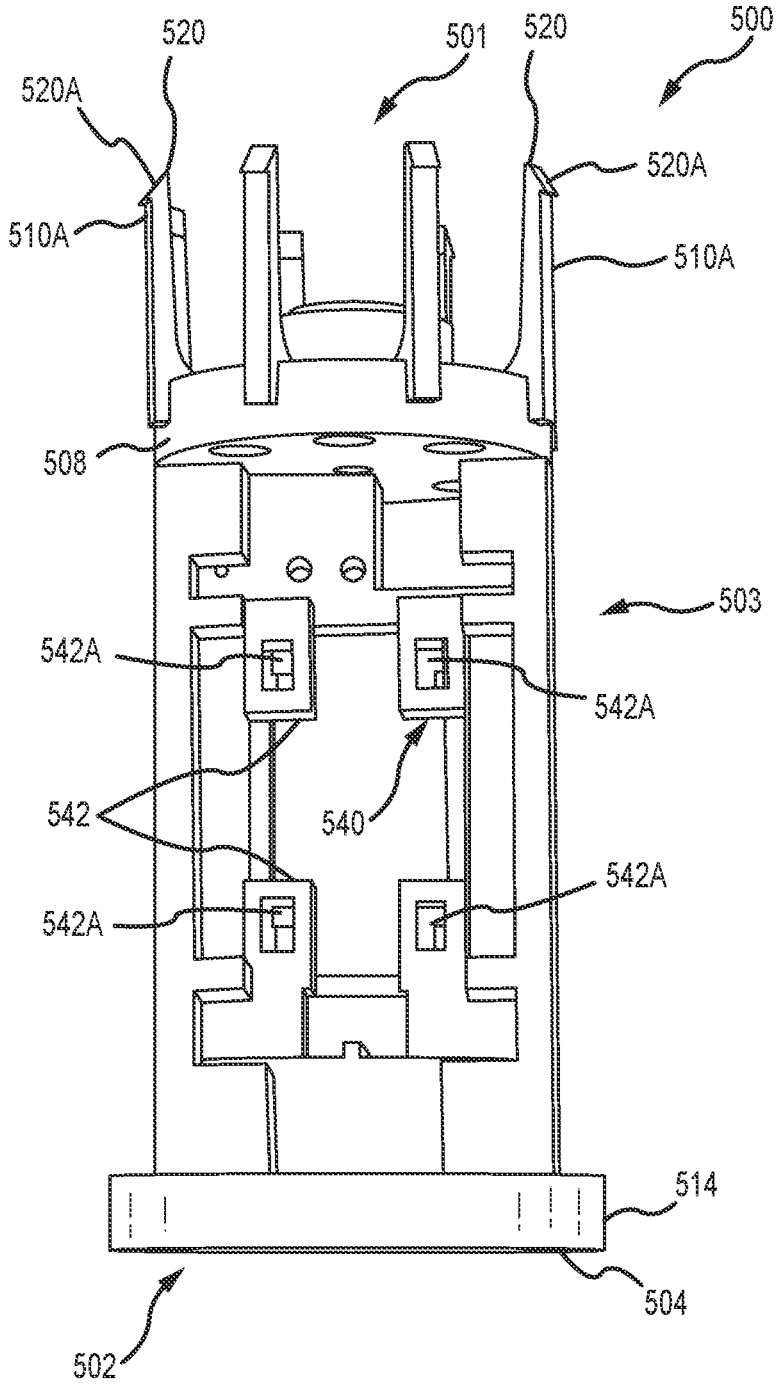
FIG. 22 is an alternate side view of the gun-tube extension of FIG. 15.
Figure 23:
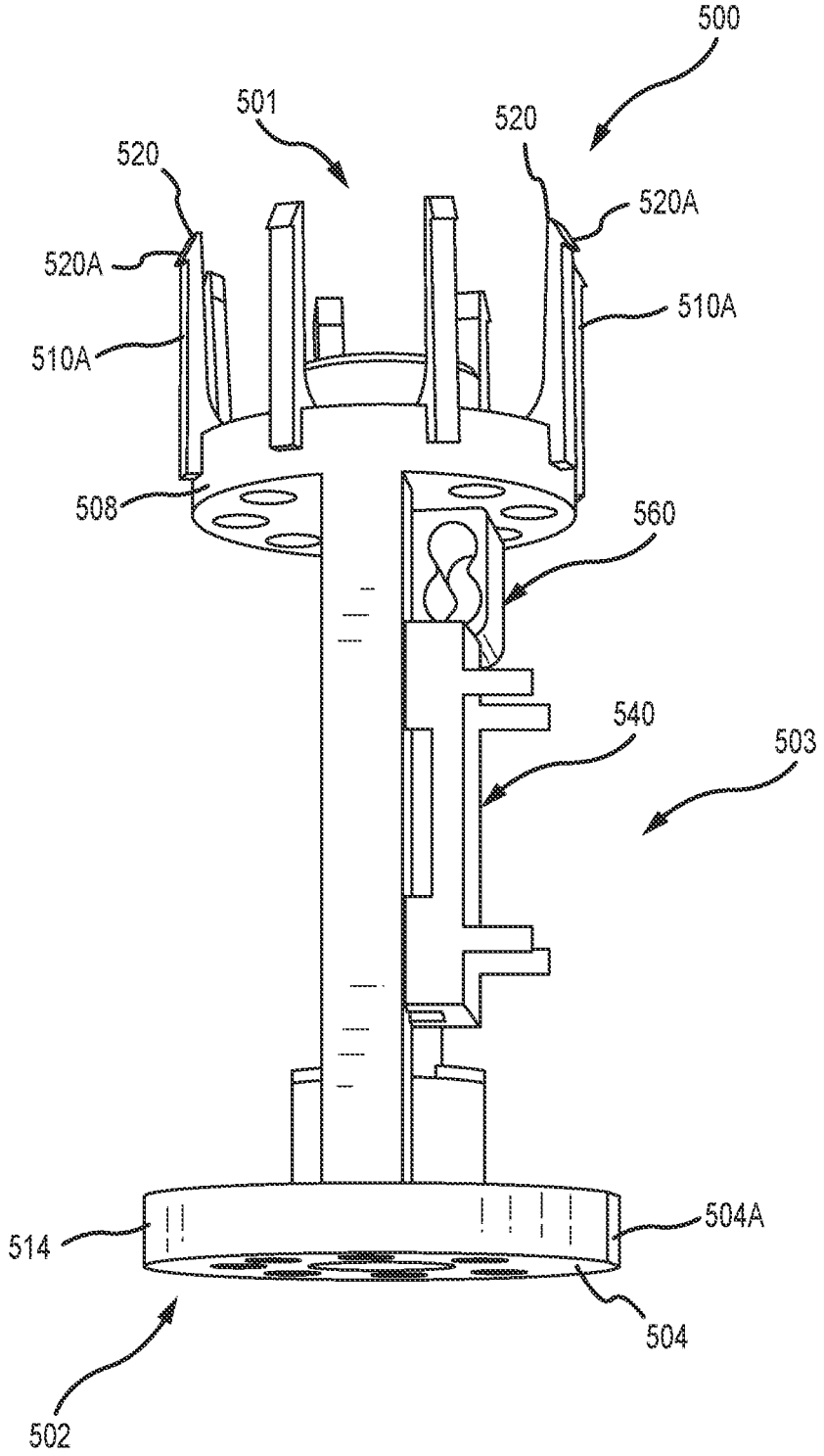
FIG. 23 is an alternate side, perspective view of the gun-tube extension of FIG. 15.
Figure 24:
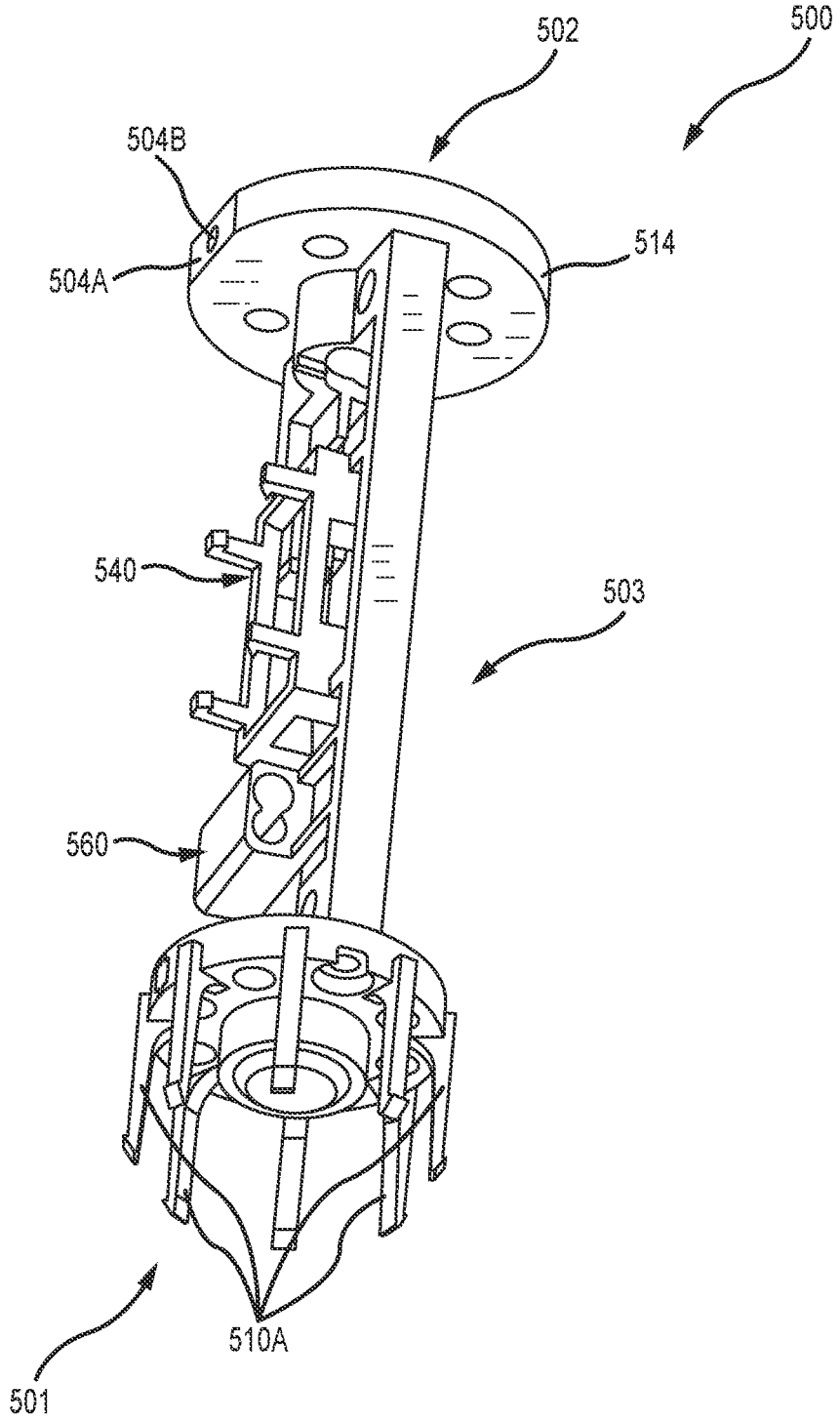
FIG. 24 is a perspective, side view of the gun-tube extension of FIG. 15 with a structure to retain a detonation and primer card.
Figure 25:
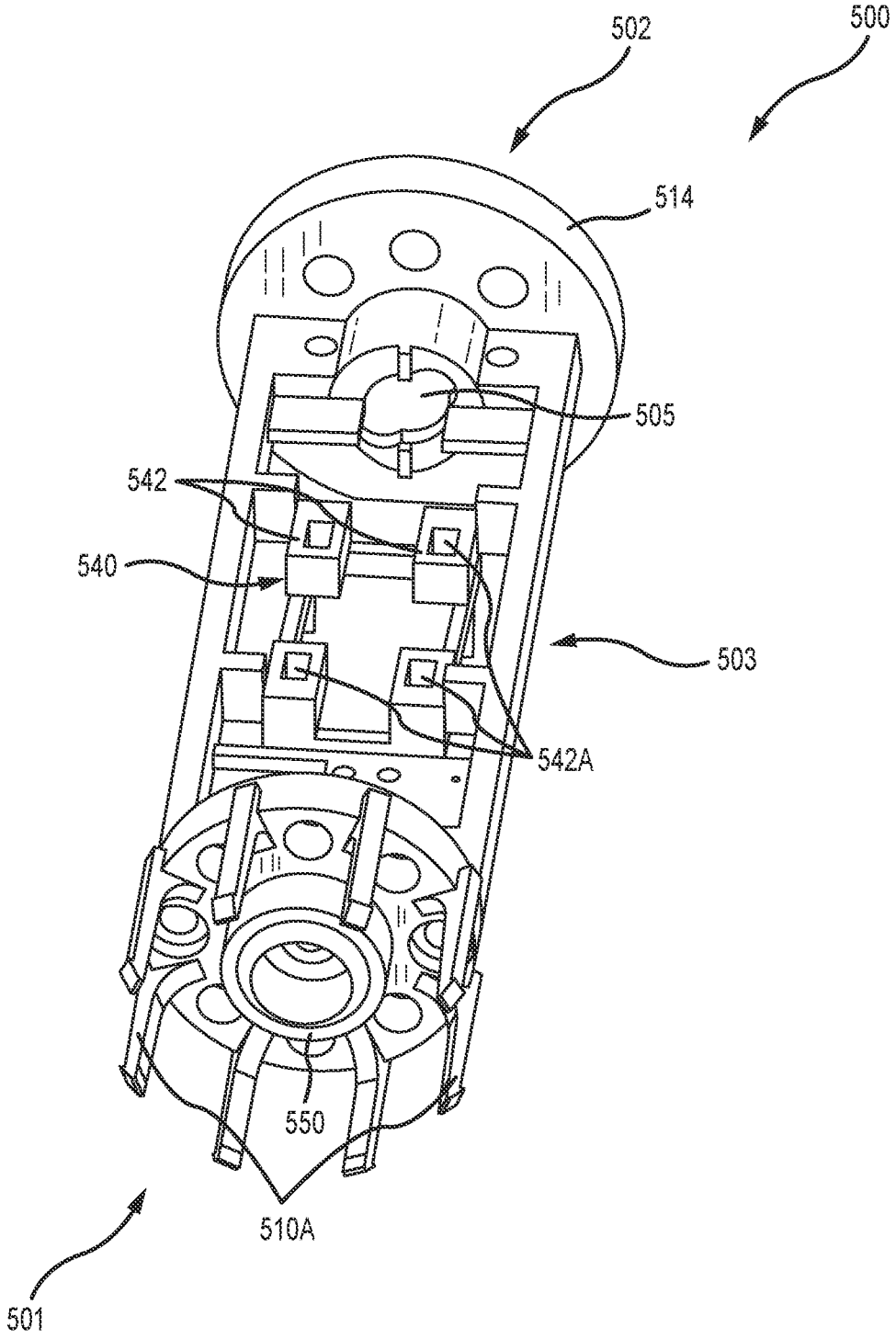
FIG. 25 is a perspective, side view of the gun-tube extension of FIG. 15.
Figure 26:
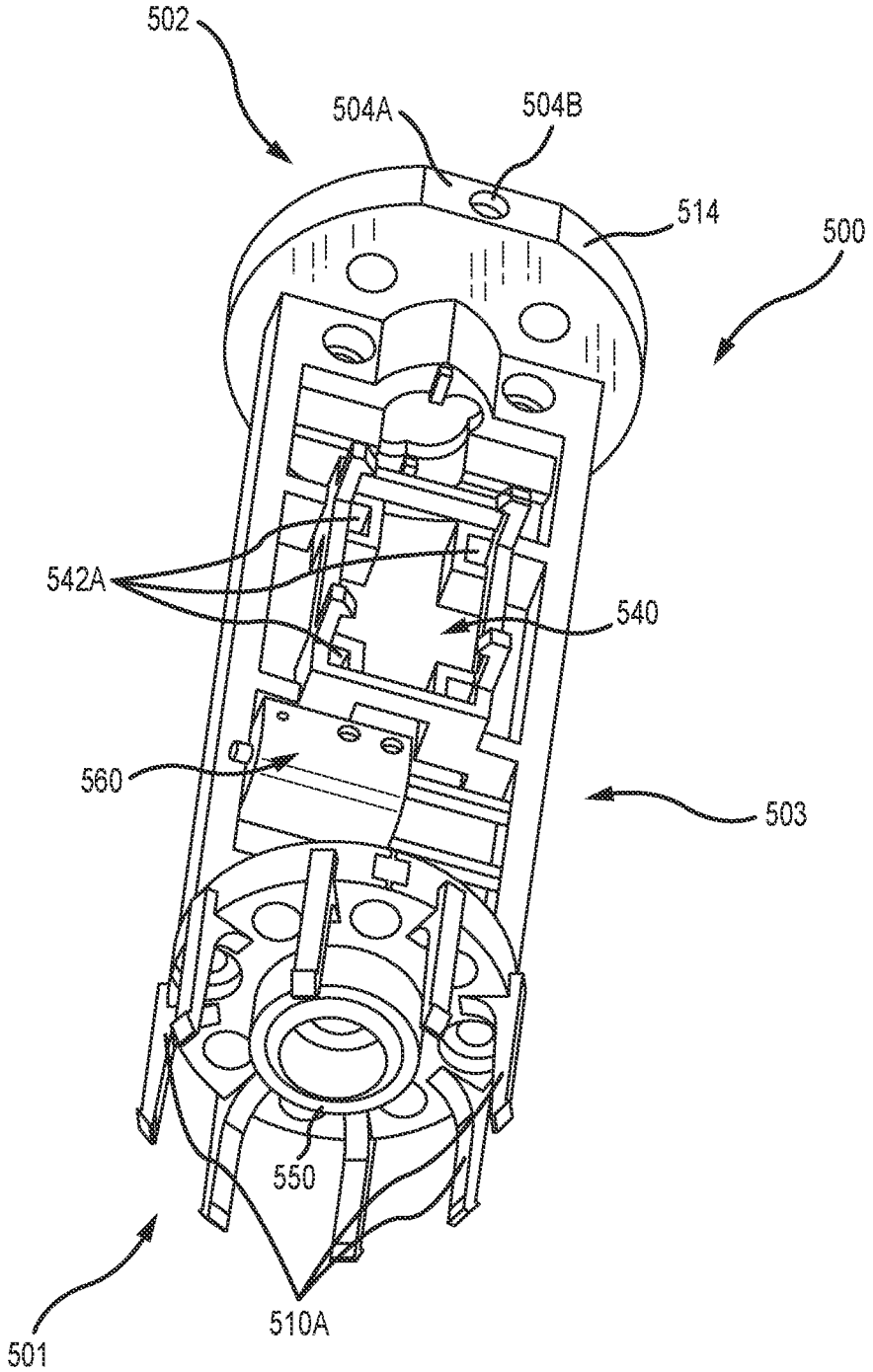
FIG. 26 is an alternate perspective, side view of the gun-tube extension of FIG. 15.
Figure 27:
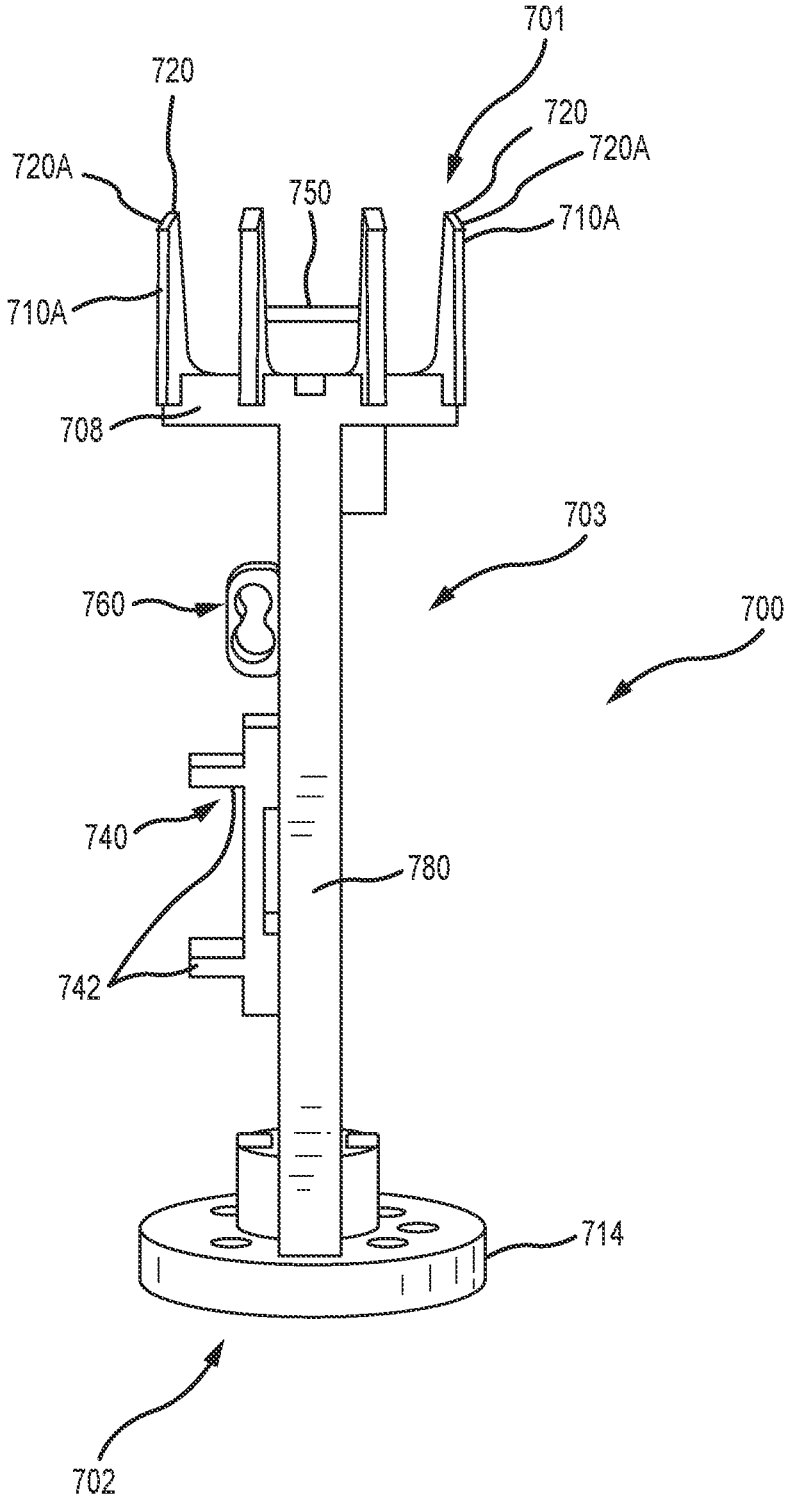
FIG. 27 is a side view of a longer-version gun-tube extension according to this disclosure.
Figure 28:
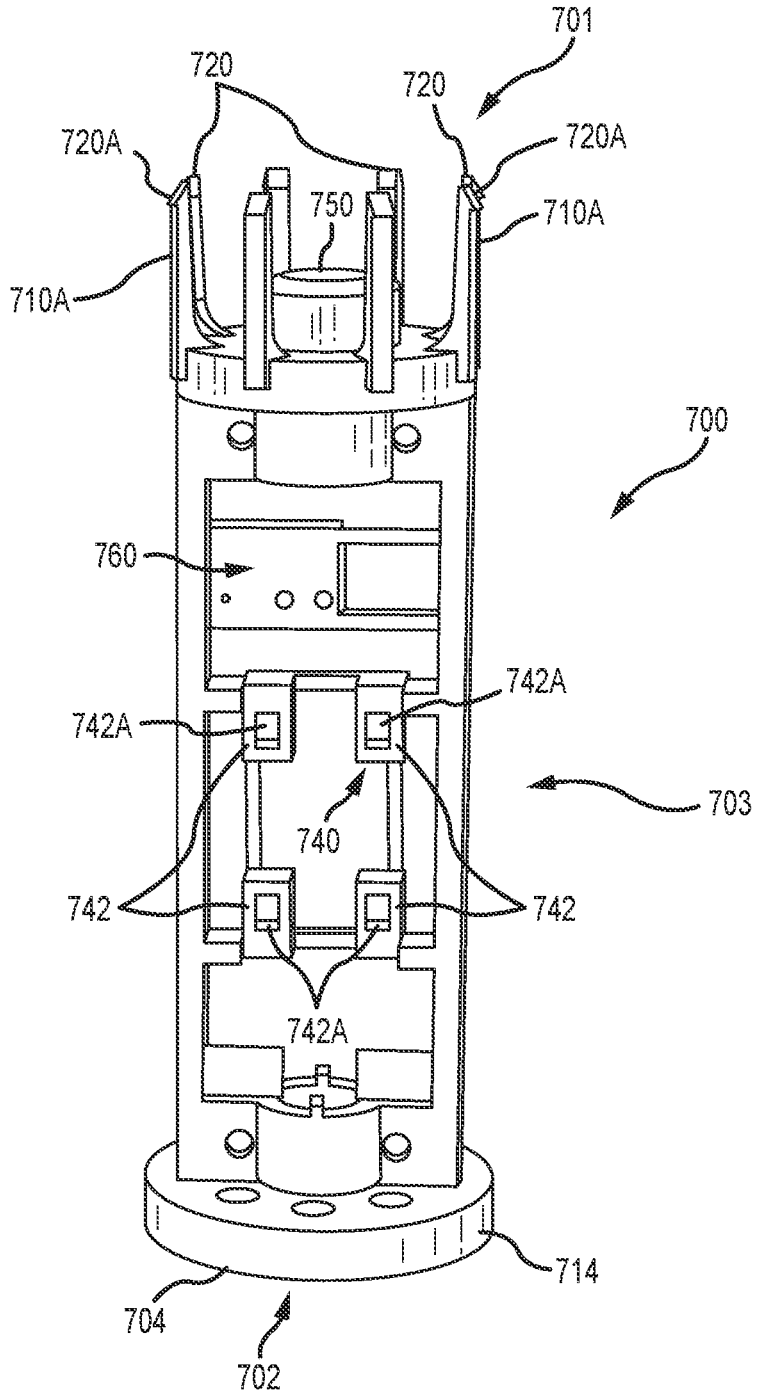
FIG. 28 is a rotated, side view of the gun-tube extension of FIG. 27.
Figure 29:
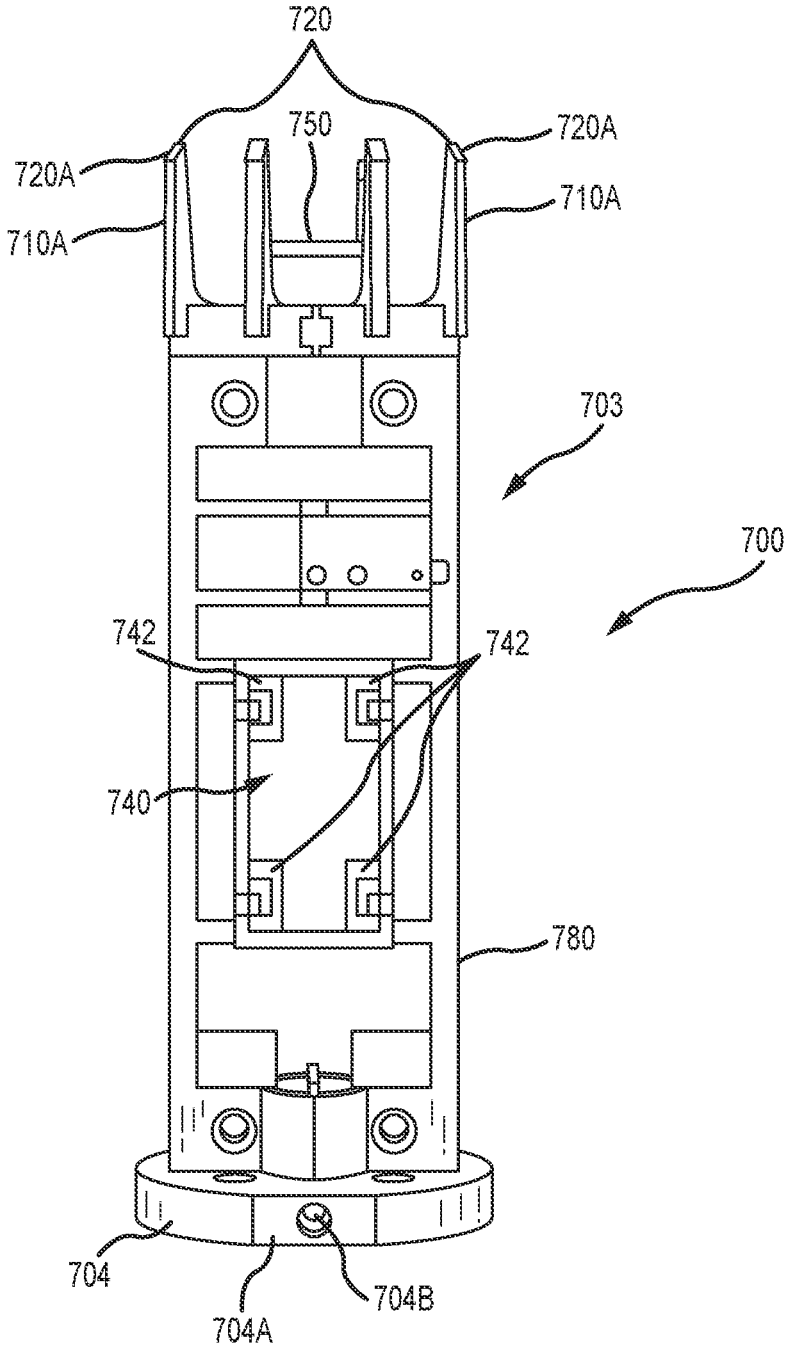
FIG. 29 is a side view of the gun-tube extension of FIG. 27.

Turning now to the Figures, where the purpose is to describe preferred embodiments and not to limit the scope of the claims, FIGS. 1-4 show an indexing end cap 10 according to this disclosure. End cap 10 has the same basic structure as the end caps referenced previously, except that a gun tube on which two of such end caps are mounted can be indexed, or rotated, to different positions. This indexing changes the position of the explosives (also called shape charges) in the gun tube on which the end caps are positioned so the explosives fire outwards at different directions depending upon the position of the gun tube. The gun tube position may be selected based upon geographical mapping of the underground formation in which the gun tube will be positioned and the explosives fired.

End cap 10 is preferably comprised of an insulating material, such as plastic, or a conductive material, such as aluminum. End cap 10 has three annular sections 20, 40, and 60. Annular sections 20 and 40 are configured to fit inside of the end of a gun tube, while annular section 60 is too large to fit into a gun tube and butts against the end of the gun tube and is positioned outside of the gun tube.

Annular section 60 has an outer surface 62 and indicia 70 that enable a user to position a gun tube at any desired rotational position (measured in degrees). When one end cap is positioned at a first end of the gun tube and another end cap positioned at a second end of the gun tube are connected at the same indicia position (such as 0°, 90°, 135°, 180°, or other) and the gun tube is locked in place at that position, the firing direction of shape charges in the gun tube is essentially fixed according to the user's desired direction.

When the end caps 10 are mounted to respective ends of a gun tube they, and the gun tube, are locked in a rotational position by connecting one end cap 10 to a gun-tube extension, such as gun-tube extension 500 or 700, described further herein. The gun-tube extension 500 or 700 is held in a fixed position in a sub-assembly. Gun-tube extension 500 has legs 510A that are received in openings 110 of end cap 10. Gun-tube extension 700 has legs 710A that are received in openings 110 of end cap 10. When the end caps, and the gun tube on which they are positioned, are rotated to a desired position, and legs 510A or 710A are pushed into openings 110, the end caps and gun tube are locked in that position because the gun-tube extension 500 or 700 is affixed in the sub-assembly.

Annular section 40 has an outer wall 42 and openings 44 that receive fasteners (not shown) to connect the end cap 10 to a gun tube in which end cap 10 is positioned.

Opening 90 is to receive electrically-conductive components, as is known in the art. In this embodiment, retainers 100 are utilized to retain bow spring ground assemblies, which are discussed later herein, and retainers 100 and a bow spring ground assembly need not be used. Openings 120 are for miscellaneous uses, such as for permitting wires to be passed through end cap 10 and into or out of a gun tube.

End Caps to Fit Gun Tubes of Different Diameters

FIGS. 5-10 show an end cap 200 that can fit into two different diameter gun tubes, such as a 1⅝" diameter and also a 1¾" diameter gun tube, or a 1⅞" diameter and also a 2" diameter tube. End cap 200 may also be an indexing end cap as described above.

End cap 200 has three sections of different diameters. Section 220 has the smallest diameter, section 240 has the next smallest diameter, and section 260 has the largest diameter. Section 220 is configured to fit into a smaller diameter gun tube, and if cap 200 is used with a smaller diameter gun tube, sections 240 and 260 are too large to fit inside of the gun tube and remain outside of it. Section 240 is configured to fit inside of a larger diameter gun tube. If cap 200 is used with a larger diameter gun tube, sections 220 and 240 fit inside of the gun tube and section 260 remains outside of the gun tube because it is too large to fit inside.

Section 220 has an annular wall 222 and openings 224 to receive fasteners (not shown) to connect the end cap 200 to the gun tube.

Section 240 has an annular wall 242 and openings 244 to receive fasteners (not shown) to connect the end cap 200 to the gun tube.

Opening 290 performs the same function as previously-described opening 90. Openings 220 perform the same function as previously-described openings 120. Retainers 300 are utilized to retain bow spring ground assemblies, which are discussed later herein, and retainers 300 and bow spring ground assemblies need not be used.

FIGS. 11-14 show an end cap 400 that is the same as end cap 200 except that it shows bow spring assembly retainer portion 450. End cap 400 is also designed to fit two different diameter gun tubes, and it may have indicia for indexing as previously described. In this embodiment the head of a fastener used in a bow spring ground assembly, such as assembly 4000 discussed herein, can be accessed from an opening or slot 454 in the top (or widest portion) of end cap 400. In this manner the end cap 400 can be placed inside of a gun tube with the bow spring in a relaxed position and a user can then tighten the fastener to move the bow spring outward to contact and ground against the inside surface of a casing in which the gun tube including end cap 400 is positioned. A nut into which the fastener of bow spring 4000 is threaded may be held in position in opening 454, and the fastener head may be on the top surface of section 460, or located in slot 452.

End cap 400 has a first section 420, a second section 440, and third section 460. First section 420 has the smallest diameter and will fit into a smaller diameter gun tube, in which case sections 440 and 460 will remain outside of the gun tube because they cannot fit inside. For a larger diameter gun tube, both sections 420 and 440 fit inside and section 460 remains outside.

Section 420 has an outer surface 422 and an opening 424 to receive a fastener (not shown) to connect end cap 400 to a gun tube. Section 440 has an outer surface 442 and an opening 444 to receive a fastener (not shown) to connect end cap 400 to a gun tube. Opening 492 is to connect end cap 400 to an internal component of the gun tube.

Gun-Tube Extensions

Turning now to FIGS. 15-26, as examples, an exemplary gun-tube extension 500 is shown.

Gun-tube extension 500 is outside of and separate from a gun tube. It has a first end 501 configured to be connected to an end cap and a second end 502 configured to be received in a sub-assembly.

Figure 32:
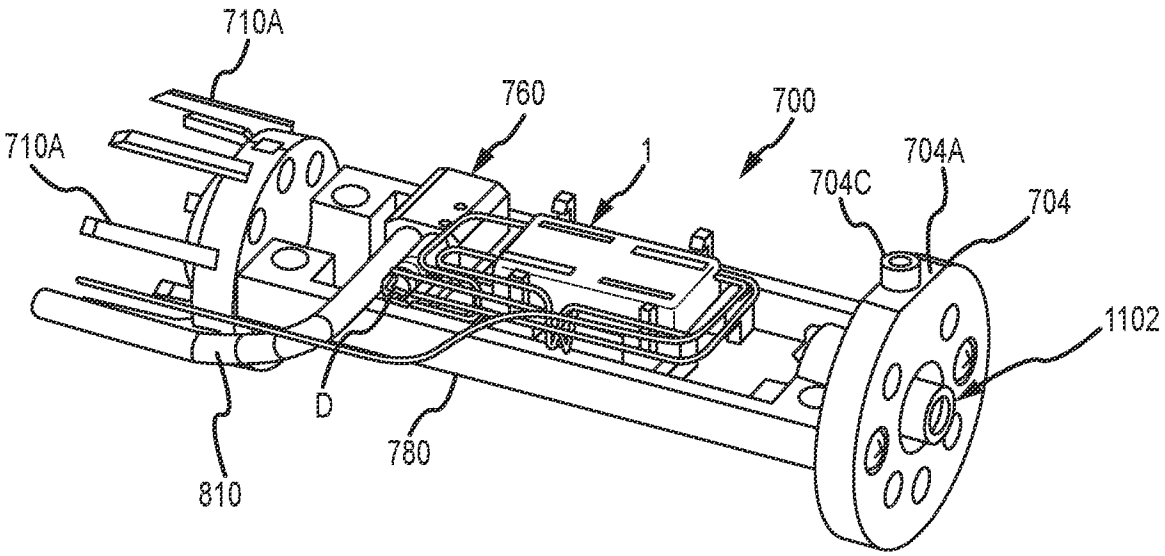
FIG. 32 is a side, perspective view of the gun-tube extension of FIG. 27 with an addressable switch, detonator and primer cord.
Figure 32A:
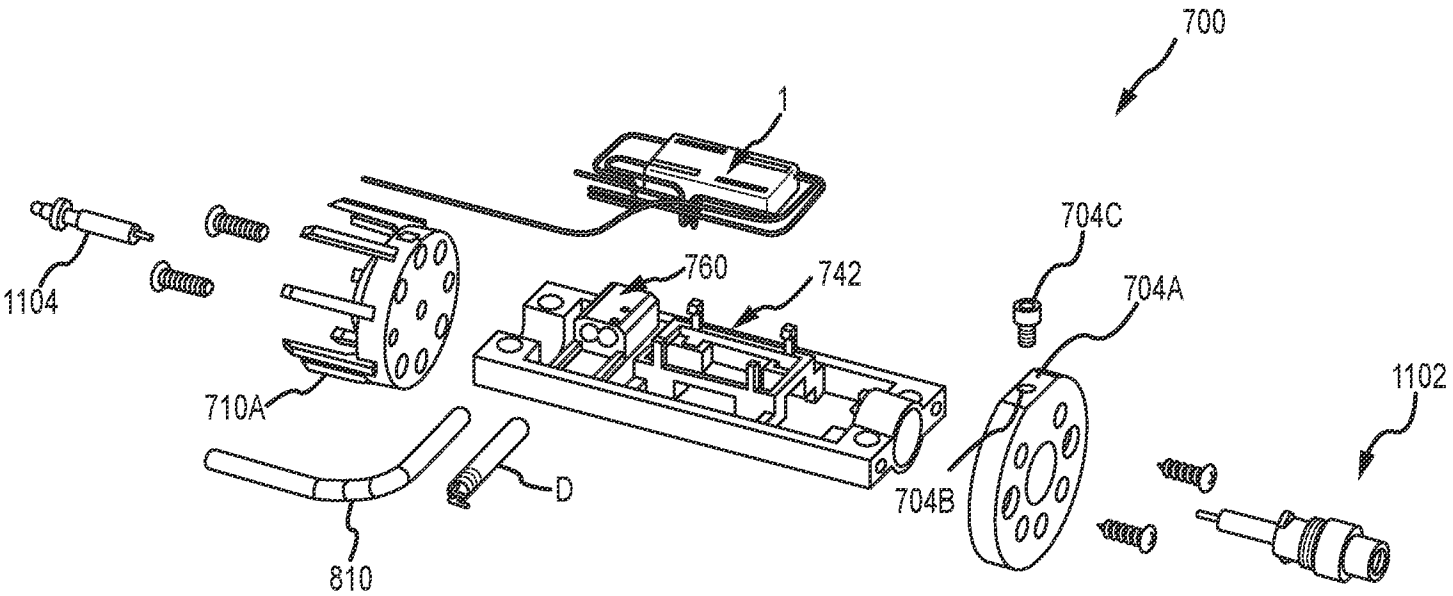
FIG. 32A is a side perspective, exploded view of the gun-tube extension of FIG. 32.

As shown, gun-tube extension 500 is molded as separate pieces (the first section, second section and body portion) as can best be seen in FIG. 32A with respect to gun-tube extension 700. But gun-tube extension 500 could be formed in any suitable manner.

Gun-tube extension 500 has an annular disk 504 at second end 502, with a top surface 518 and an annular side surface 514. A flat portion 504A is preferably formed in side surface 514 as well as an opening 504B configured to receive a fastener 504C. As described herein, the head of fastener 504C remains outside of flat portion 504A. The purpose of this structure is to orient gun-tube extension 500 in one position inside of a sub-assembly. The inner wall (not shown) of the sub-assembly includes a groove into which the head of fastener 504C can be received and fastener 504C cannot fit at another location in the sub-assembly, such as sub-assembly 1100.

A passage 545 permits electrical connections from a sub-assembly to pass into gun-tube extension 500.

Body portion 503 is for retaining and supporting a switch, such as an addressable switch 1, a detonator D, and a primer cord 810. Body portion 503 has a frame 580, a switch support 540, and a retainer 560 for retaining detonator D and primer cord 810.

Switch support 540 as shown has four mounting blocks 542 with openings 542A. Addressable switch 1 is mounted onto supports 540 and fasteners attach switch 1 to openings 542A. Retainer 560 has two openings, one of which receives detonator D and the other of which receives primer cord 810.

Second end 501 has an annular first section 508 from which a plurality of legs 510 (each leg being referenced by numeral 510A) extend. Each leg 510A has a pointed end 520 and an angled portion 520A. Legs 510 are configured to be received and locked into openings, such as openings 110, in an end cap in order to connect to the end cap and lock it, and the gun tube to which the end cap is attached, into position.

An extension 550 with an opening is configured to allow the passage of components to electrically communicate.

FIGS. 27-29, 32-34, and 39, as examples, show a gun-tube extension 700.

Gun-tube extension 700 is outside of and separate from a gun tube. It has a first end 701 configured to be connected to an end cap and a second end 702 configured to be received in a sub-assembly.

Gun-tube extension 700 has an annular disk 704 at second end 702, with a top surface 718 and an annular side surface 714. A flat portion 704A is preferably formed in side surface 714 as well as an opening 704B configured to receive a fastener 704C. As described herein, the head of fastener 704C remains outside of flat portion 704A. The purpose of this structure is to orient gun-tube extension 700 in one position inside of a sub-assembly. The inner wall (not shown) of the sub-assembly includes a groove into which the head of fastener 704C can be received and fastener 704C cannot fit at another location in the sub-assembly, such as sub-assembly 1100.

A passage 745 permits electrical connections from a sub-assembly to pass into gun-tube extension 700.

Body portion 703 is for retaining and supporting a switch, such as an addressable switch 1, a detonator D, and a primer cord 810. Body portion 703 has a frame 780, a switch support 740, and a retainer 760 for retaining detonator D and primer cord 810.

Switch support 740 as shown has four mounting blocks 742 with openings 742A. Addressable switch 1 is mounted onto support 540 and fasteners attach switch 1 to openings 742A. Retainer 760 has two openings, one of which receives detonator D and the other of which receives primer cord 810.

Second end 701 has an annular first section 708 from which a plurality of legs 710 (each leg being referenced by numeral 710A) extend. Each leg 710A has a pointed end 720 and an angled portion 720A. Legs 710 are configured to be received and locked into openings, such as openings 110, in an end cap in order to connect to the end cap and lock it, and the gun tube to which the end cap is attached, into position.

An extension 750 with an opening is configured to allow the passage of components to electrically communicate.

As shown, gun assembly 700 is molded as separate pieces (the first section, second section, and body portion) as can best be seen in FIG. 32A with respect to gun-tube extension 700. But gun-tube extension 700 could be formed in any suitable manner.

Gun-tube extension 700 can optionally rotate, preferably by second end 702 being rotatably connected to body portion 703. Weight 715, discussed further below, may be connected to body portion 703 by fasteners in order to use gravity to orient gun-tube extension 700 and the gun tube to which it is indirectly connected.

Orientation of Gun Tube

Figure 30:
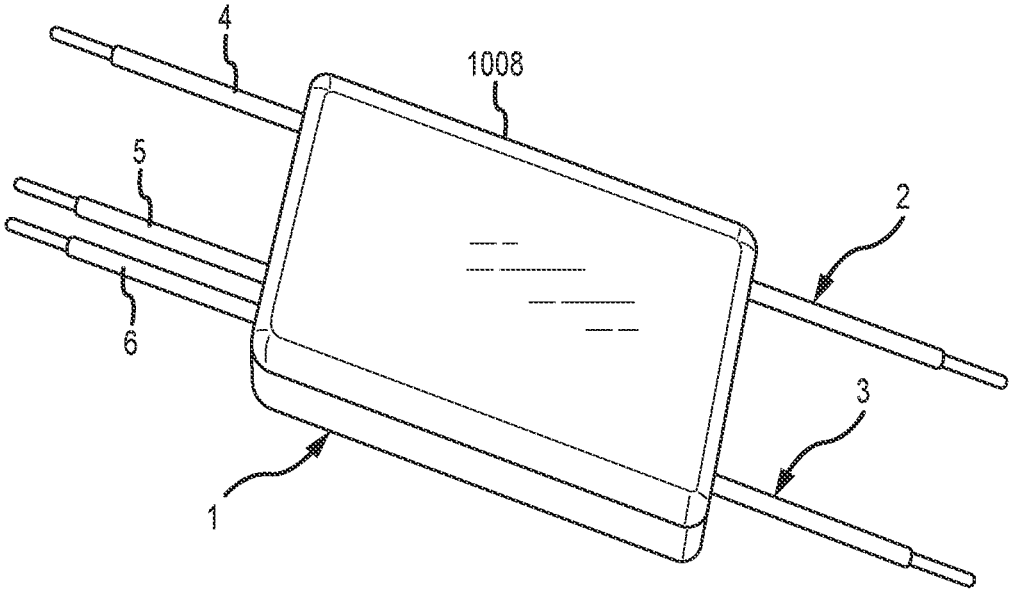
FIG. 30 is a perspective, top view of an addressable switch.

Turning to FIG. 30, an addressable switch 1 is shown, which is preferably made by Integrated Solutions, Inc. of Phoenix, Ariz., and is used to detonate explosive charges in a gun tube.

Figure 31:
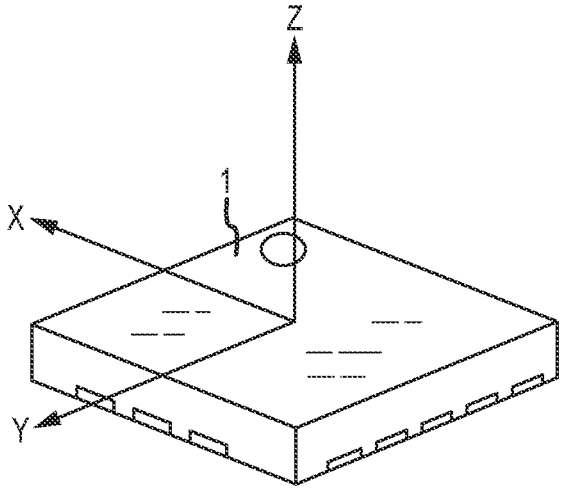
FIG. 31 is a perspective, side view of the addressable switch shown in FIG. 30 that includes an orientation device.

Addressable switch 1 may be at any suitable location, such as in the gun tube, in a sub-assembly, or in a gun-tube extension 500 or 700. Addressable switch 1 may have an optional orientation-device, which is most preferably an accelerometer, as part of its integrated circuitry (IC or microprocessor). The accelerometer, or other special-orientation device, determines the relative position and can output data that indicates one or more of the following positions of the addressable switch or other structure on which the orientation device is positioned: (1) angular position; (2) rotational location about an axis; (3) G forces; (4) 10,000 G high shock survivability; or (5) x, y, and z axis position. This is shown to some extent in FIG. 31.

The addressable switch may be positioned outside of the gun tube. An addressable switch is typically wired and placed inside of a gun tube adjacent to the shape charges to be fired. When used in this manner, the addressable switch 1 would be randomly positioned and, in many cases, not constrained at all. Using a gun-tube extension 500 or 700, the addressable switch is fixed in one position, which is why an orientation device can be effectively used.

Further, a temperature sensor may be included in the microprocessor of addressable switch 1. Another external temperature sensor may be included on the frame of the gun-tube extension 500 or 700, or on any other suitable structure, that sends temperature data directly to the microprocessor in order to provide a more stable temperature reading, and to also provide a more accurate reading than the microprocessor temperature sensor would provide.

To accurately determine the physical orientation of the addressable switch 1, if the orientation device (such as an accelerometer) is attached to addressable switch 1 or part of its IC, the physical body (in this case, the enclosure 1008) of the addressable switch 1 is constrained in the x, y and z axes. Thus, addressable switch 1 in this embodiment is positioned on support 540 of gun-tube extension 500, or support 740 of gun-tube extension 700, so that the addressable switch's placement in the gun tube or gun-tube extension 500 or 700 is stationary relative the gun tube or gun-tube extension. Once mounted, the gun-tube extension 500 or 700 may be rotated. This rotates the gun tube and positions the charges 820 in gun tube 800 to direct the outward force of the explosions to where an operator desires.

Addressable switch 1 is used to ignite the detonator D, which in turn ignites the primer cord 810 linking to each of the explosive charges 820. Orienting the addressable switch 1 can provide feedback to a surface operator, via a communication scheme, such as a communication scheme developed by Integrated Solutions, Inc. of Phoenix, Ariz., that can communicate to an operator the orientation of the addressable switch in the wellbore (and thereby the orientation of the gun tube with its explosive charges) prior to detonation.

A collective string of gun tubes connected by sub-assemblies rotates as the string is moved either up or down a wellbore. The orientation of each gun tube may be determined by monitoring the rotational position of each gun tube in the string, which is specific to the communication from each particular addressable switch. Then it may be possible to orient the gun-tube string as desired within the wellbore to select the desired firing location for each gun tube. This can be done without the use of a self-orientating gun tube that uses weights, or other means to position the gun tube in the wellbore. Once the desired gun-tube position is determined, such as by determining the position of each addressable switch, the relative rotational position of the gun tube may be altered (and measured) such as by using a motor to rotationally move the gun tube until the gun tube is properly position. A signal can then be sent to the addressable switch 1, which would fire the detonator D and explosive charges 820. The gun string would then be pulled farther up the wellbore to the next firing position and the method could be repeated. Utilizing this structure and method, guns can be fired as they are being pulled up the well bore without stopping.

A string of gun tubes could also be positioned by rotating the entire gun tube string. For example, a Rotary Motor Unit (RMU) positioned below the CCL casing collar locator and below the motorized release tool, for example, could be driven to rotate the gun-tube string based by communication with a surface controller. In this scenario, the gun string could be stopped in the wellbore, and the addressable switch of the lowest gun in the gun-tube string could be communicated with to determine its relative orientation. Knowing this orientation, the RMU could be driven to rotate the lower gun tube to the proper position so the explosive charges are in the proper position prior to detonation. The gun string would then be pulled up the wellbore to the next location, where this method could be repeated.

Pre-Wiring

Addressable switches are most often wired at the job site, meaning that the addressable switch wires are terminated using quick connectors known in the art. Addressable switches are instead sometimes positioned within a sub-assembly used to connect two gun tubes. Sub-assemblies are machined pieces of steel that connect two gun tubes. Some switches used inside of a sub-assembly are of a mechanical design (using concussive force or displacing a rod to set or break the switch continuity), but addressable switches may also be positioned in sub-assemblies.

The addressable switch 1 may be pre-wired to the detonator D at the manufacturing facility instead of at the job site. This could save operational time at the wellbore site.

Examples of Assembled Components

Figure 33:
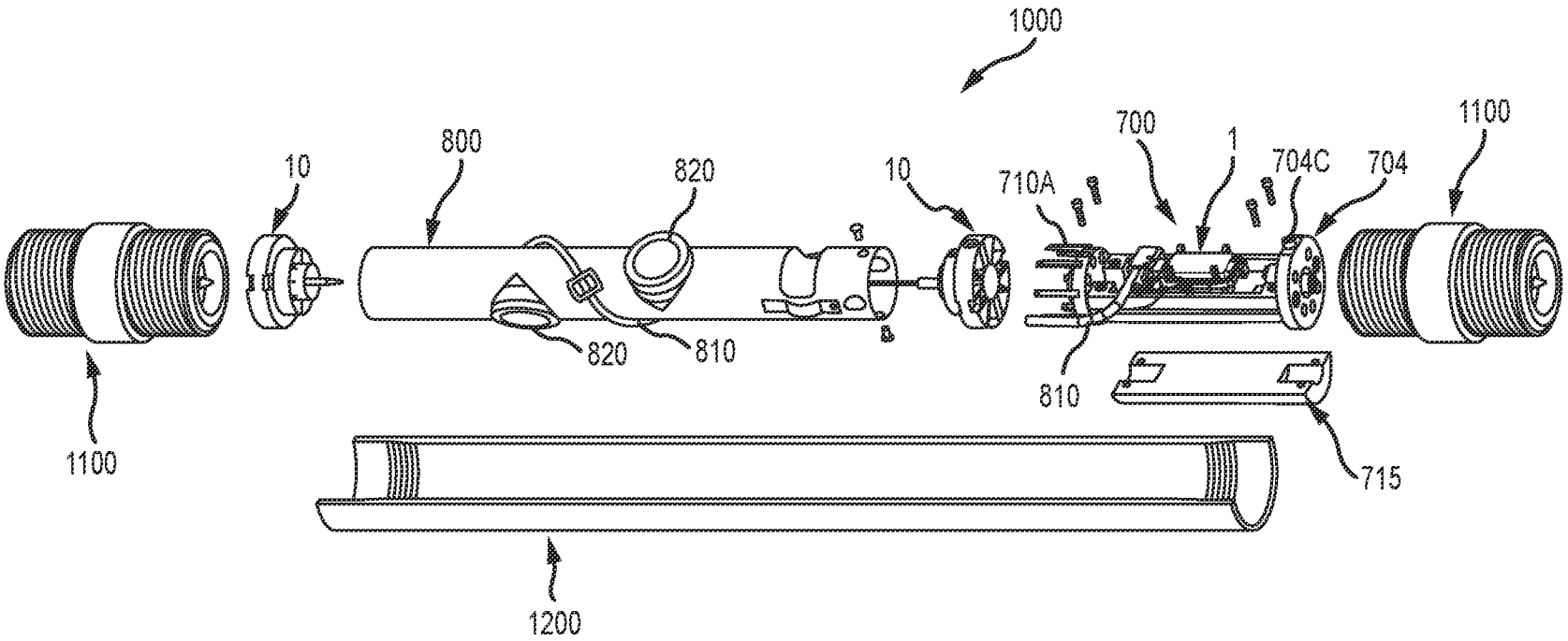
FIG. 33 is a side, perspective, partially exploded view of a gun-tube assembly according to this disclosure.
Figure 34:
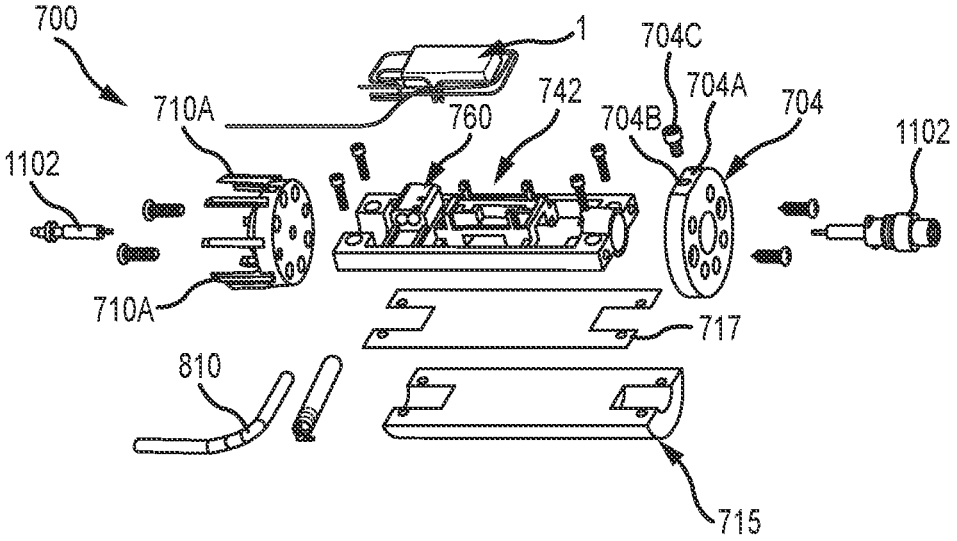
FIG. 34 is a side, perspective, exploded view of the gun-tube extension shown in FIG. 33.
Figure 35:
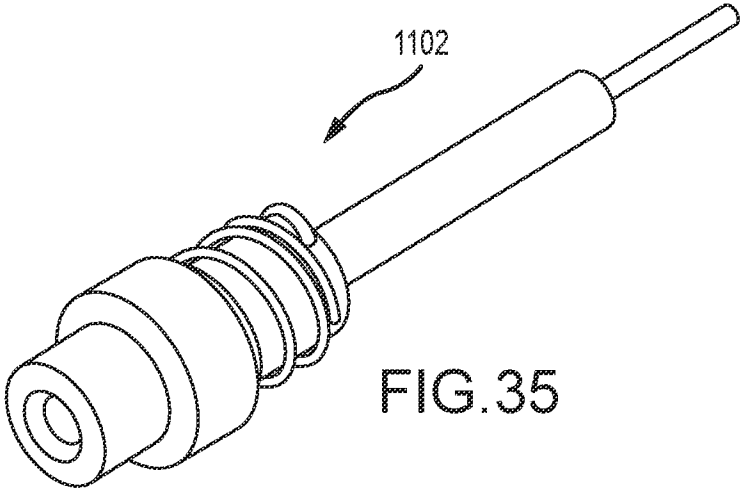
FIG. 35 is a side perspective view of an end fitting.
Figure 36:
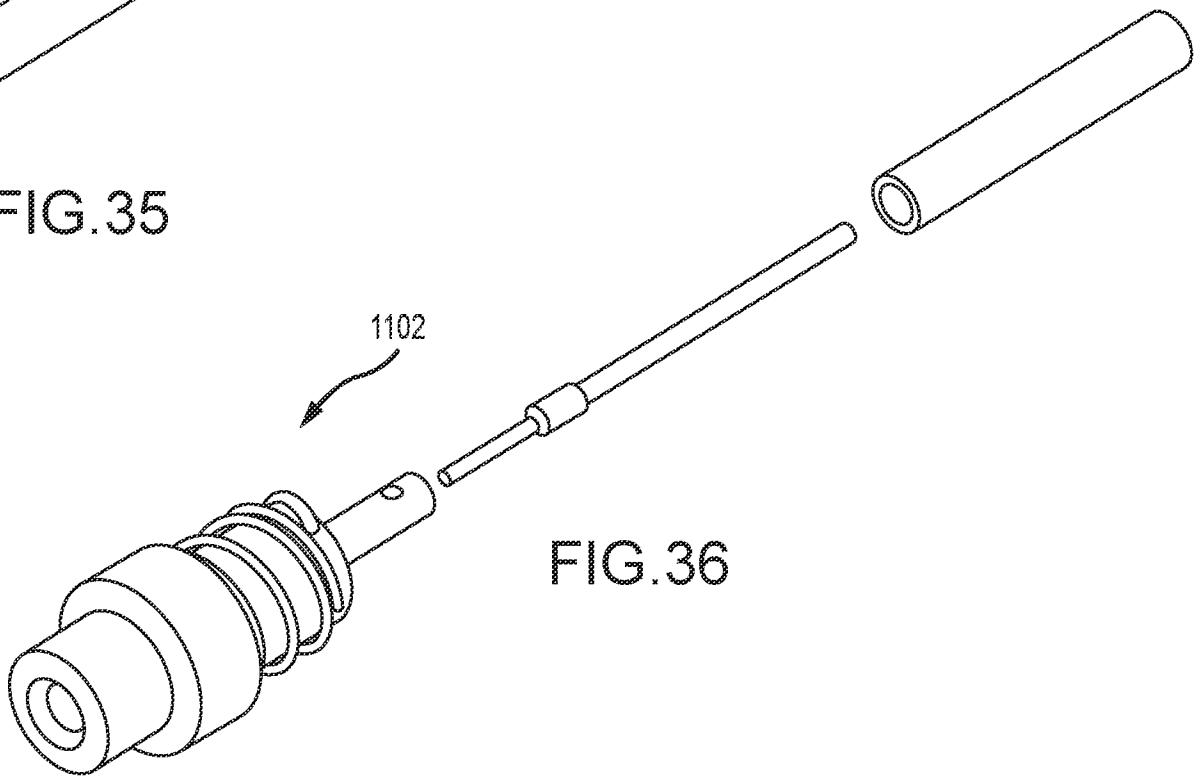
FIG. 36 is a side, perspective, partially exploded view of the end fitting of FIG. 35.
Figures 37, 38:
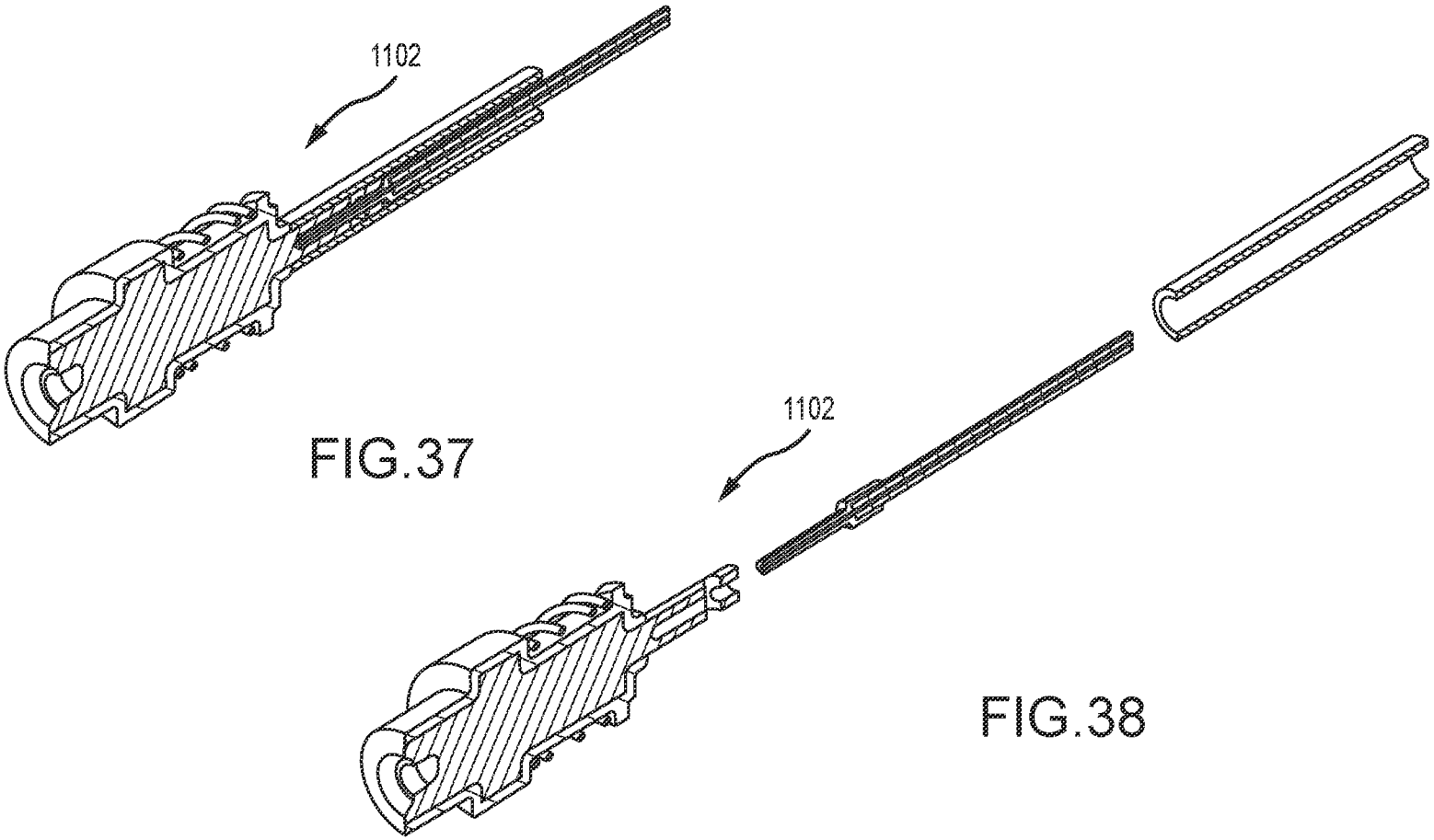
FIG. 37 is a side, cross-sectional view of the end fitting of FIG. 35.
FIG. 38 is a side, perspective, partially exploded, cross-sectional view of the end fitting of FIG. 37.

FIGS. 33 and 34 show an example of a gun tube that includes indexing end caps 10 and gun-tube extension 700. End caps 10 are received, respectively in opposite ends of gun tube 800, which includes shape charges 820 and primer cord 810. Gun-tube extension 700, with weight 715, is attached to one of end caps 10 to lock gun tube 800 into position. Then the second end 702 of gun-tube extension 700 is positioned in a sub-assembly 1100. An end fitting 1102 inside of sub-assembly 1100 is received in an opening of the second end of gun-tube extension 700 to provide electricity to the addressable switch and detonator.

FIGS. 35-38 show an end fitting, which is known in the art.

Figure 41:
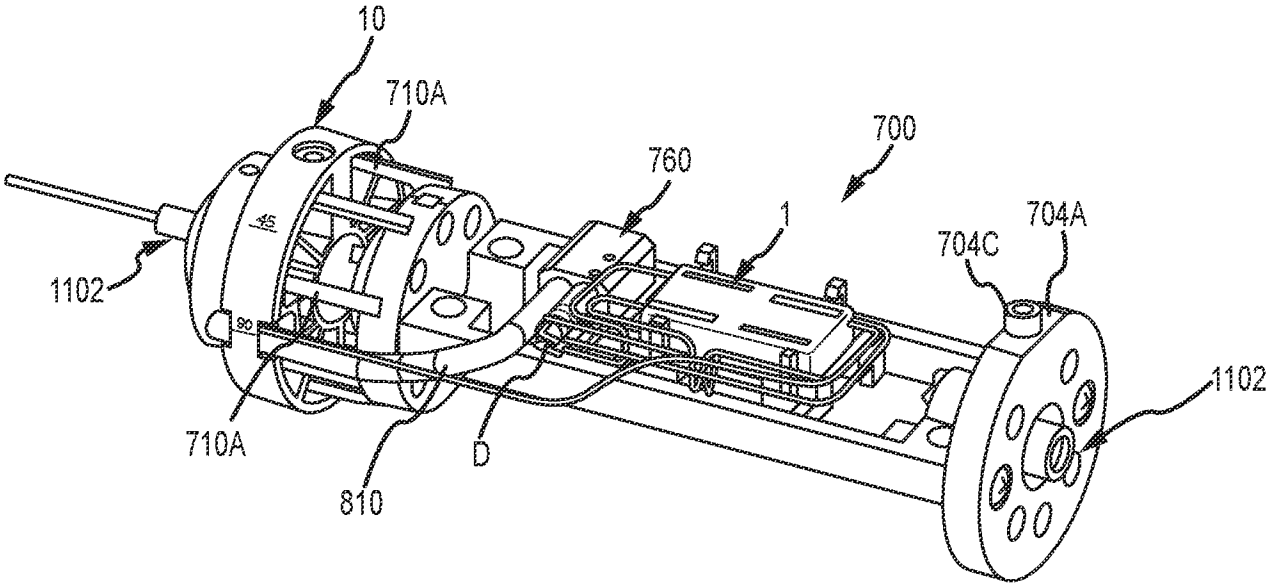
FIG. 41 is a perspective, side view of the gun-tube extension of FIG. 27 without a weight and that is connected to an end cap.
Figure 42:
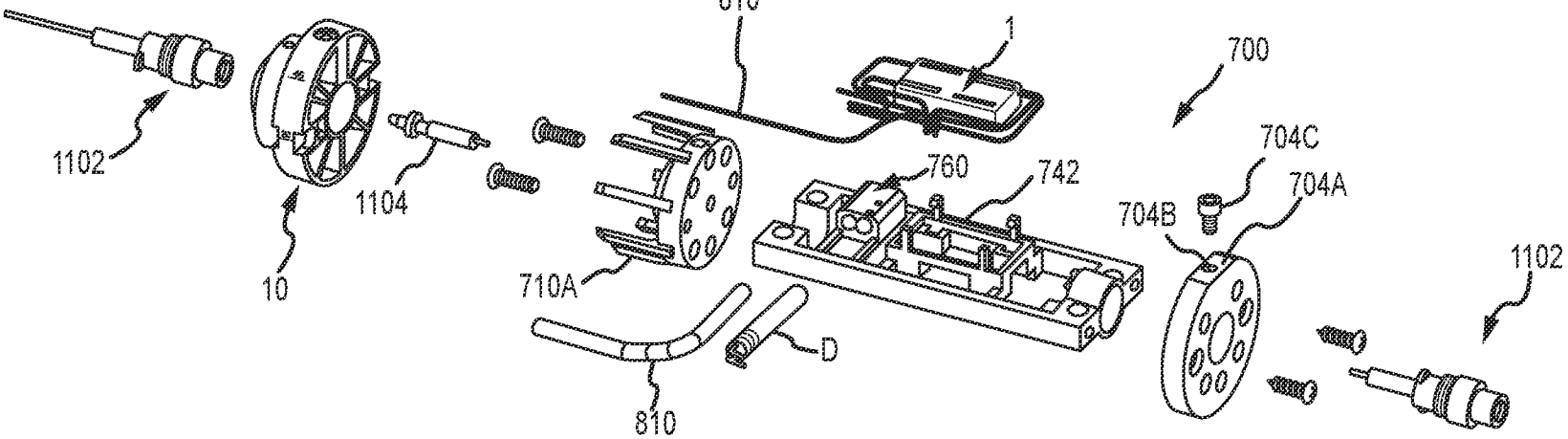
FIG. 42 is a perspective, exploded, side view of the gun-tube extension of FIG. 41.

FIGS. 41 and 42 are illustrations of gun-tube extension 700 with end fittings 1102 and no weight.

Figure 55:
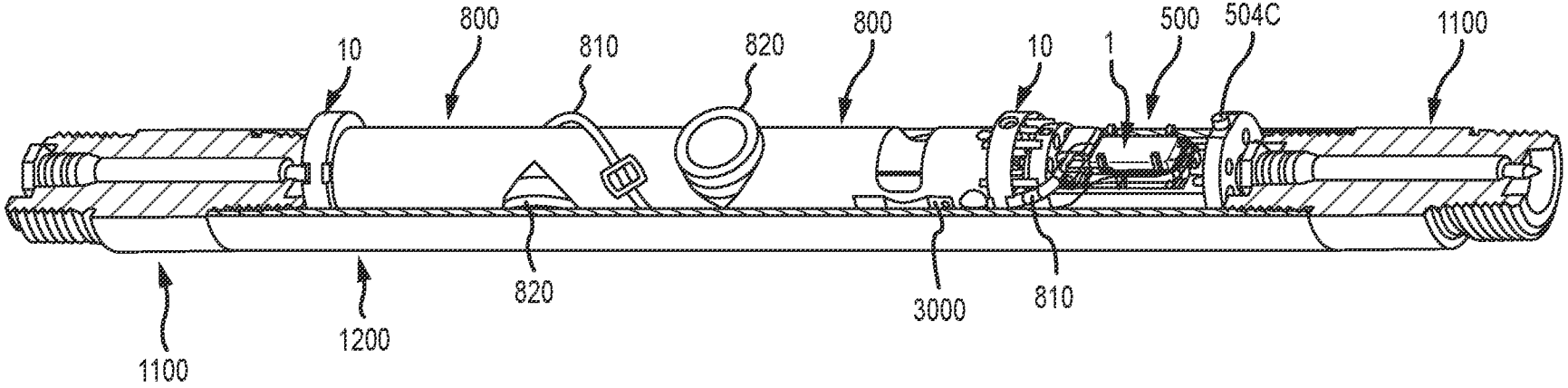
FIG. 55 is a perspective, partial cross-sectional, side view of an assembled gun tube with the gun-tube extension of FIG. 15, indexed end caps, and positioned in an outer casing and connected to sub-assemblies.
Figure 56:
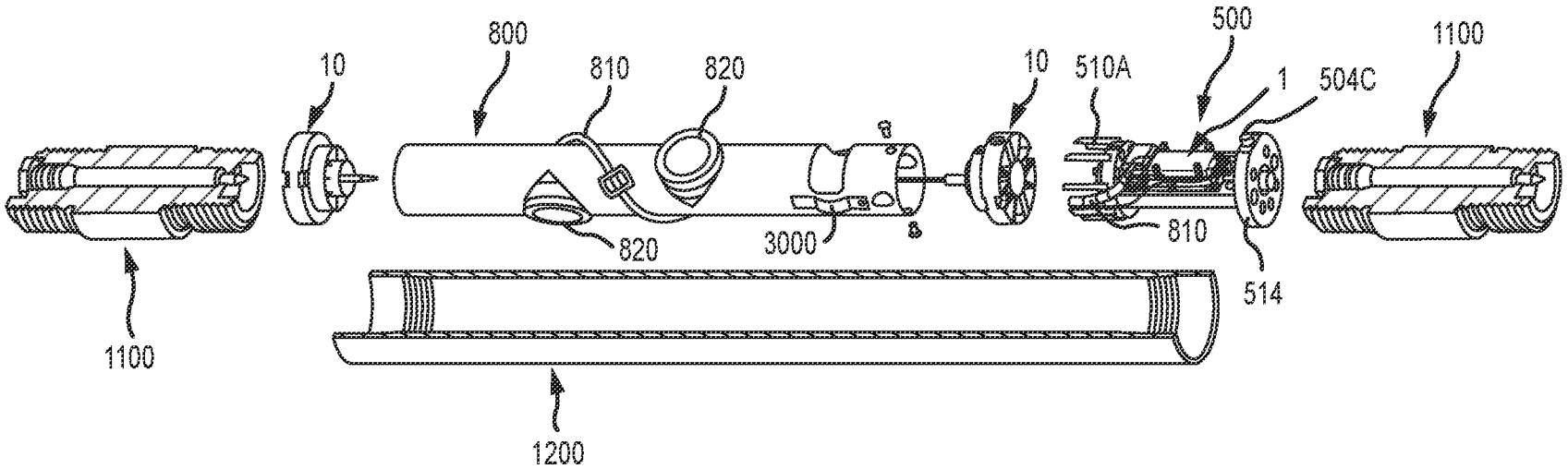
FIG. 56 is a partially exploded, partial cross-sectional, perspective, side view of the gun tube of FIG. 55.

FIGS. 55 and 56 are illustrations of gun-tube extension 500 with end caps 10, in a gun tube 800, in a casing 1200, and with sub-assemblies 1100.

Figure 39:
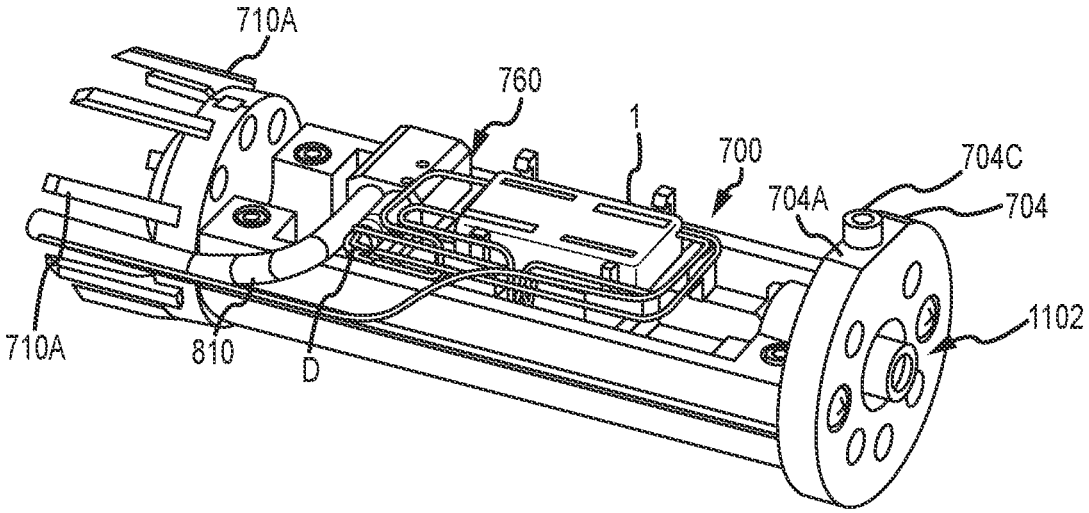
FIG. 39 is a side, perspective view of a gun-tube extension of FIG. 27 with a weight attached.
Figure 40:
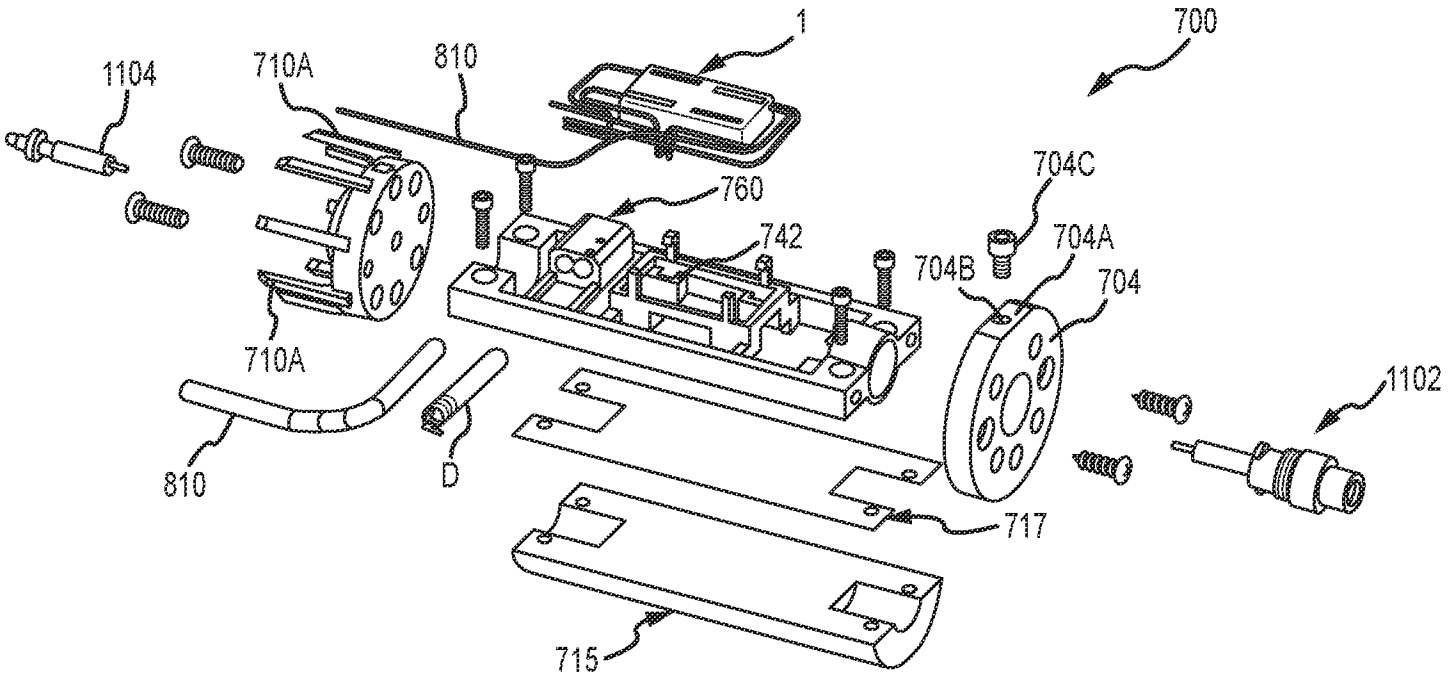
FIG. 40 is a perspective, side, exploded view of the gun-tube extension of FIG. 39.

FIGS. 39 and 40 are illustrations of gun-tube extension 700 with weight 750, and with an end cap 10, end fitting 1102, and plunger 1104.

Figure 43:
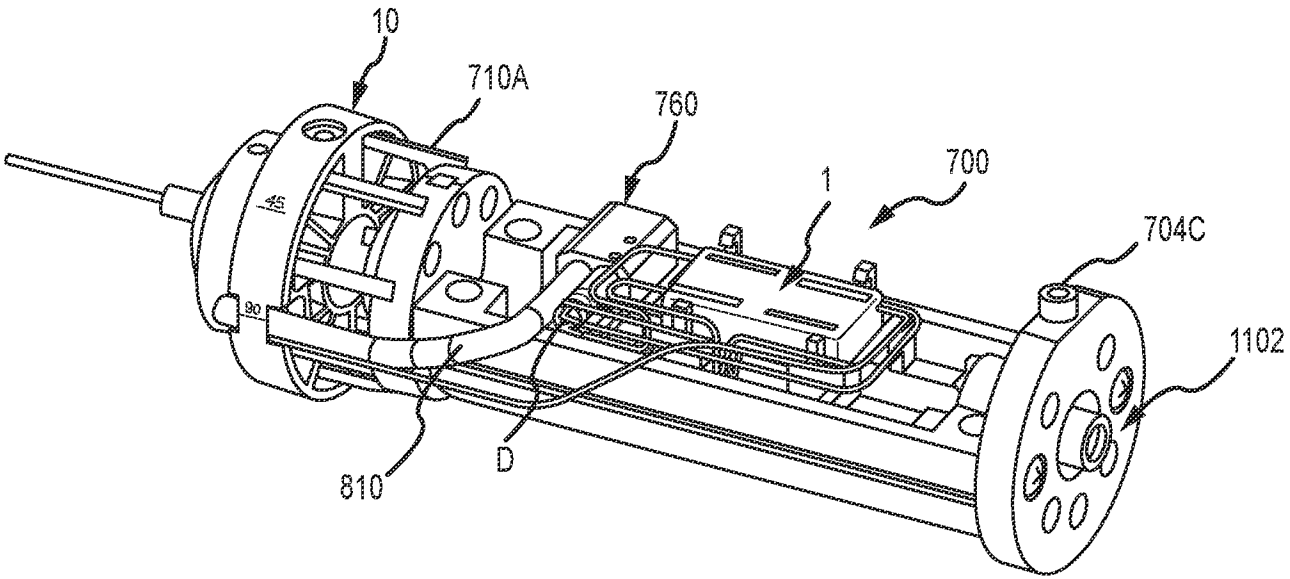
FIG. 43 is a side, perspective view of the gun-tube extension of FIG. 27 with a weight and attached to an end cap.
Figure 44:
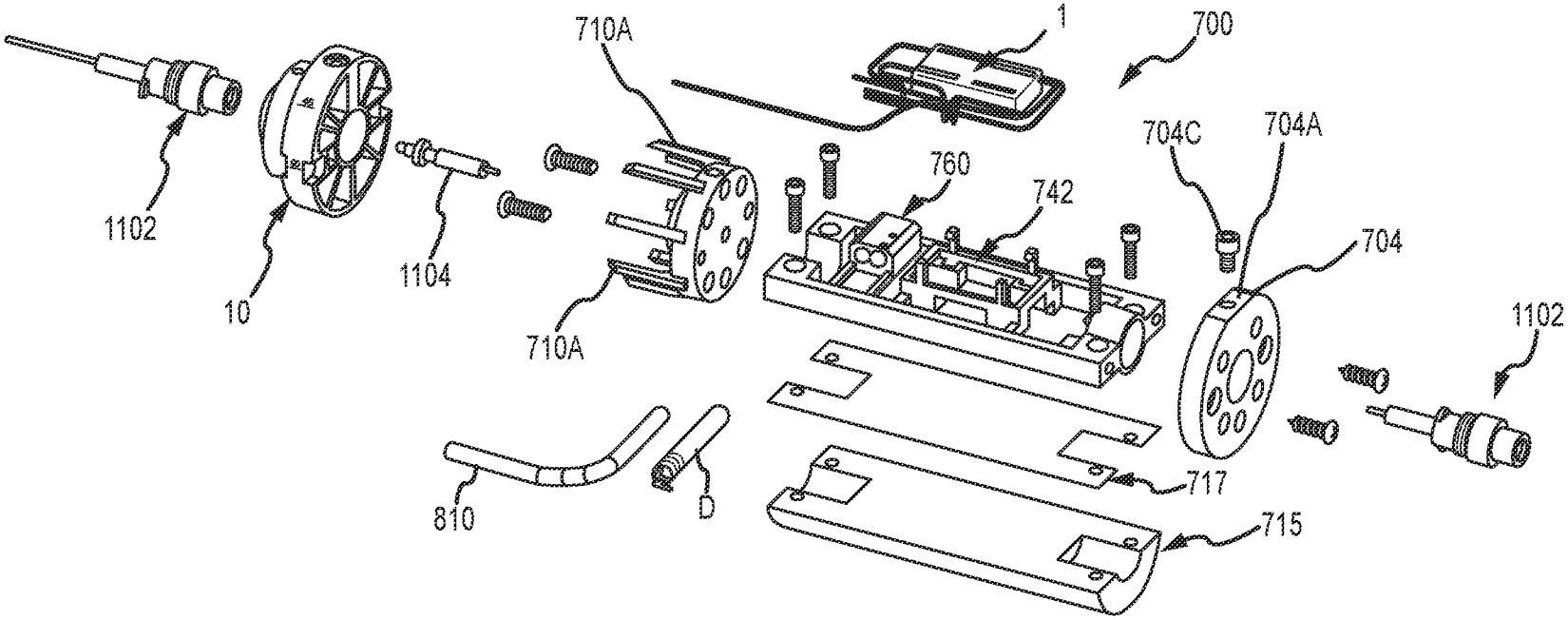
FIG. 44 is a side, perspective, exploded view of the gun-tube extension of FIG. 47.

FIGS. 43 and 44 are additional illustrations of gun-tube extension 700 with a weight 715 and an end cap 10.

Figure 45:
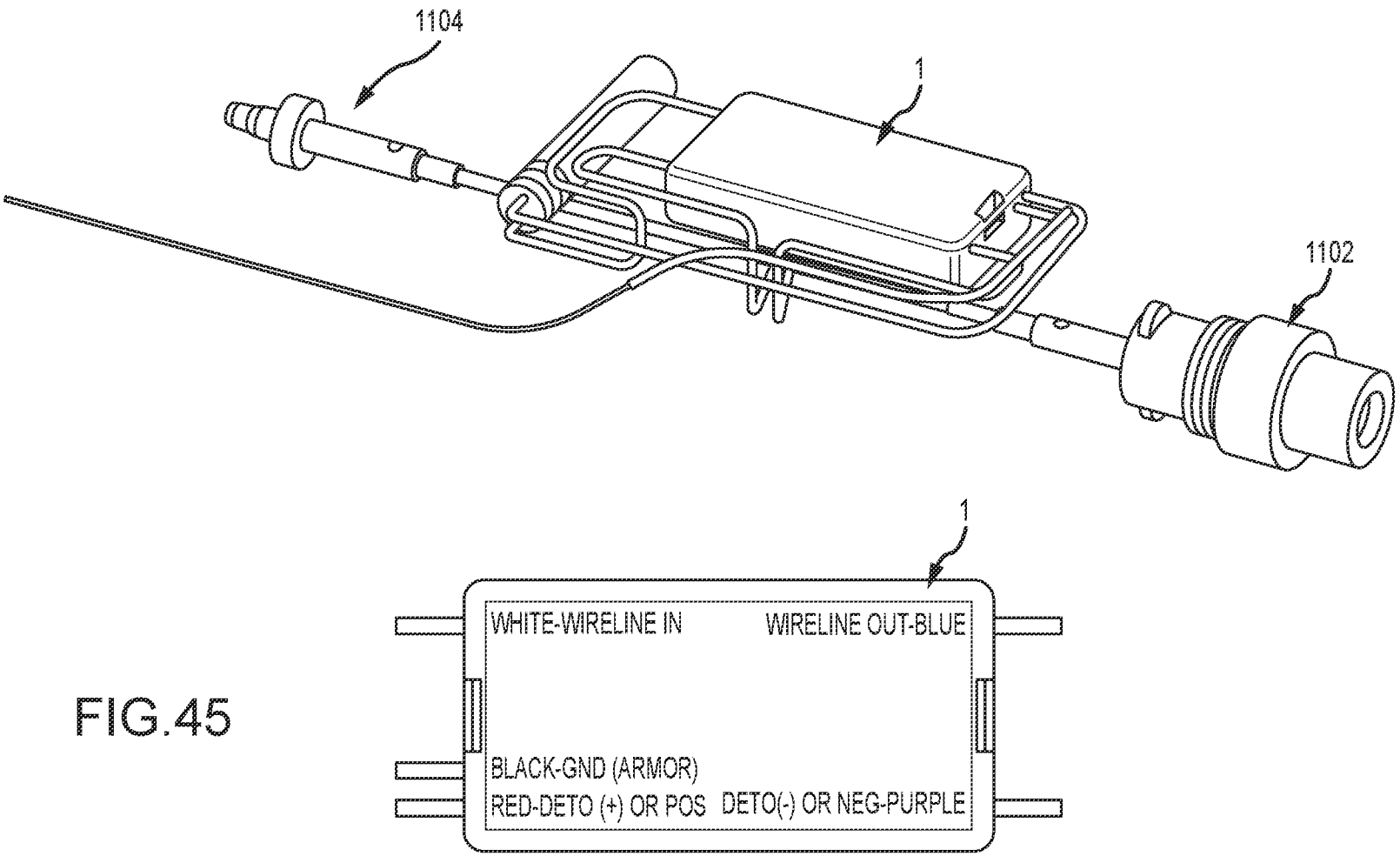
FIG. 45 is a side, perspective view of an addressable switch showing the wired connections.
Figure 46:
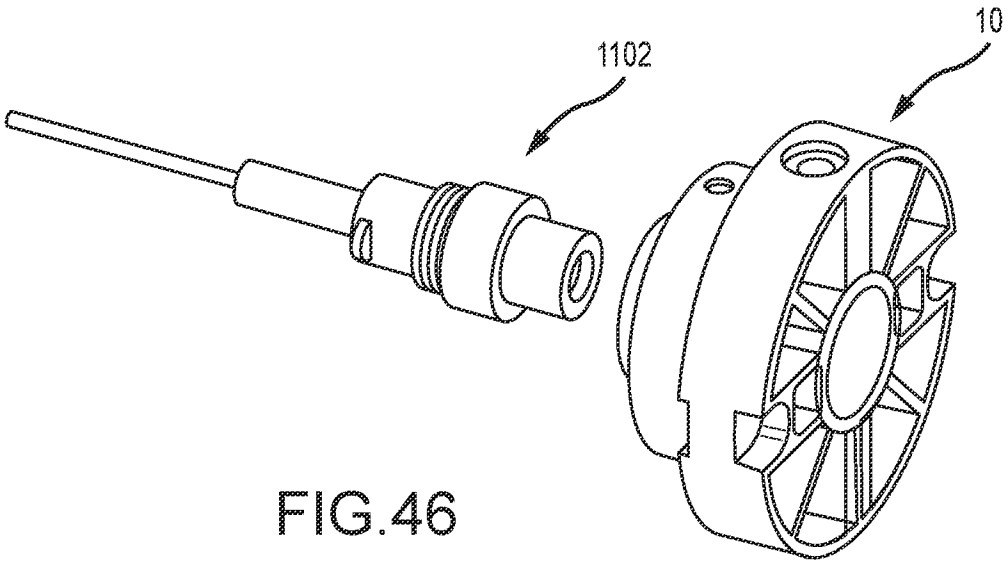
FIG. 46 is a perspective, side view of an indexing end cap and end fitting.
Figure 49:
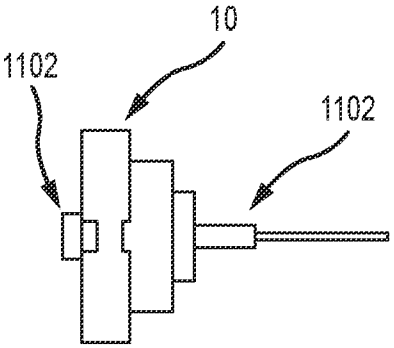
FIG. 49 is an opposite, side view of the assembled end cap of FIG. 46.
Figure 48:
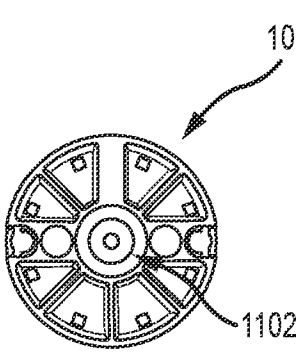
FIG. 48 is a top view of the assembled end cap of FIG. 46.
Figure 47:
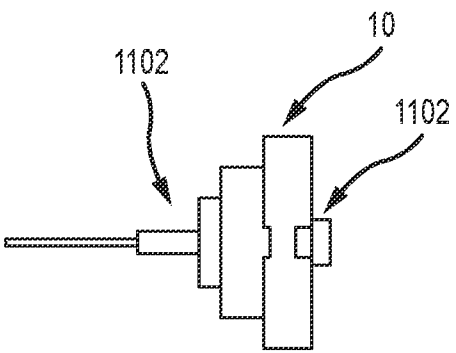
FIG. 47 is a side view of the assembled end cap of FIG. 46.
Figure 50:
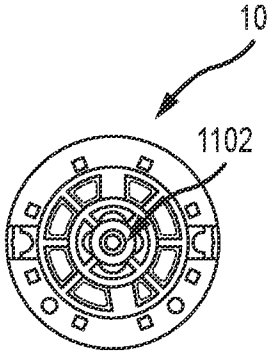
FIG. 50 is a bottom view of the assembled end cap of FIG. 46.

FIG. 45 shows the electrical connections from end fitting 1102 to addressable switch 1 and leaving switch 1.

FIGS. 46-50 are views of end cap 10 with end fitting 1102.

Figure 51:
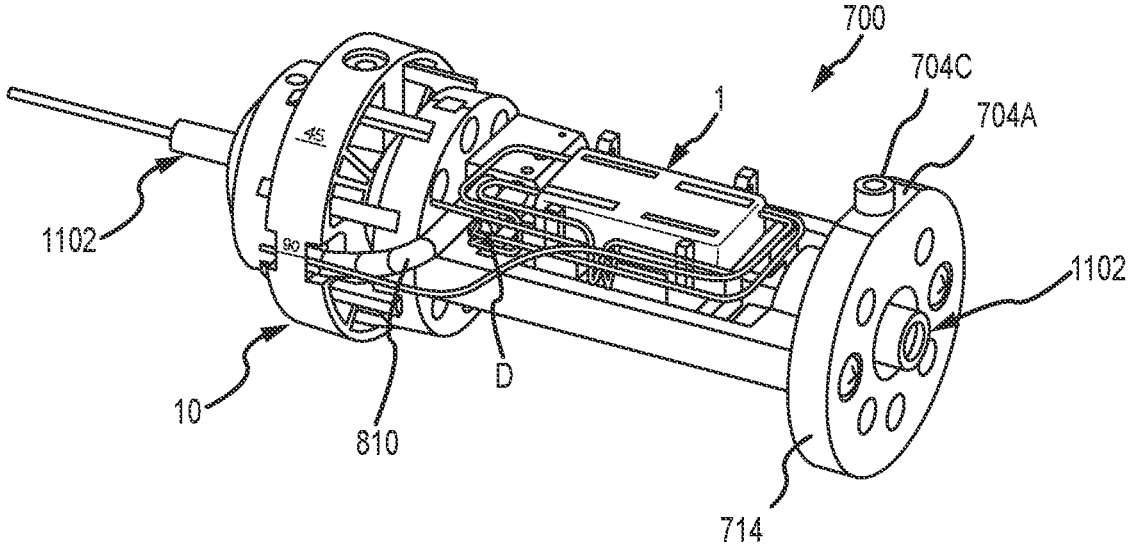
FIG. 51 is a side, perspective view of the gun-tube extension of FIG. 15 attached to an end cap and oriented at 0 degrees.
Figure 52:
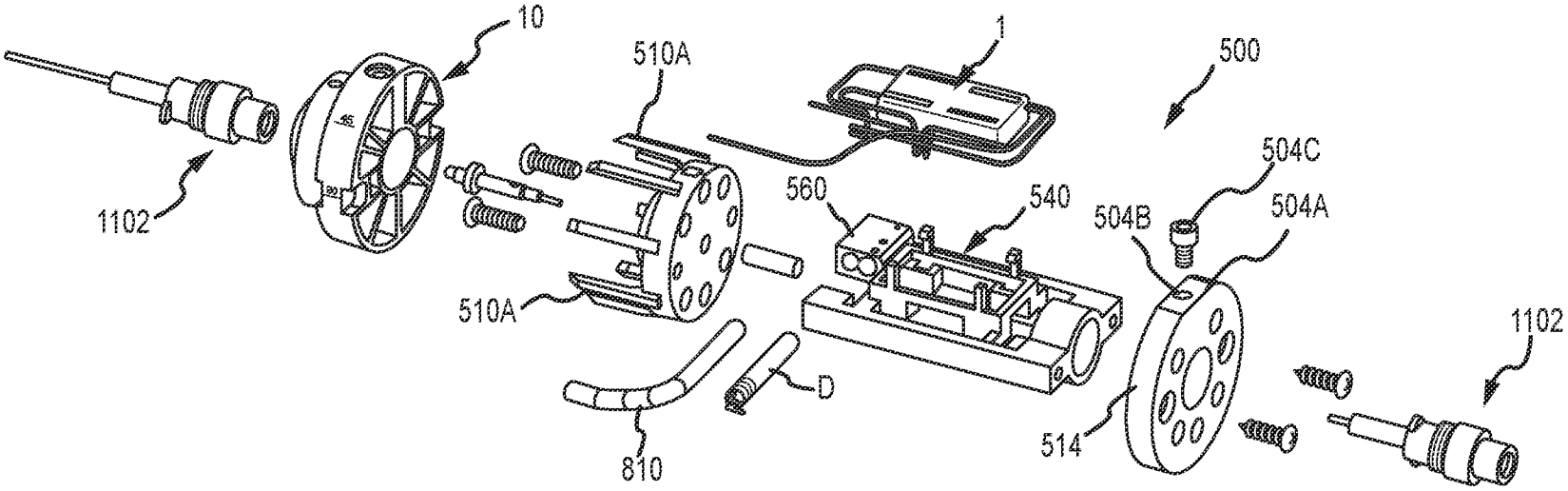
FIG. 52 is a perspective, exploded, side view of the gun-tube extension of FIG. 51.

FIGS. 51 and 52 are illustrations of gun-tube extension 500 with end cap 10 and end fittings 1102 with the end cap 10 oriented at 0°.

Figure 53:
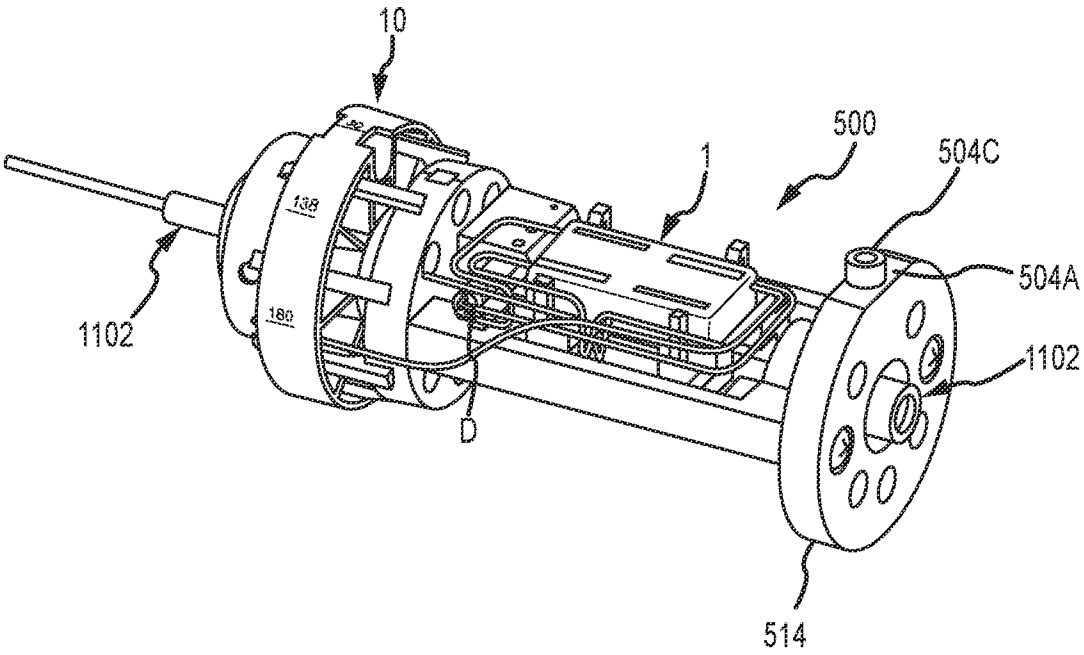
FIG. 53 is a side, perspective view of the gun-tube extension of FIG. 15 attached to an end cap and oriented at 90 degrees.
Figure 54:
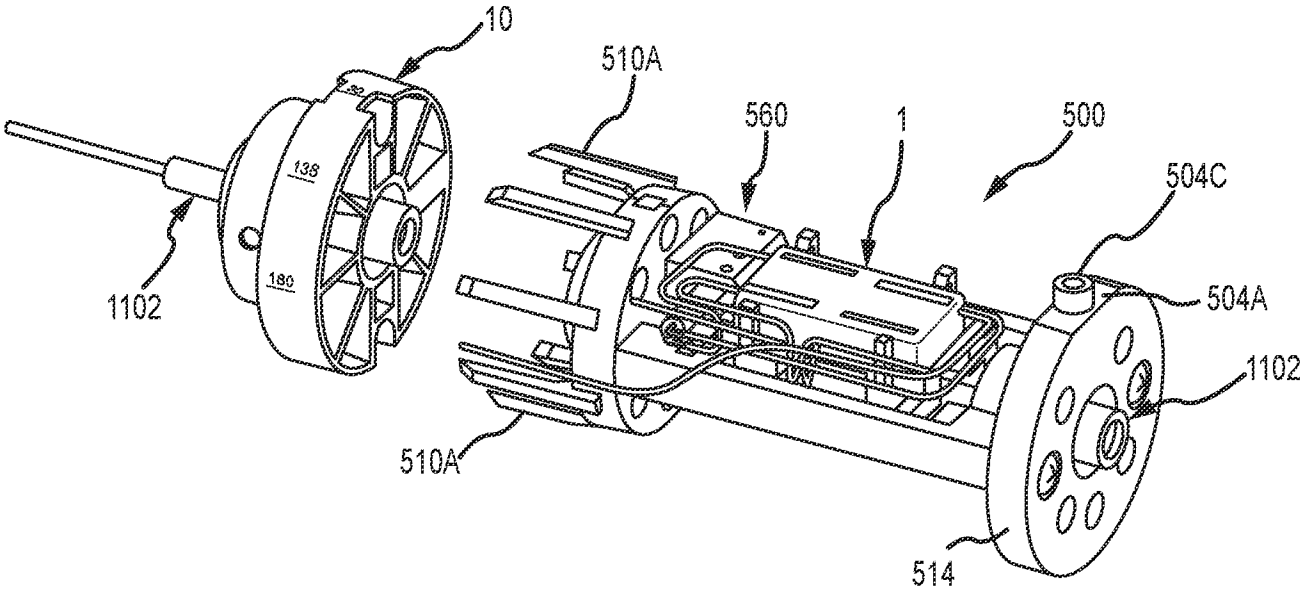
FIG. 54 is a partial, exploded, side, perspective view of the gun-tube extension of FIG. 53.

FIGS. 53 and 54 illustrate end-tube extension 500 with end cap 10 and end fittings 1102 with the end cap 10 oriented at 90°.

FIGS. 55 and 56 show a gun-tube assembly having a gun tube 800, shape charges 820, and addressable switch 1, bow spring grounds 3000, sub-assemblies 1100, end caps 10, and a gun-tube extension 500.

Figure 57:
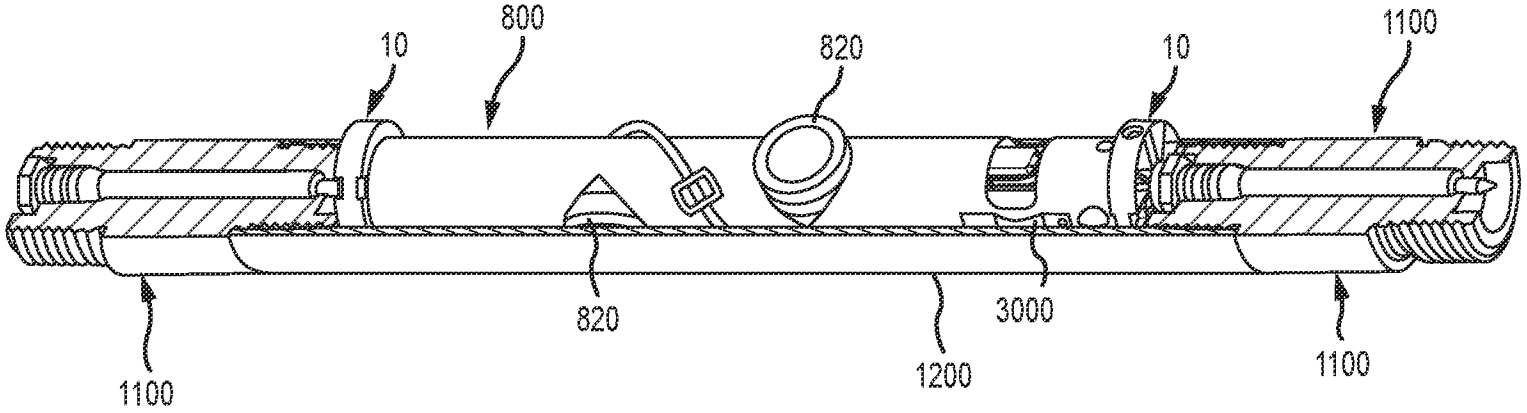
FIG. 57 is a perspective, partial cross-sectional, side view of an assembled gun tube with indexed end caps positioned in an outer casing and connected to sub-assemblies.
Figure 58:
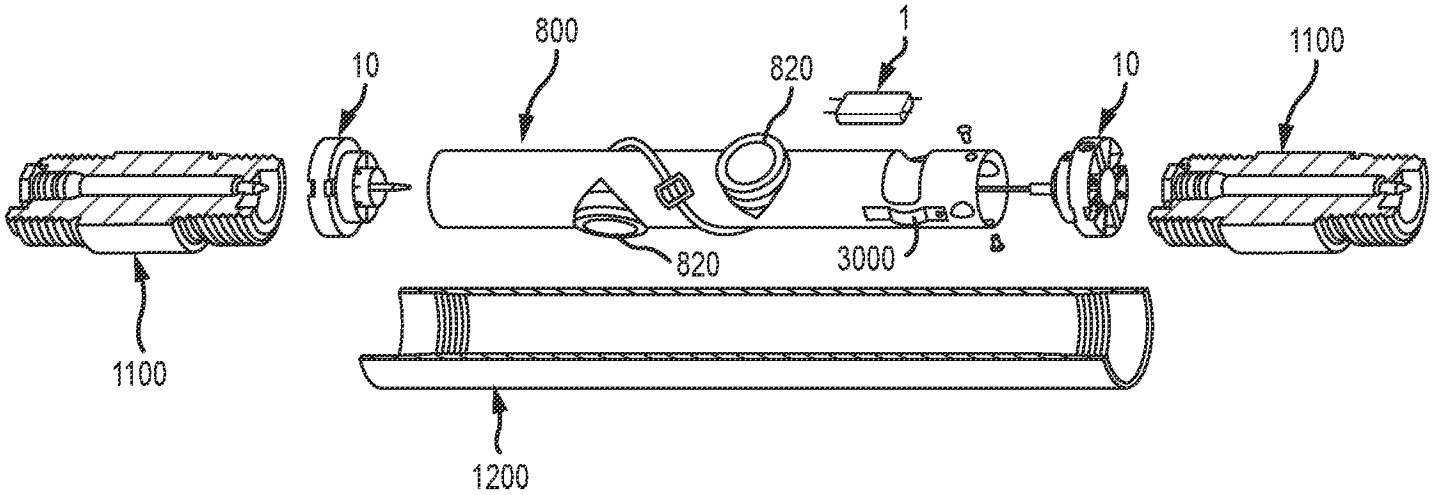
FIG. 58 is a partially exploded, partial cross-sectional, perspective, side view of the gun tube of FIG. 57.

FIGS. 57 and 58 show a gun-tube assembly having a gun tube 800, shape charges 820, and addressable switch 1, bow spring grounds 3000, sub-assemblies 1100, and end caps 10.

Figure 59:
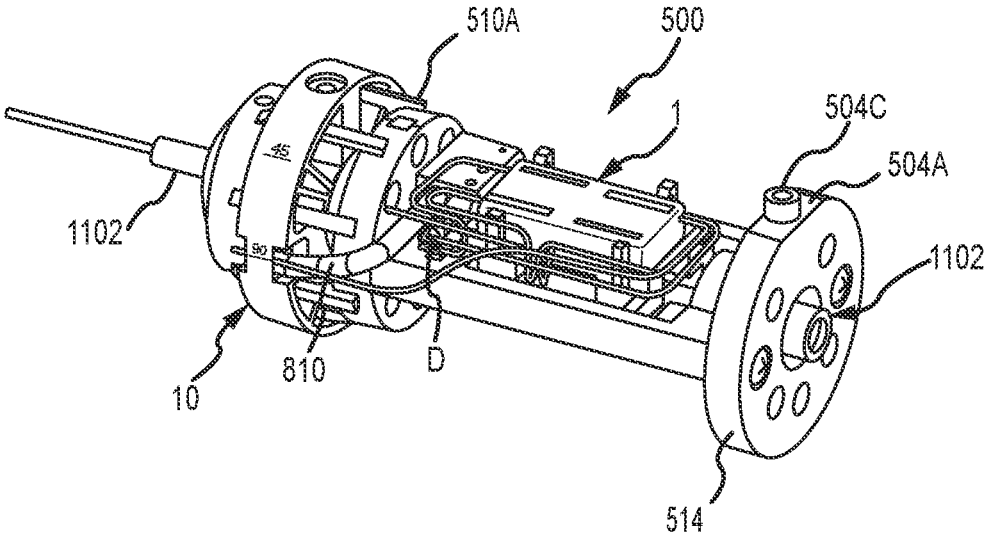
FIG. 59 is a perspective, side view of the gun-tube extension of FIG. 15 connected to an indexed end cap.
Figure 60:
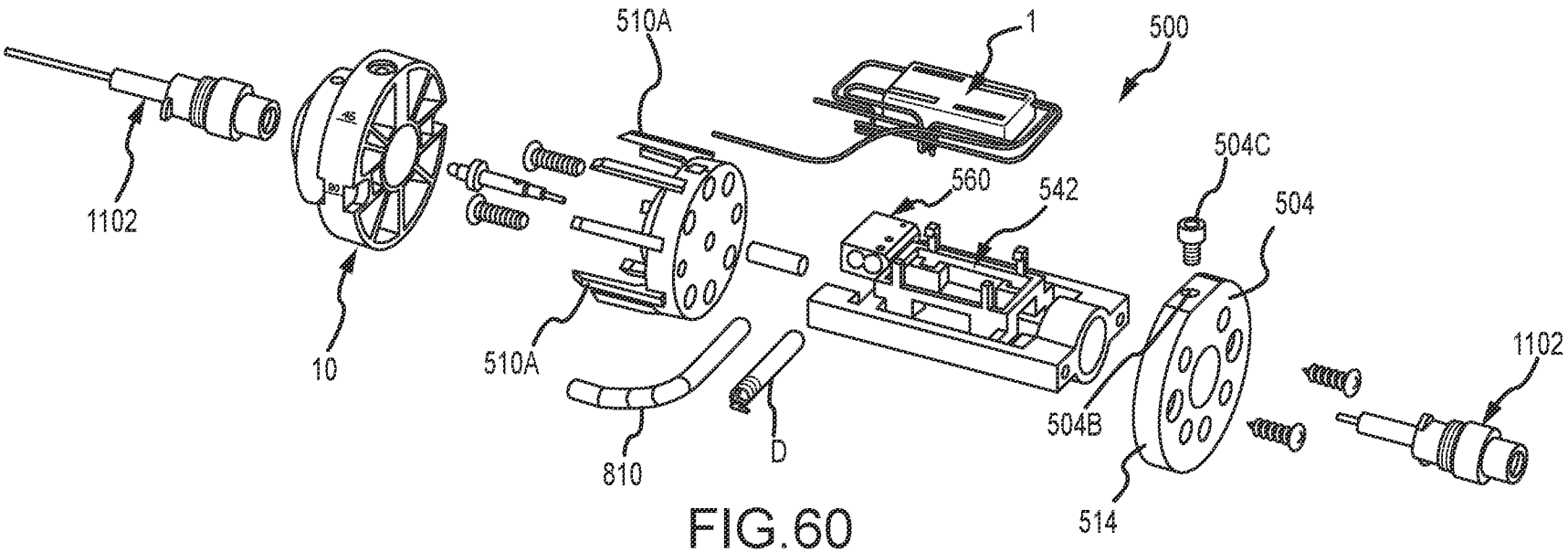
FIG. 60 is an exploded, side, perspective view of the gun-tube extension of FIG. 59.

FIGS. 59 and 60 show gun-tube extension 500, cap 10, and end fittings 1102.

Figure 61:
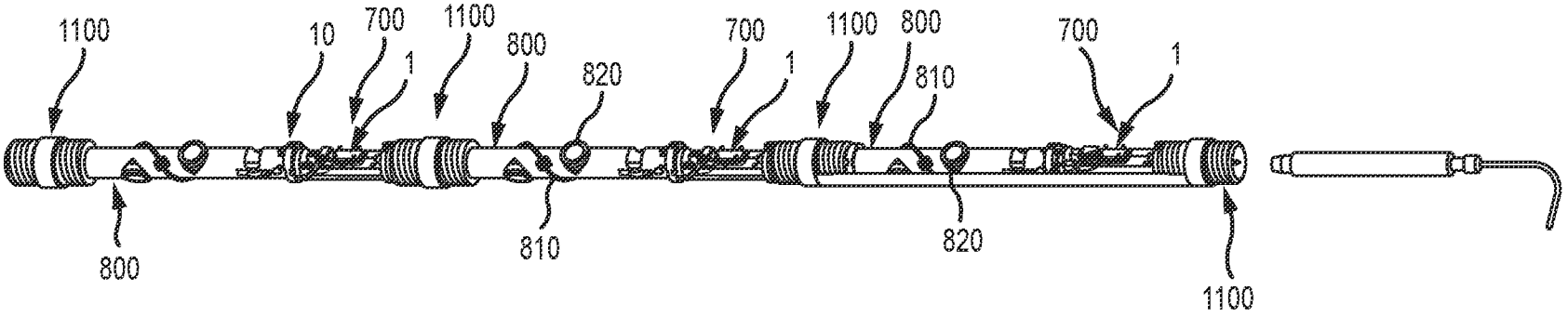
FIG. 61 is a partial, cross-sectional side view of a gun tube string according to this disclosure.
Figure 62:
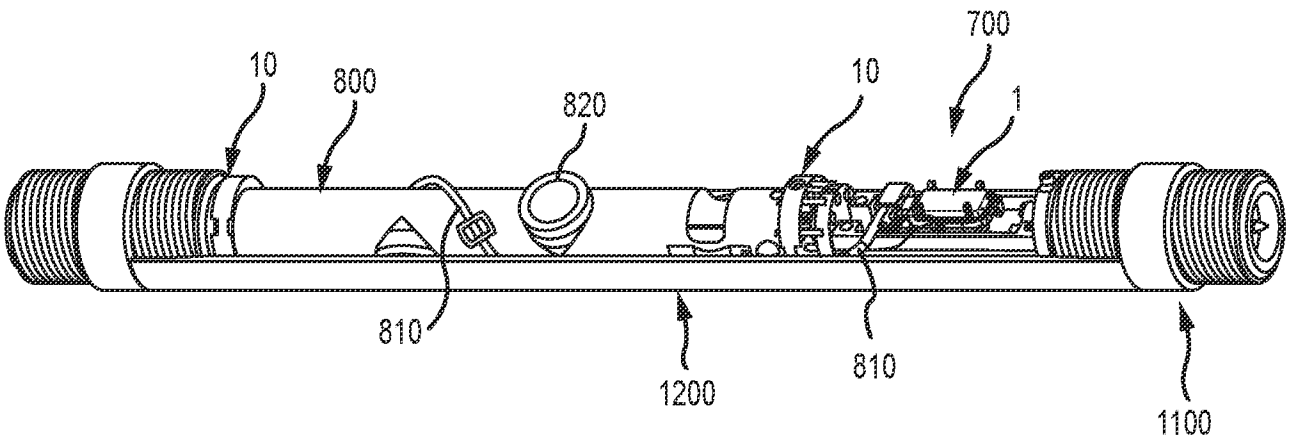
FIG. 62 is a partial cross-sectional, side, perspective view of a gun tube assembly according to this disclosure.

FIGS. 61 and 62 illustrate a gun-tube string that includes gun tubes 800, end caps 10, weighted gun-tube extensions 700, sub-assemblies 1100, and an outer casing 1200.

Figure 63:
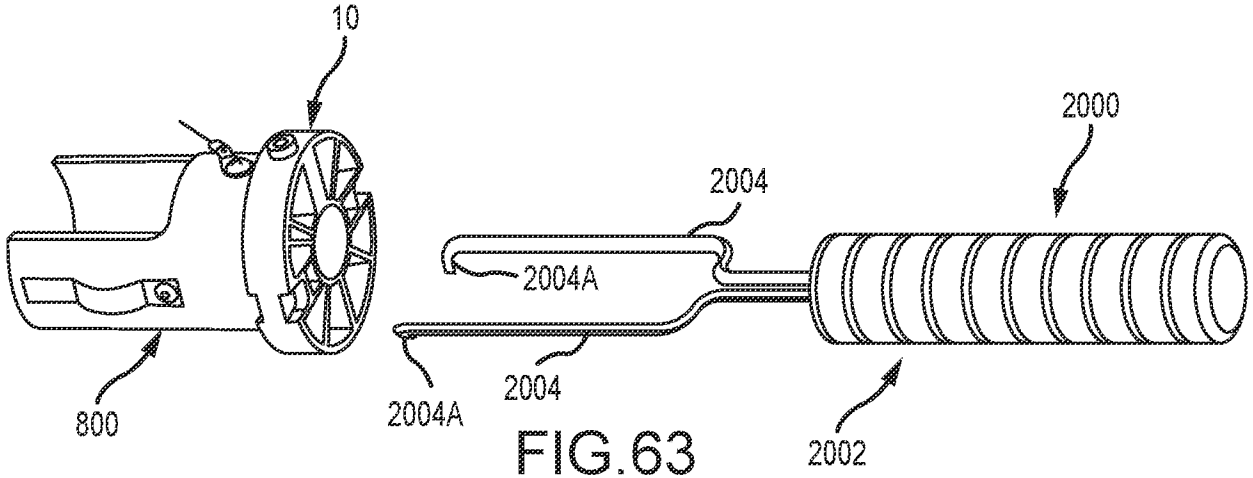
FIG. 63 is a side, perspective view showing an end cap and a tool that can be used to pull a gun tube from a casing.
Figure 65:
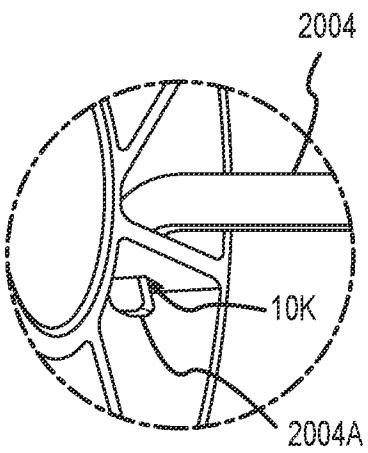
FIG. 65 is a partial, close-up view showing the slots in an end cap that the tool can engage.
Figure 64:
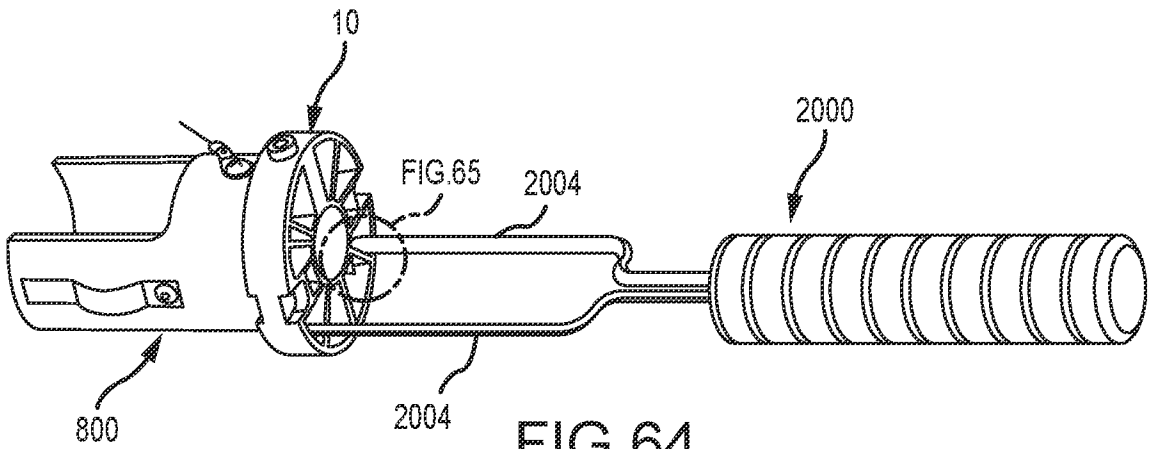
FIG. 64 is a side, perspective view of the structures of FIG. 63 connected.
Figure 66:
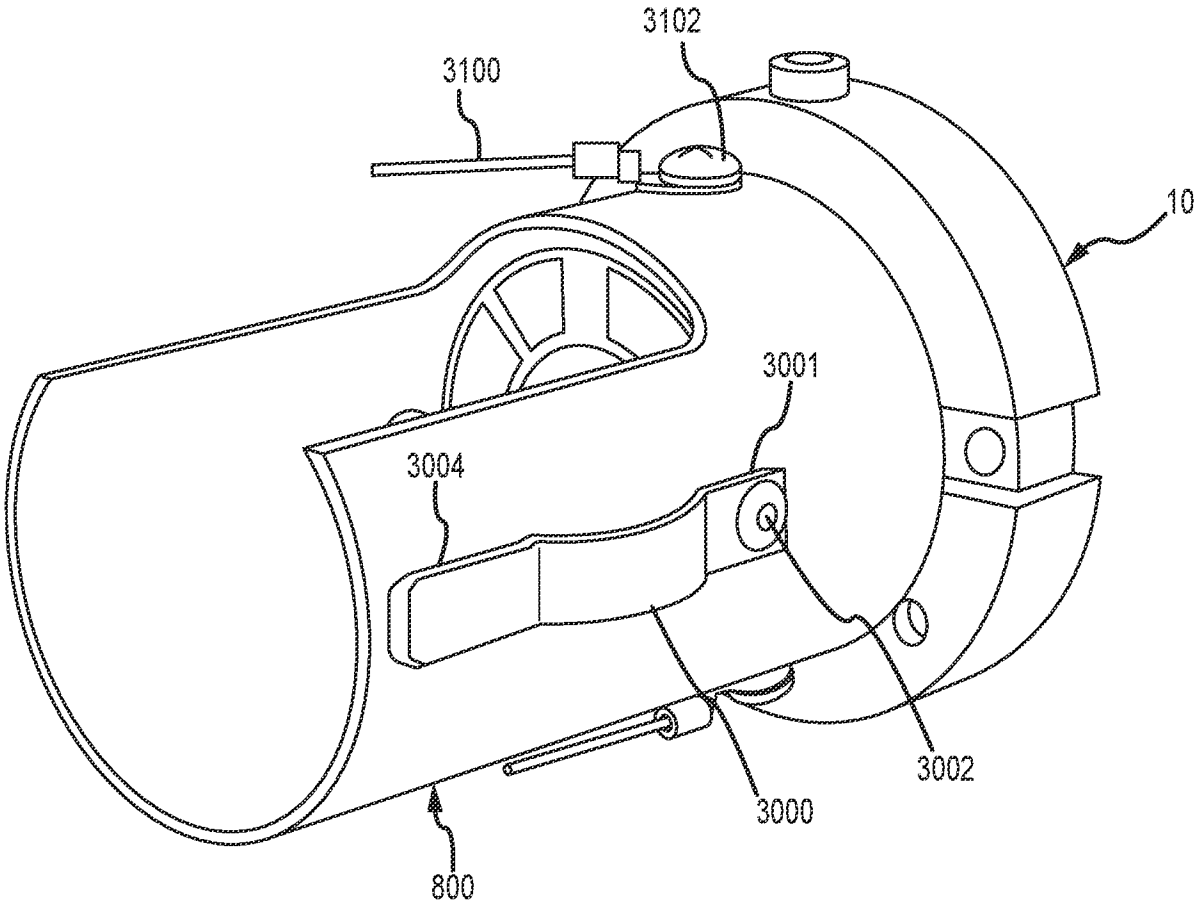
FIG. 66 is a side, perspective view of a bow-spring ground according to this disclosure mounted on a gun tube.

FIGS. 63-64 show a tool 2000 for use in extracting a gun tube once it has been positioned in a casing, such as previously-described casing 1200. The tool is designed to remove a gun tube after a gun-tube string has been removed from a wellbore. Slots 10K in the end caps, which may or may not be end caps 10 or 200, receive the curved or angled ends 2004A of forceps 2004. The slots 10K receive the ends 2004A of forceps 2004 and the user then pulls the gun tube out of the casing.

Bow Spring Grounds

Figure 67:
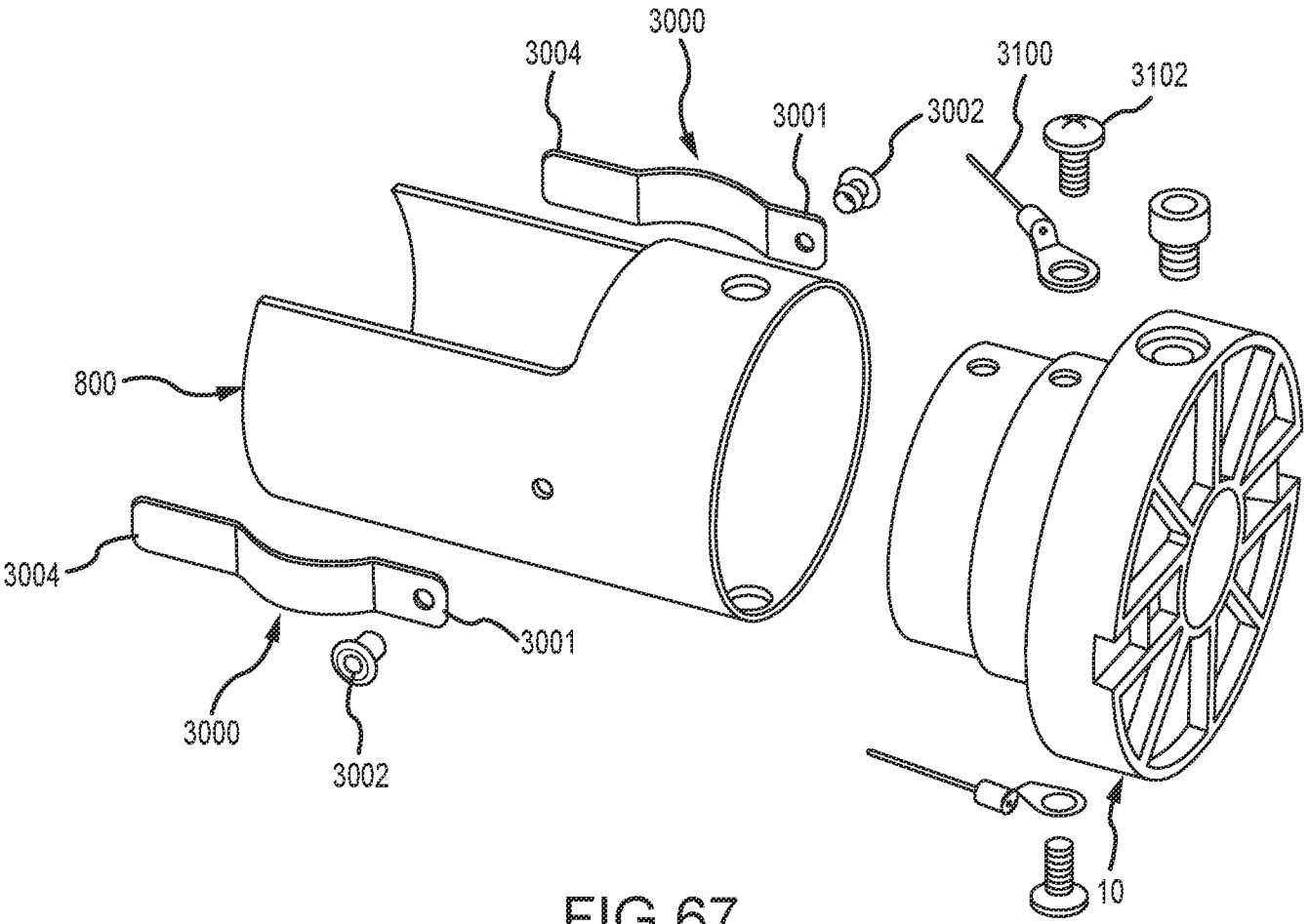
FIG. 67 is side, perspective, exploded view of the bow-spring ground of FIG. 66.
Figure 68:
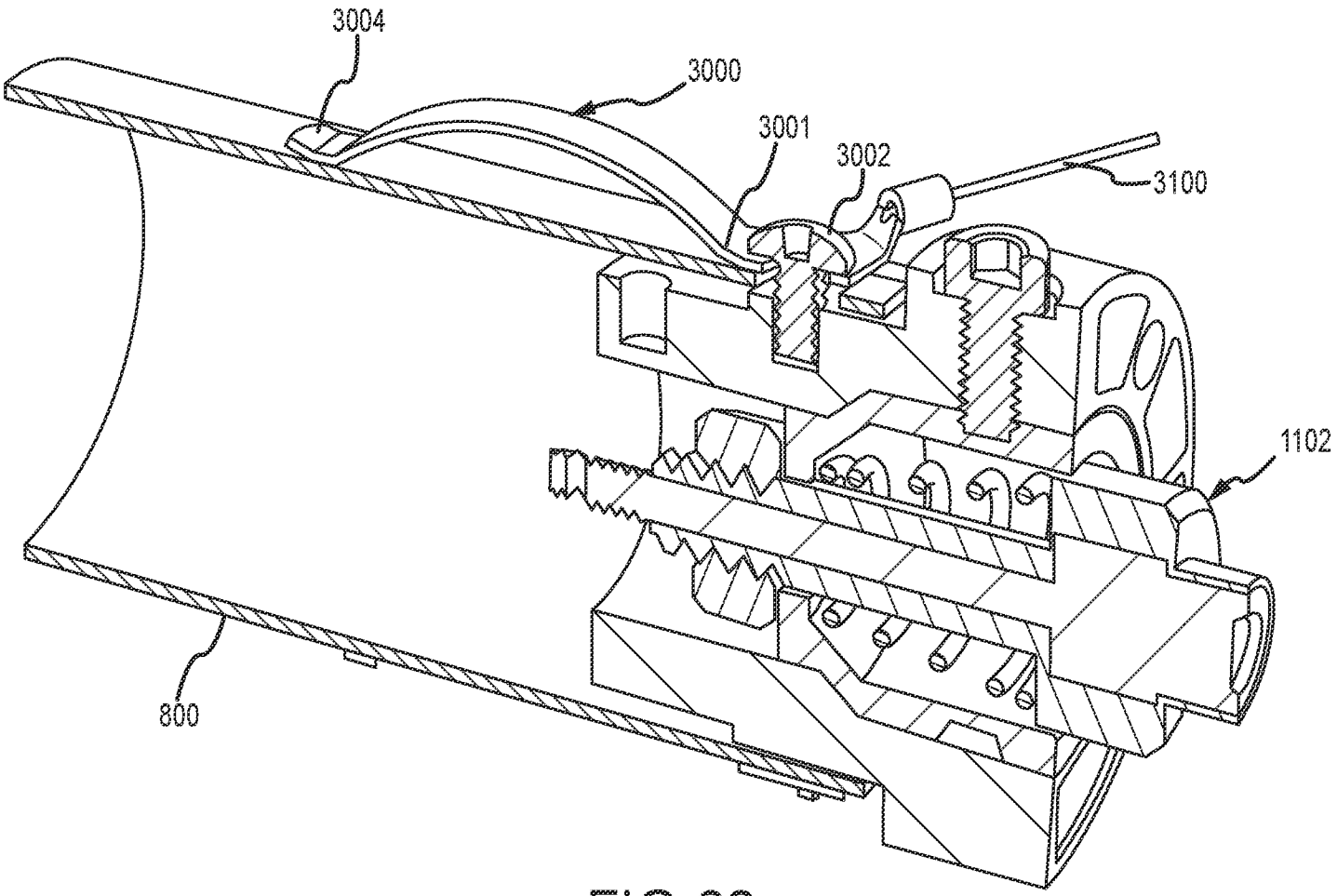
FIG. 68 is a side, perspective, cross-sectional view of a gun tube and end cap with a bow-spring ground.
Figure 69:
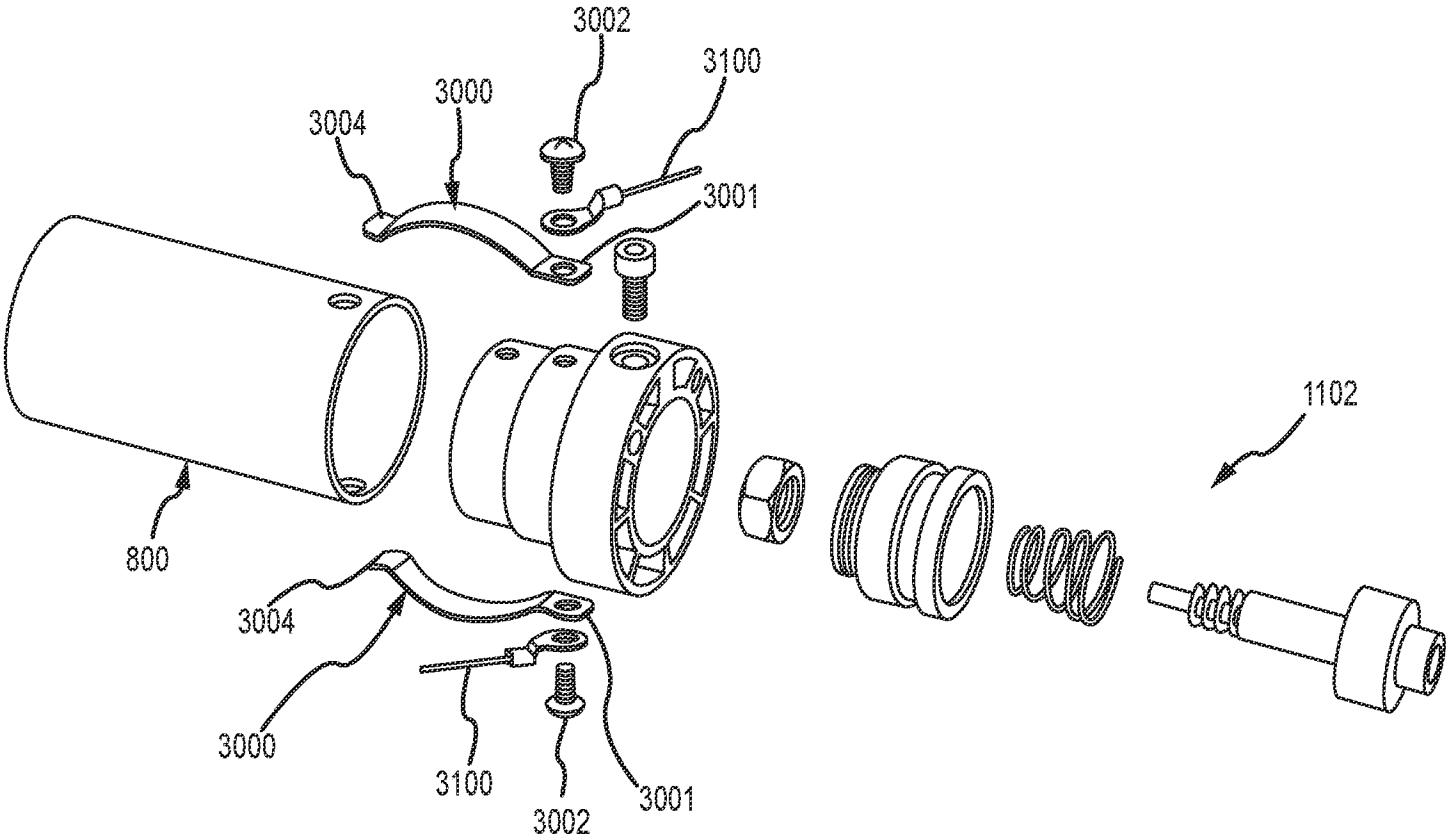
FIG. 69 is a partial, side, perspective, exploded view of the tube and end cap of FIG. 68.
Figure 70:
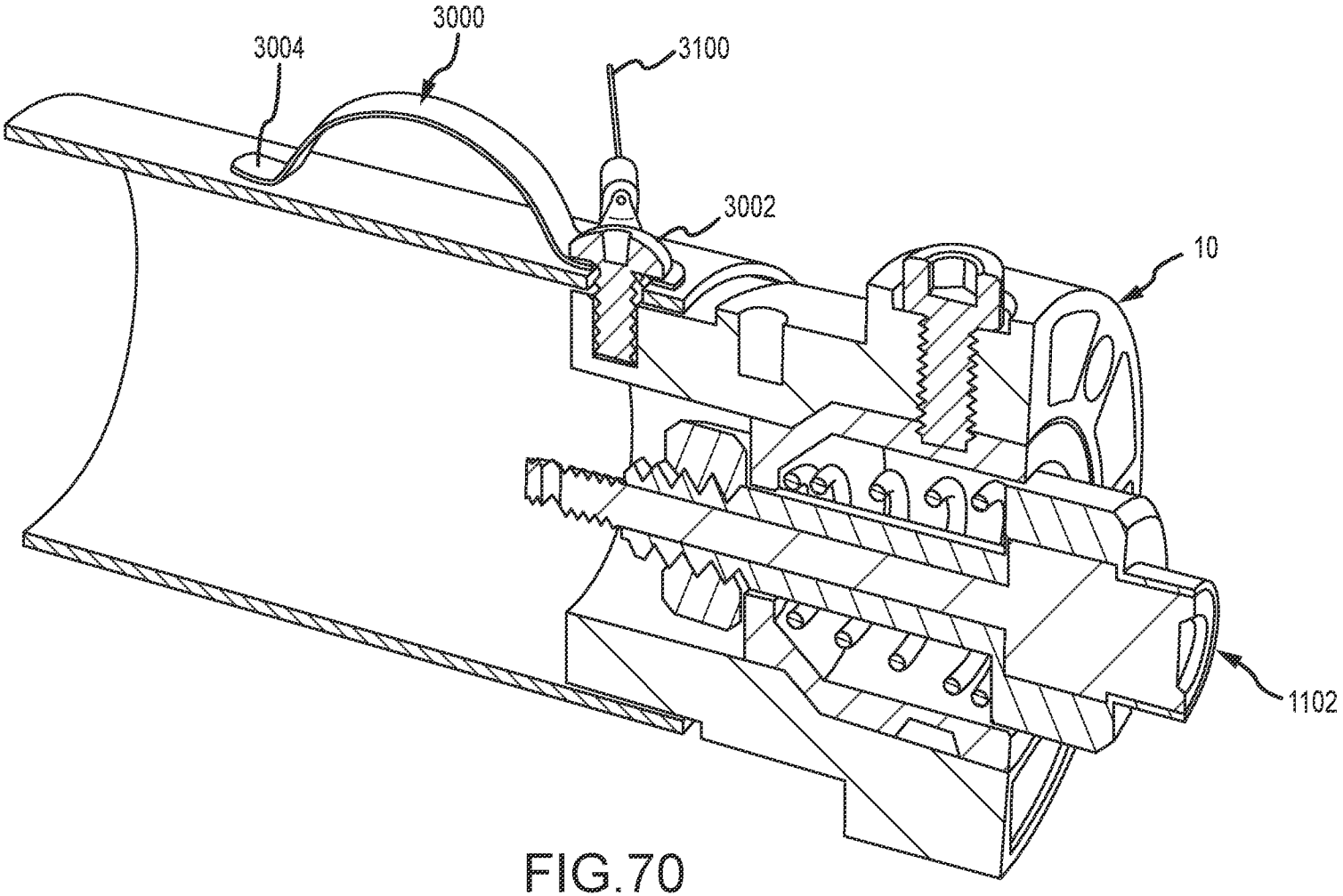
FIG. 70 is side, perspective, cross-sectional view of a tube and end cap with a bow-spring ground.

FIGS. 67-79 show various applications of a bow spring to ground a gun tube. FIGS. 67-68 show bow springs 3000 having a first end 3001 affixed to gun tube 800 by a fastener 3002. End 3004 presses against the outer surface of gun tube 800. The bow in spring 3000 contacts the inner surface of a casing (not shown) to create a ground. FIGS. 69-70 and 73-74 show bow spring 3000 with a first end connected by fastener 3002 to gun tube 800 and to an end cap. Ground wire 3100 is connected to the fastener and to bow spring 3000. End 3004 is pressed against the outer surface of gun tube 800.

Figure 71:
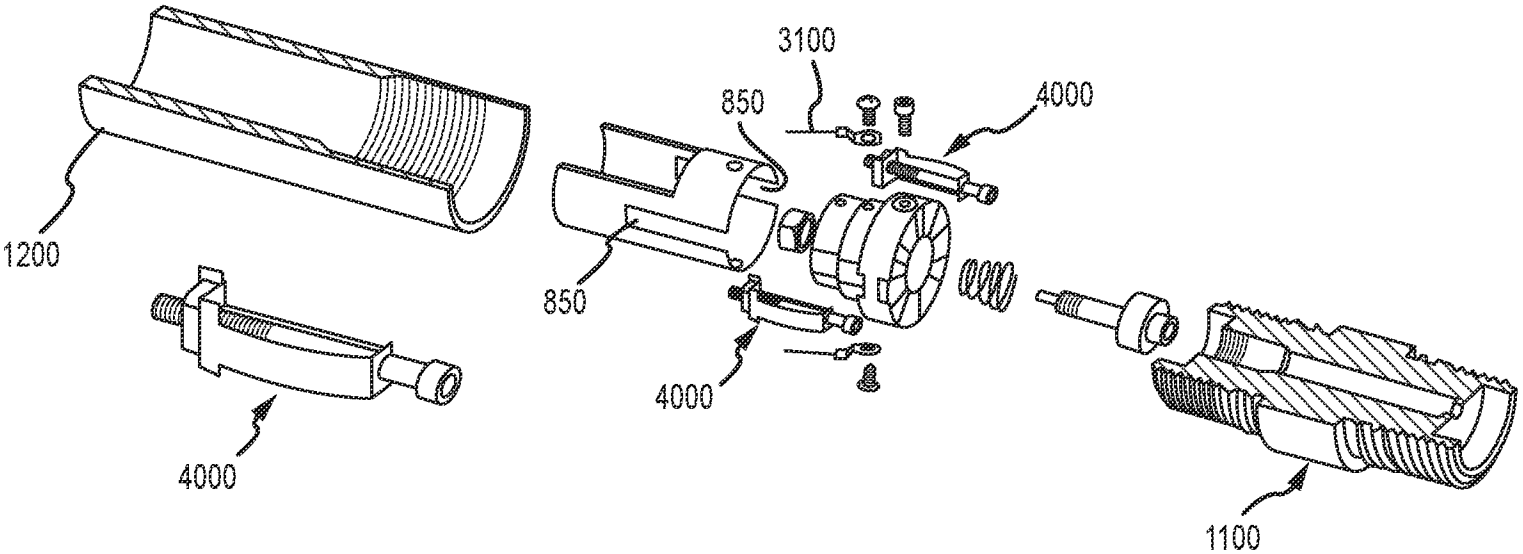
FIG. 71 is a side, perspective, partial cross-sectional, exploded view of a device utilizing a bow-spring ground.
Figure 72:
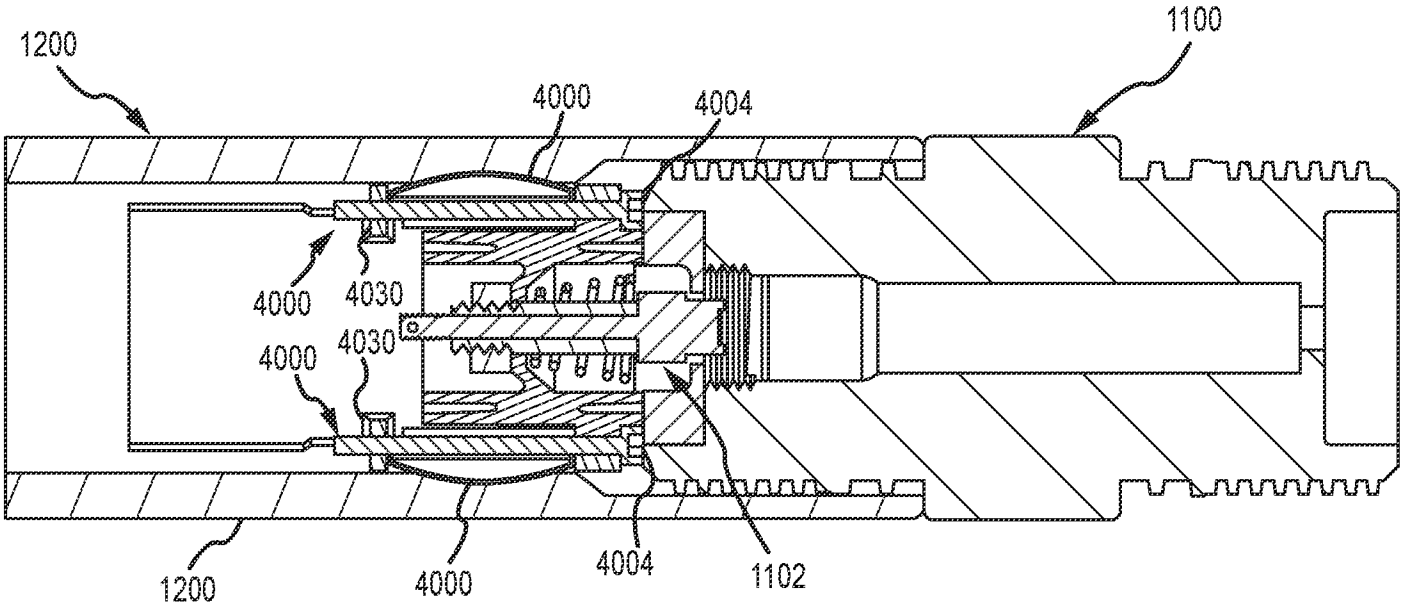
FIG. 72 is a side, partial cross-sectional, assembled view of the device of FIG. 71.

FIGS. 71-72 show a bow-spring grounding assembly 4000 positioned on a gun tube 800. One end 3001 of the bow spring is connected to the gun tube 800 by a fastener 3002. The other end 3004 rests against the outer surface of gun tube 800. The bow spring bows outward so that it contacts the inner surface of a casing (not shown) in which the gun tube 800 is positioned in order to ground the gun tube 800 and electrical components inside of it.

Figure 78:
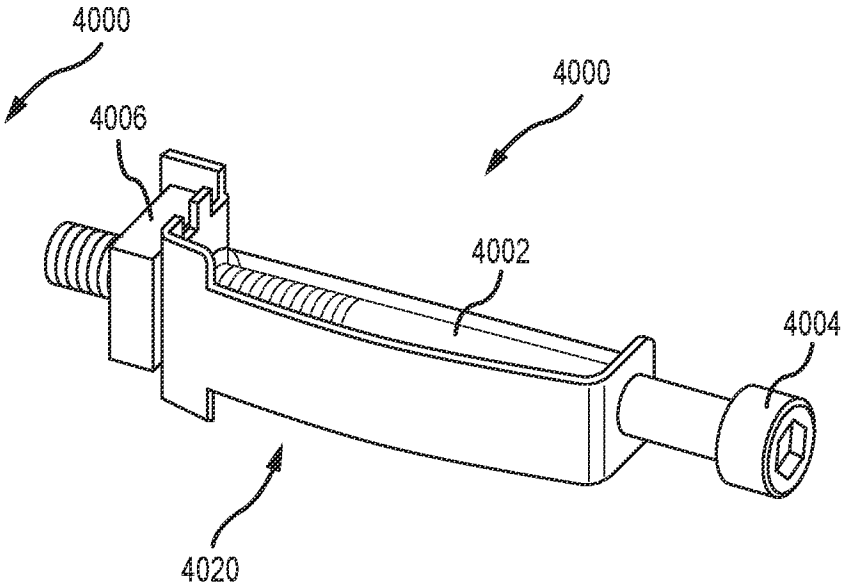
FIG. 78 is an alternate side view of the bow spring ground assembly of FIG. 75.
Figure 77:
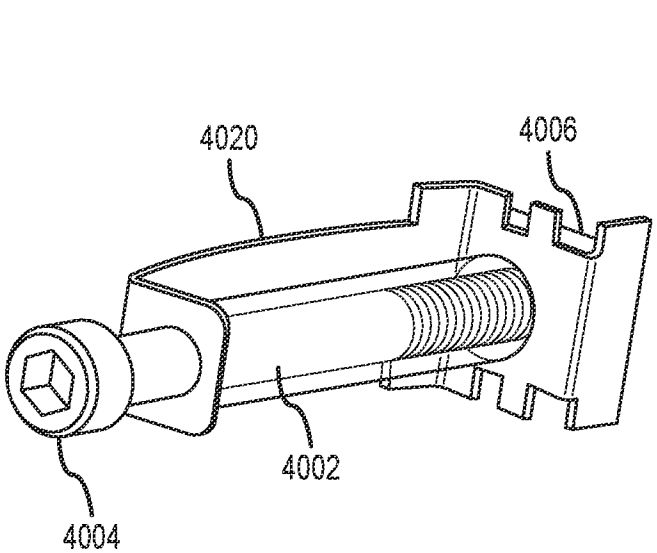
FIG. 77 is a rotated, side view of the bow-spring ground assembly of FIG. 75.

FIGS. 72, and 75-78 show bow spring grounding assembly 4000 that is preferably positioned in a retention slot on an end cap, such as end cap 10 or end cap 200. Bow spring grounding assembly 4000 basically comprises a fastener 4002, an optional tube 4010, a bow spring 4020, and a nut or other structure to receive an end of fastener 4002. Fastener 4002 has a driving end 4004 and a fastening end 4006, which in this embodiment is threaded. As shown in FIGS. 72, 77, and 78, fastener 4002 is passed through an opening in end 4022 of bow spring 4020, through another opening in end 4026, and is threaded into nut 4030. As the fastener 4002 is tightened the pressure forces the center of bow spring 4020 to bow outwards to contact a conductive surface and ground a device, such as gun tube 800, or an end cap 10 or 200, to which bow spring assembly 4000 is attached.

An advantage of such a design is that the gun tube with end caps that includes such a bow spring assembly must be positioned in a casing and the tolerances are very tight. If the bow spring is already in an extended position (i.e., bowed outwards) it may be difficult to slide the gun tube into the casing. With assembly 4000, the gun tube can first be positioned in the casing and then the fastener 4002 can be tightened to extend the bow spring 4020 to contact the inner wall of the casing.

FIG. 71 shows a bow spring assembly 4000 that fits into slots 850 of a gun tube 800 and into slots of an end cap. FIG. 72 shows an assembled version of the device of FIG. 72 inside of a casing 1100.

Figure 73:
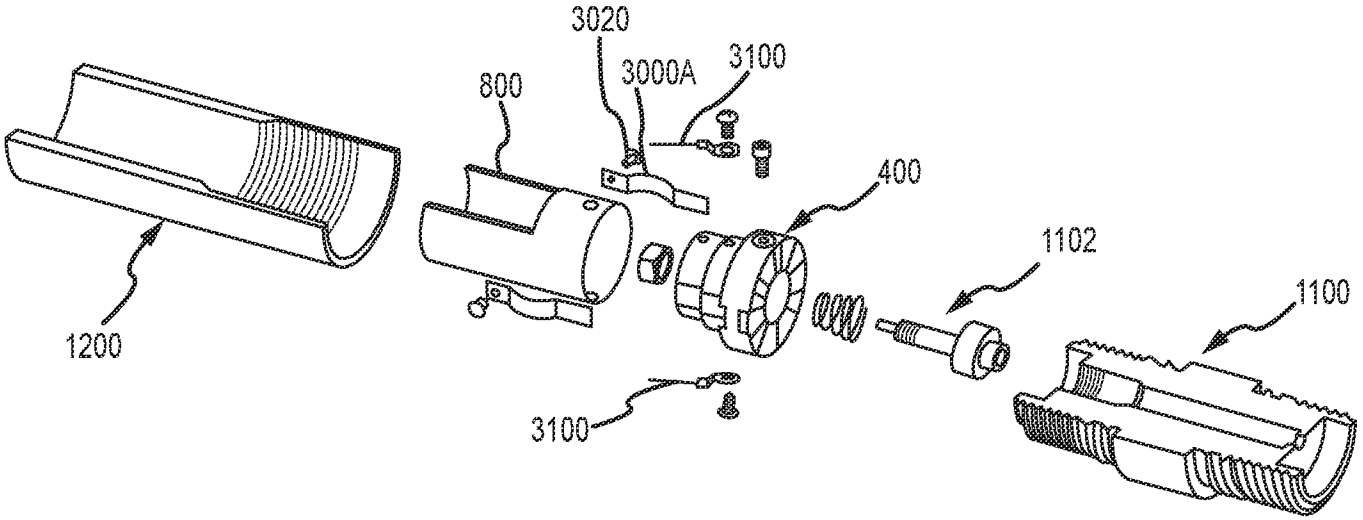
FIG. 73 is a side, perspective, partial cross sectional, exploded view of a device utilizing a bow-spring ground.
Figure 74:
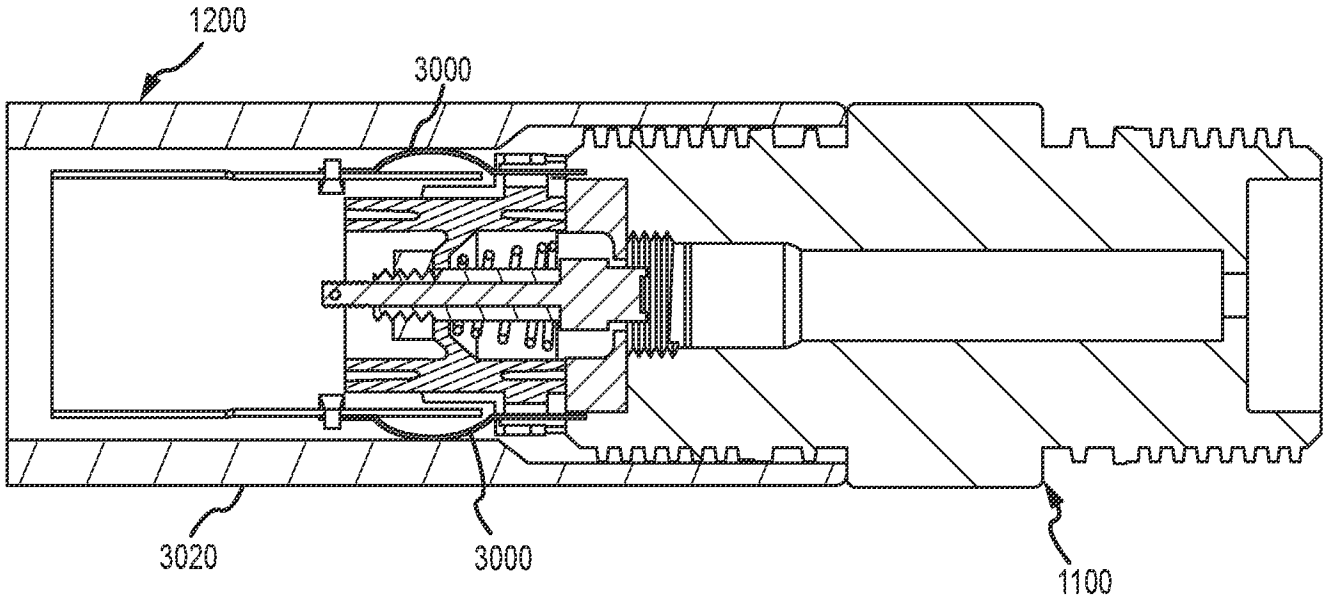
FIG. 74 is a side, partial cross-sectional, assembled view of the device of FIG. 73.
Figure 75:
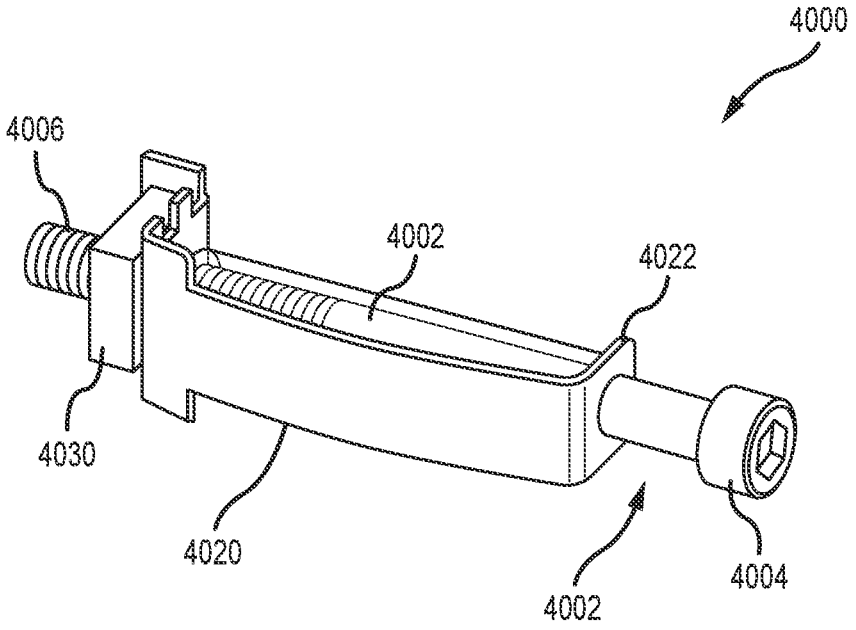
FIG. 75 is a perspective, side view of a bow-spring ground assembly according to this disclosure.
Figure 76:
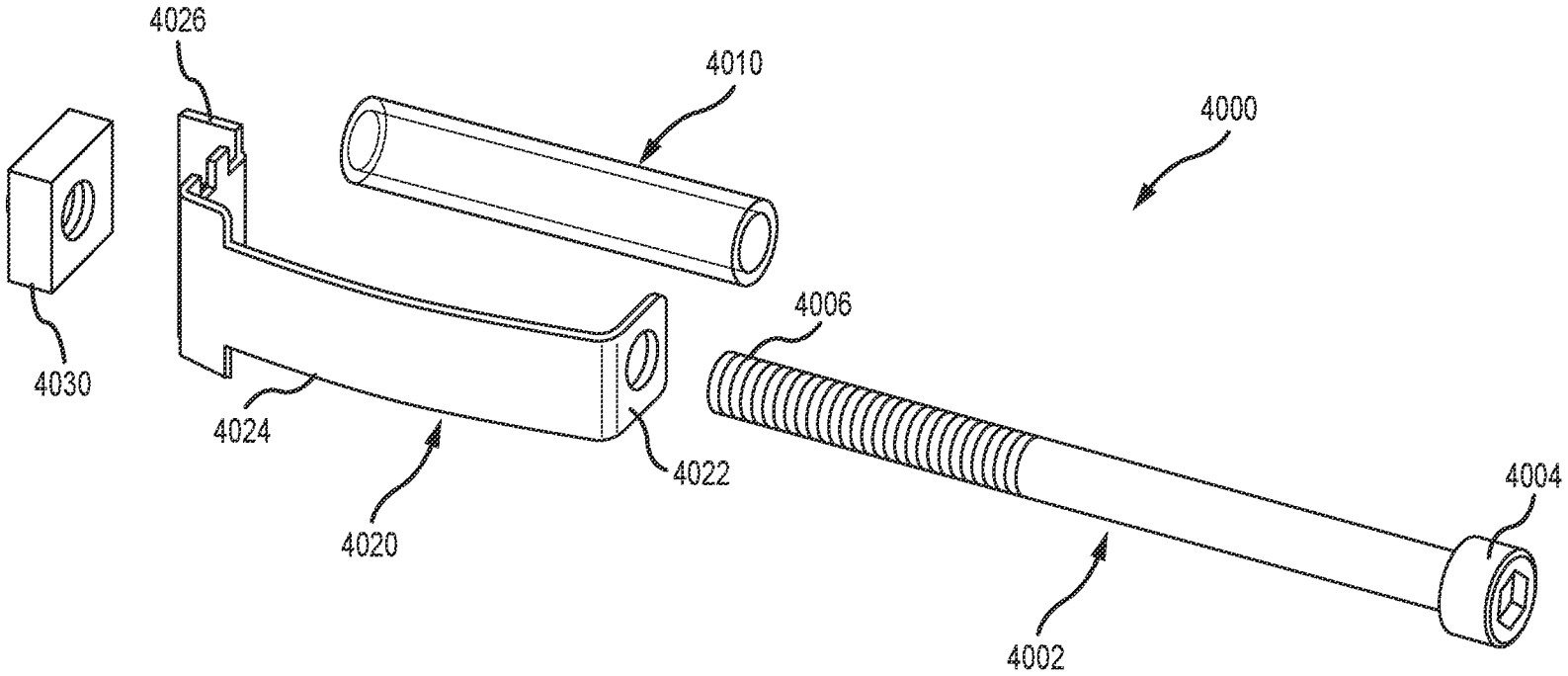
FIG. 76 is an exploded view of the bow-spring ground assembly of FIG. 75.

FIG. 73 shows bow springs 3000A that can be used with end cap 400. Bow spring 3000A has an end 311 with an opening and end 311 is attached to gun tube 800 by a fastener 3020. End 313 of bow spring 3000A is received in slot 450. As sub-assembly 1100 is tightened onto casing 1200, the sub-assembly presses on end 313 of bow spring 3000A to bow outwards.

Some non-limiting examples of this disclosure are as follows:

Example 1: A gun-tube extension comprising: a first end, a second end, and a body portion; wherein the first end is configured to be connected to a gun tube; and the second end is configured to be connected to a sub-assembly; and the body portion includes a support configured to retain a switch that is configured to detonate explosives positioned in that gun tube.

Example 2: The gun-tube extension of example 1, wherein the second end has an annular outer surface.

Example 3: The gun-tube extension according to any one of example 1 or example 2, wherein the second end is configured to be positioned at least partly inside of the sub-assembly.

Example 4: The gun-tube extension according to any one of examples 1-3, wherein the switch is an addressable switch.

Example 5: The gun-tube extension according to any one of examples 1-4, wherein the body portion comprises a frame that includes the support, wherein the frame is between the first end and the second end.

Example 6: The gun-tube extension of example 5, wherein the frame has (a) a first frame end that is connected to the first end, and (b) a second frame end that is connected to the second end.

Example 7: The gun-tube extension according to any one of examples 5 or 6, wherein the frame is configured to rotate around the first end.

Example 8: The gun-tube extension according to any one of examples 5-7, wherein the frame is configured to rotate around the second end.

Example 9: The gun-tube extension according to any one of examples 1-8 that further comprises one or more weights attached to the body portion.

Example 10: The gun-tube extension according to any one of examples 1-8 that further comprises one or more weights.

Example 11: The gun-tube extension according to any one of examples 9-10, wherein the one or more weights are configured to rotate the gun-tube extension around a longitudinal axis based on gravity acting on the one or more weights.

Example 12: The gun-tube extension according to any one of examples 9-11, wherein the one or more weights comprises two separate weights: a first weight and a second weight.

Example 13: The gun-tube extension of example 12, wherein the first weight is juxtaposed a first end of the body and the second weight is juxtaposed a second end of the body.

Example 14: The gun-tube extension according to any one of examples 9-13, wherein each of the one or more weights has a semi-cylindrical shape.

Example 15: The gun-tube extension according to any one of examples 12-14, wherein the first weight weighs ⅞ lbs. at sea level and the second weight weighs 1¾ lbs. at sea level.

Example 16: The gun-tube extension according to any one of examples 12-15, wherein the second weight is at least twice as heavy as the first weight.

Example 17: The gun-tube extension according to any one of examples 9-16, wherein the one or more weights collectively weigh from 2 lbs. to 8 lbs. at sea level.

Example 18: The gun-tube extension according to any one of examples 9-17, wherein each of the one or more weights are comprised of steel.

Example 19: The gun-tube extension according to any one of examples 9-18, wherein the one or more weights is collectively one of the following percentages of the weight of the gun-tube extension without the weight: up to 20%, up to 30%, up to 40%, and up to 50%, up to 60%, up to 70%, up to 80%, up to 90%, up to 100%, up to 200%, up to 300%, up to 400%, up to 500%, or from 300% to 1000%.

Example 20: The gun-tube extension according to any one of examples 12-17, wherein the first weight is 2"-3" in length and the second weight is 3"-8" in length.

Example 21: The gun-tube extension according to any one of examples 1-20 that further comprises an outer surface that includes grounding hardware, wherein the grounding hardware has a first, expanded position and a second, contracted position.

Example 22: The gun-tube extension according to any one of examples 1-21, wherein the first end is connected to a first end cap that comprises an end contact having a first end that comprises a stem, the stem being spring loaded.

Example 23: The gun-tube extension according to any one of examples 1-22 that further includes a switch and a detonator in the body portion, wherein the detonator is in electrical communication with the switch.

Example 24: The gun-tube extension of example 23 that further includes a primer cord that extends from the body portion into a gun tube that includes explosives, wherein the primer cord transmits a signal from the switch to explosives in the gun tube in order to activate the explosives.

Example 25: The gun-tube extension according to any one of examples 1-24 that further includes a primer cord that extends from the body portion into a gun tube and that transmits a signal from the switch to explosives in the gun tube in order to activate the explosives in the gun tube.

Example 26: The gun-tube extension of example 25 that further includes a slot in the body portion, wherein the slot is configured to retain the primer cord.

Example 27: The gun-tube extension according to any one of examples 1-26, wherein the first end comprises a plurality of outwardly-extending fingers.

Example 28: The gun-tube extension of example 27, wherein a first end cap is attached to a gun tube, and the first end cap has a plurality of openings, and wherein each of the plurality of openings is configured to receive one of the plurality of outwardly-extending fingers of the gun-tube extension.

Example 29: The gun-tube extension according to any one of examples 1-28, wherein the second end has an annular outer surface with a flat portion.

Example 30: The gun-tube extension according to any of examples 1-29, wherein the first end of the gun-tube extension is connected to an end cap of a gun tube.

Example 31: The gun-tube extension of example 30, wherein the second end of the gun-tube extension is connected to a sub-assembly.

Example 32: The gun-tube extension according to any one of examples 1-31 that is directly or indirectly connected to a motor configured to rotationally move the gun-tube extension.

Example 33: The gun-tube extension of example 32, wherein the motor has a horse power from 5 and 50.

Example 34: The gun-tube extension according to any of examples 1-33 that further includes a position-orientation device configured to determine the orientation of the gun-tube extension in a wellbore.

Example 35: The gun-tube extension of example 34, wherein the orientation device is an accelerometer.

Example 36: The gun-tube extension according to any one of examples 34 or 35, wherein the orientation device is part of an addressable switch.

Example 37: The gun-tube extension according to any one of examples 34-36, wherein the orientation device is on the frame of the body portion of the gun-tube extension.

Example 38: The gun-tube extension according to any one of examples 1-37 that further includes a thermocouple.

Example 39: The gun-tube extension according to any one of examples 1-38 that further includes a first thermocouple, and an addressable switch, wherein the first thermocouple is in the addressable switch.

Example 40: The gun-tube extension of example 39 that further includes a second thermocouple on the body portion, wherein the second thermocouple is in communication with the addressable switch.

Example 41: The gun-tube extension according to any one of examples 9-40, wherein the body portion further comprises a plurality of tabs for retaining the one or more weights.

Example 42: The gun-tube extension according to any of examples 9-40 that further includes openings on the body portion to receive fasteners, and each of the one or more weights has one or more openings through which the fasteners can pass, and the fasteners are passed through the openings in the one or more weights and are received in the openings in the body portion.

Example 43: The gun-tube extension according to example 41, wherein the tabs have a first, open position, and a second, closed position in which the tabs retain the one or more weights in the inner cavity.

Example 44: The gun-tube extension according to any one of examples 1-43 that further includes an outer casing positioned over and around part of the body portion, the outer casing having a first end and a second end.

Example 45: The gun-tube extension of example 44 that further comprises a first sub-assembly connected to a first end of the outer casing.

Example 46: The gun-tube extension of example 45, wherein the first sub-assembly is threadingly connected to the outer casing.

Example 47: The gun-tube extension of example 46, wherein the first sub-assembly is threadingly connected to the first end of the outer casing and a second sub-assembly is threadingly connected to a second end of the outer casing.

Example 48: The gun-tube extension according to any one of examples 45-47 that further comprises a plunger in the first sub-assembly.

Example 49: The gun-tube extension of example 48, wherein the plunger has a longitudinal axis and an electrical connection running through it.

Example 50: The gun-tube extension according to any one of examples 1-49, wherein an expandable bow spring is positioned at least partially on an outer surface of the gun-tube extension, the expandable bow spring configured to provide an electrical ground by contacting an inner wall of a casing surrounding a gun tube.

Example 51: The gun-tube extension of example 50, wherein the bow spring is expandable to about ⅜" outwards from its relaxed position.

Example 52: The gun-tube extension of example 51, wherein the bow spring is connected to a buttress that can be compressed to expand the bow spring and opened to relax the bow spring.

Example 53: The gun-tube extension according to any one of examples 1-52, wherein the gun-tube extension has an outer surface that includes one or more slots, and each slot includes an expandable bow spring to create a ground when the gun-tube extension is positioned inside of an outer casing or inside of a sub-assembly.

Example 54: The gun-tube extension according to any one of examples 50-53, wherein the expandable bow spring has a first, outwardly-biased position and a second, contracted position.

Example 55: The gun-tube extension of example 54, wherein the expandable bow spring can expand outward by up to ⅜".

Example 56: The gun-tube extension according to any of examples 1-55, wherein the second and is attached to an end cap that is rotatable to a plurality of indexed positions.

Example 57: The gun-tube extension of example 56, wherein the first end cap includes a plurality of indexed positions.

Example 58: The gun-tube extension according to any one of examples 1-57, wherein the gun-tube extension is not electrically conductive.

Example 59: The gun-tube extension according to any one of examples 1-58 that further includes a detonator in the body portion.

Example 60: The gun-tube extension according to any one of examples 1-59 that further includes a primer cord in the body portion.

Example 61: The gun-tube extension according to any one of examples 59 or 60, wherein the switch is in electrical communication with the detonator.

Example 62: The gun-tube extension according to any of examples 1-61, wherein the second end includes an outwardly-extending projection that is configured to align with a groove inside of a sub-assembly.

Example 63: The gun-tube extension of example 62, wherein the second end has an annular outer surface with a flat portion of the outer surface including a bore into which a fastener is received, and the fastener head remains outside of the bore to form the outwardly-extending projection.

Example 64: The gun-tube extension according to any one of examples 62 or 63, wherein the second end further comprises a flat portion on the outer surface and the outwardly extending projection is positioned at the flat portion.

Some further non-limiting examples of this disclosure are as follows:

Example 1: A gun tube comprising:

a body having a cavity, a longitudinal axis, a first end, and a second end;

a motor connected to the first end, the motor configured to rotate the body around the longitudinal axis.

Example 2: The gun tube of example 1 that further comprises a first end fitting attached to the first end of the body.

Example 3: The gun tube of example 2 that further comprises a second end fitting attached to the second end of the body.

Example 4: The gun tube according to any one of examples 1-3 that further comprises a sensor configured to detect the location of the explosive charges.

Example 5: The gun tube of example 3, wherein the sensor comprises an accelerometer.

Example 6: The gun tube of example 3, wherein the sensor comprises one or more of an accelerometer, a magnetometer, and gyroscope.

Example 7: A system comprising the gun tube of example 6 and a motor control remote to the gun tube, the motor control configured to operate the motor.

Example 8: The system of example 7, wherein the motor control is a computer.

Example 9: The system of example 7 that further includes a receiver for receiving transmissions sent by the sensor.

Example 10: The system of a claim 7, wherein the motor control is configured to be operated by a human operator.

Example 11: The system of a claim 7, wherein the motor control is configured to be operated by a machine operator.

Example 12: The gun tube of example 1, wherein the at least first end fitting comprises:

an outer collar;

a bearing housing that includes ball bearings and a central opening; and a support having a first portion with a first diameter and a second portion with a second diameter that is greater than the first diameter, wherein the bearing housing is positioned on the first portion and the central opening surrounds at least part of the first portion, and the outer collar is fastened to the support.

Example 13: The gun tube according to any one of examples 1-6 or 12 that further comprises one or more charge openings configured to receive an explosive charge.

Example 14: The gun tube of example 13 that further comprises one or more explosive charges in the one or more charge openings.

Example 15: The gun tube according to any one of examples 1-6 or 12-14 that further comprises one or more clip openings configured to receive charge clips.

Example 16: The gun tube of example 15 that comprises one or more clips in the one or more clip openings.

Example 17: The gun tube of example 2, wherein the first end fitting includes a first end contact having a first, extended position and a second, contracted position, and that also comprises a second end fitting having a second end contact including a first, extended position and a second, extended position.

Example 18: The gun tube according to any one of examples 12-16, wherein the outer collar has one or more openings, wherein at least one of the one or more openings contains grounding hardware biased to a first, extended position, and that also has a second, contracted position.

Example 19: The gun tube according to any one of example 2 or 17, wherein the first end fitting comprises an end contact having a first end that comprises a stem, the stem being positioned inside of the cavity, and the end contact having a second end, the second end comprising an electrical contact that is positioned outside of the body.

Example 20: The gun tube of example 19, wherein the end contact is configured to transmit electricity therethrough.

Example 21: The gun tube of example 2, wherein the first end fitting comprises a first end contact that includes a housing and one or more frangible elements extending outwardly from the housing.

Example 22: The gun tube of example 21 that further comprises a second end fitting that includes a second end contact having a housing and one or more frangible elements extending outwardly from the housing.

Example 23: The gun tube of according to any one of examples 21 or 22, wherein the housing and frangible elements are comprised of plastic and the frangible elements are configured to break away from the housing upon the application of explosive, outward axial force caused by explosion of one or more explosive charges in the gun tube.

Example 24: The gun tube of example 17, wherein the first end contact is biased towards the first, extended position.

Example 25: The gun tube of example 24, wherein the second end contact is biased towards the first, extended position.

Example 26: The gun tube of example 24 that further includes a spring on a housing of the first end contact, the spring configured to bias the first end contact to the first, extended position, and the spring configured to compress when the first end contact moves to its second, contracted position.

Example 27: The gun tube of example 26 that further includes a spring on a housing of the second end contact, the spring configured to bias the first end contact to the first, extended position, and the spring configured to compress when the first end contact moves to its second, contracted position.

Example 28: The gun tube of example 17, wherein the distance between the first, extended position and the second, contracted position of the first end contact is between 0.150" and 1.250".

Example 29: The gun tube of example 28, wherein the distance between the first, extended position and the second, contracted position of the second end contact is between 0.150" and 1.250".

Example 30: The gun tube or system of any of examples 1-29, wherein the sensor is one an addressable switch.

Example 31: The gun tube system of any examples 1-30 that further comprises a gun-tube extension according to any of previous examples 1-80.

Some further non-limiting examples of this disclosure are as follows:

Example 1: An end fitting comprising:

(a) a first end and a second end;

(b) a bearing housing that includes ball bearings, the bearing housing having a bearing opening;

(c) a support having a first portion with a first diameter and a second portion with a second diameter that is greater than the first diameter, wherein the bearing housing is positioned on the first portion with the bearing opening surrounding at least part of the first portion; and (d) an end contact comprising a housing, a first end having a conductive stem, and a second end that comprises an electrical contact, the second end having a first, extended position and a second, contracted position.

Example 2: The end fitting of example 1, wherein the end contact is biased to the first, extended position.

Example 3: The end fitting according to any one of examples 1 or 2, wherein electricity can be conducted through the end contact.

Example 4: The end fitting according to any one of examples 1-3, wherein the end contact further comprises a housing and one or more frangible elements extending outwardly from the housing.

Example 5: The end fitting of example 4, wherein the housing and the one or more frangible elements are comprised of plastic.

Example 6. The end fitting of example 4, wherein the one or more frangible elements are a plurality of tabs.

Example 7: The end fitting of example 6, wherein the one or more frangible elements are two tabs.

Example 8: The end fitting of example 6, wherein each of the plurality of tabs extend outward from the body by 0.070" to 0.125".

Example 9: The end fitting of example 6, wherein each of the plurality of tabs is from 0.010" to 0.080" thick.

Example 10: The end fitting of example 8, wherein each of the plurality of tabs is from 0.010" to 0.080" thick.

Example 11: The end fitting according to any one of examples 2-10 that further includes a spring on the end contact.

Example 12: The end fitting of example 11, wherein the spring is on a first portion of the end contact.

Example 13: The end fitting of example 12, wherein the support further includes one or more frangible elements and the spring is retained between a central portion of the end contact and the one or more frangible elements.

Example 14: The end fitting of example 6, wherein the support has an opening that receives an end of the end contact housing that includes the plurality of tabs, and wherein the end contact has a first position in which the tabs fit through the opening and a second position in which they do not fit through the opening.

Example 15: The end fitting of example 4, wherein the one or more frangible elements break when 30 lbs. or more of explosive, outward, longitudinal, axial force is applied to them.

Example 16: The end fitting of example 4, wherein the one or more frangible elements break when 50 lbs. or more of explosive, outward, axial force is applied to them.

Example 17: The end fitting according to any one of examples 1-16, wherein the conductive stem includes a through hole, wherein the through hole is configured to receive one or more wires.

Example 18: The end fitting according to any one of examples 1-17 that further includes a wire harness assembly attached to the conductive stem, the wire harness assembly comprising an insulated wire and an insulated circular connector.

Example 19: The end fitting of example 18, wherein the insulated circular connector is a barrel crimp connector.

Example 20: An end fitting for a gun tube that comprises an end contact with a first end that includes an electrical contact having a first extended position and a second, contracted position.

Example 21: The end fitting of example 20, wherein the end contact further includes one or more frangible elements configured to break when 30 lbs. or more of explosive, outward longitudinal, axial, force is applied.

Example 22: The end fitting of example 21, wherein the one or more frangible elements are a plurality of tabs.

Example 23: The end fitting of example 22, wherein the one or more frangible elements are two tabs.

Example 24: The end fitting according to any one of examples 1-23 that further comprises an outer collar having an opening therethrough.

Example 25: The end fitting of example 24, wherein the electrical contact is positioned from 1/16" to 5/16" outside of the opening when the second end of the end contact is in its first, extended position.

Example 26: The end fitting according to any one of examples 4-25, wherein the housing and one or more frangible elements are integrally formed.

Example 27: An end cap configured for use in a downhole gun tube having an inner cavity with a diameter, the end cap having a stepped cylindrical body with a first length having a first diameter, a second length having a second diameter, and a third length having a third diameter, wherein the first diameter is less than the second diameter, the second diameter is less than the third diameter, and the third diameter is greater than the diameter of the inner cavity.

Example 28: The end cap according to any of examples 1-27 that connected to any one of the gun-tube extensions of previous examples 1-80.

Some further non-limiting examples of this disclosure are as follows:

Example 1: A gun tube comprising:

(a) a body having a cavity, a longitudinal axis, a first end, and a second end;

(b) a motor connected to the first end, the motor configured to rotate the body around the longitudinal axis.

Example 2: The gun tube of example 1 that further comprises a first end fitting attached to the first end of the body.

Example 3: The gun tube of example 2 that further comprises a second end fitting attached to the second end of the body.

Example 4. The gun tube according to any one of examples 1-3 that further comprises a sensor configured to detect the location of the explosive charges.

Example 5: The gun tube of example 3, wherein the sensor comprises an accelerometer.

Example 6: The gun tube of example 3, wherein the sensor comprises one or more of an accelerometer, a magnetometer, and gyroscope.

Example 7: A system comprising the gun tube of example 6 and a motor control remote to the gun tube, the motor control configured to operate the motor.

Example 8: The system of example 7, wherein the motor control is a computer.

Example 9: The system of example 7 that further includes a receiver for receiving transmissions sent by a sensor.

Example 10: The system according to any one of examples 7-8, wherein the motor control is configured to be operated by a human operator.

Example 11: The system according to any one of examples 7-8, wherein the motor control is configured to be operated by a machine operator.

Example 12: The gun tube or system according to any one of examples 1-11, wherein the at least first end fitting comprises:

(a) an outer collar;

(b) a bearing housing that includes ball bearings and a central opening; and (c) a support having a first portion with a first diameter and a second portion with a second diameter that is greater than the first diameter, wherein the bearing housing is positioned on the first portion and the central opening surrounds at least part of the first portion, and the outer collar is fastened to the support.

Example 13: The gun tube according to any one of examples 1-12 that further comprises one or more charge openings configured to receive an explosive charge.

Example 14: The gun tube or system of example 13 that further comprises one or more explosive charges in the one or more charge openings.

Example 15: The gun tube or system of example 13 that further comprises one or more clip openings configured to receive charge clips.

Example 16: The gun tube or system of example 15 that comprises one or more clips in the one or more clip openings.

Example 17: The gun tube or system according to any one of examples 2-16, wherein the first end fitting includes a first end contact having a first, extended position and a second, contracted position, and that also comprises a second end fitting having a second end contact including a first, extended position and a second, extended position.

Example 18: The gun tube of example 12, wherein the outer collar has one or more openings, wherein at least one of the one or more openings contains grounding hardware biased to a first, extended position, and that also has a second, contracted position.

Example 19: The gun tube or system according to any one of examples 2-18, wherein the first end fitting comprises an end contact having a first end that comprises a stem, the stem being positioned inside of the cavity, and the end contact having a second end, the second end comprising an electrical contact that is positioned outside of the body.

Example 20: The gun tube or system of example 19, wherein the end contact is configured to transmit electricity therethrough.

Example 21: The gun tube or system according to any one of examples 2-20, wherein the first end fitting comprises a first end contact that includes a housing and one or more frangible elements extending outwardly from the housing.

Example 22: The gun tube or system of example 21 that further comprises a second end fitting that includes a second end contact having a housing and one or more frangible elements extending outwardly from the housing.

Example 23: The gun tube or system of example 21, wherein the housing and frangible elements are comprised of plastic and the frangible elements are configured to break away from the housing upon the application of explosive, outward axial force caused by explosion of one or more explosive charges in Example 1: The gun tube.

Example 24: The gun tube or system of example 17, wherein the first end contact is biased towards the first, extended position.

Example 25: The gun tube or system of example 24, wherein the second end contact is biased towards the first, extended position.

Example 26: The gun tube or system of example 24 that further includes a spring on a housing of the first end contact, the spring configured to bias the first end contact to the first, extended position, and the spring configured to compress when the first end contact moves to its second, contracted position.

Example 27: The gun tube or system of example 26 that further includes a spring on a housing of the second end contact, the spring configured to bias the first end contact to the first, extended position, and the spring configured to compress when the first end contact moves to its second, contracted position.

Example 28: The gun tube or system according to any one of examples 17-27, wherein the distance between the first, extended position and the second, contracted position of the first end contact is between 0.150" and 1.250".

Example 29: The gun tube or system of example 28, wherein the distance between the first, extended position and the second, contracted position of the second end contact is between 0.150" and 1.250".

Some further non-limiting examples of this disclosure are as follows:

Example 1: A gun-tube extension connected to a down-hole gun tube, wherein the down-hole gun tube includes a plurality of explosive charges and a detonator, the gun-tube extension comprising:

(a) a body portion;

(b) a first end configured to connect to the down-hole gun tube; and (c) a support in the body portion that is configured to retain a switch to detonate the detonator.

Example 2: The gun-tube extension of example 1 that further includes a switch positioned on the support and a wire having a first end connected to the switch and a second end connected to the detonator.

Example 3: The gun-tube extension of example 2, wherein the switch is an addressable switch.

Example 4: The gun-tube extension according to any one of examples 1-3, wherein the extension has a length of between 4" and 8".

Example 5: The gun-tube extension according to any one of examples 1-4, wherein the first end is configured to rotate about the down-hole gun tube.

Example 6: The gun-tube extension according to any one of examples 1-5 that further includes a second end opposite the first end.

Example 7: The gun-tube extension of example 6, wherein the second end is connected to a sub-assembly.

Example 8: The gun-tube extension of example 6, wherein the second end is configured to rotate about a sub-assembly.

Example 9: The gun-tube extension according to any one of examples 1-8, wherein the support is comprised of plastic.

Example 10: The gun-tube extension according to any one of examples 1-9 that further includes an accelerometer in the cavity.

Example 11: The gun-tube extension of example 3 that further includes an accelerometer a body portion.

Example 12: The gun-tube extension of example 3 that further includes an accelerometer on the addressable switch.

Example 13: The gun-tube extension according to any one of examples 1-12 that further includes a motor configured to rotate the extension.

Example 14: The gun-tube extension according to any one of examples 1-13 that further includes a motor configured to rotate the extension.

Some further non-limiting examples of this disclosure are as follows:

Example 1: A gun tube for down-hole operations, the gun tube comprising:

(a) a body including an inner cavity and an outer surface; and (b) a bow spring positioned on the outer surface.

Example 2: A gun-tube assembly that comprises:

(a) an outer casing having an inner surface; and (b) the gun tube of example 1 positioned in the interior such that the bow spring touches the inner surface.

Example 3: The gun tube or gun-tube assembly according to any one of examples 1-2 that further includes at least one end cap and the bow spring is not in contact with the at least one end cap.

Example 4: The gun tube or gun-tube assembly according to any one of examples 1-2 that further includes at least one end cap and the bow spring is in contact with the at least one end cap.

Having thus described different embodiments, other variations and embodiments that do not depart from the spirit of this disclosure will become apparent to those skilled in the art. The scope of the claims is thus not limited to any particular embodiment, but is instead set forth in the claims and the legal equivalents thereof. Unless expressly stated in the written description or claims, the steps of any method recited in the claims may be performed in any order capable of yielding the desired product. No language in the specification should be construed as indicating that any non-claimed limitation is included in a claim. The terms "a" and "an" in the context of the following claims are to be construed to cover both the singular and the plural, unless otherwise indicated herein.

What is claimed:

1. A gun-tube extension comprising:

(a) a body portion, a first end, and a second end;

(b) wherein the first end is configured to be connected to a first end cap that is connected to a gun tube, and the first end comprises a plurality of outwardly-extending fingers configured to connect to openings in the first end cap and the first end cap has a plurality of openings, and wherein each of the plurality of openings is configured to receive one of the plurality of outwardly-extending fingers;

(c) wherein to the second end is configured to be connected to a sub-assembly;

(d) a support positioned in the body portion, the support configured to retain a switch that is configured to detonate explosives positioned in the gun tube.

2. The gun-tube extension of claim 1, wherein the second end has an annular outer surface with a flat portion.

3. The gun-tube extension of claim 1, wherein the switch is an addressable switch.

4. The gun-tube extension of claim 1, wherein the end cap is connected to the gun tube, and (b) the second end is connected to the sub-assembly.

5. The gun-tube extension of claim 1, wherein the body portion and first end are configured to rotate around the sub-assembly.

6. The gun-tube extension of claim 4, wherein the body portion and gun tube are configured to rotate together.

7. The gun-tube extension of claim 1 that further comprises a weight in the body portion.

8. The gun-tube extension of claim 1 that further includes one or more weights attached to the body portion, the one or more weights configured to rotate the body portion around a longitudinal axis of the gun-tube extension, based on gravity acting on the one or more weights.

9. The gun-tube extension of claim 7, wherein the weight weighs from 2 lbs. to 8 lbs. at sea level.

10. The gun-tube extension of claim 1 that further includes a detonator in the body portion, wherein the detonator is in electrical communication with the switch.

11. The gun-tube extension of claim 10 that further includes a primer cord that extends from the body portion into the gun tube and that transmits a signal from the switch to explosives in the gun tube in order to activate the explosives.

12. The gun-tube extension of claim 1, wherein the second end is connected to the sub-assembly.

13. The gun-tube extension of claim 1 that is directly or indirectly connected to a motor configured to rotationally move the gun-tube extension.

14. The gun-tube extension of claim 1 that further includes an position-orientation device that determines the rotational orientation of the gun-tube extension.

15. The gun-tube extension of claim 14, wherein the position-orientation device is part of the addressable switch.

16. The gun-tube extension of claim 14, wherein the orientation device is on the outside of the gun-tube extension.

17. The gun-tube extension of claim 1, wherein an expandable bow spring is positioned on an outer surface of the gun-tube extension, the expandable bow spring configured to provide an electrical ground.

18. The gun-tube extension of claim 17, wherein the bow spring is expandable to about ⅜" from its relaxed position.

19. The gun-tube extension of claim 18, wherein the bow spring is connected to a buttress that can be compressed to expand the bow spring and opened to retract the bow spring.

20. The gun-tube extension of claim 1, wherein the first end cap is rotatable to a plurality of indexed positions.

* * * * *